US008900702B2

(12) United States Patent
Shirakashi et al.

(10) Patent No.: US 8,900,702 B2
(45) Date of Patent: Dec. 2, 2014

(54) ARTIFICIAL HAIR AND WIG USING THE SAME

(75) Inventors: Yutaka Shirakashi, Shinjuku-ku (JP); Takayuki Watanabe, Shinjuku-ku (JP); Osamu Asakura, Shinjuku-ku (JP); Nobuyoshi Imai, Shinjuku-ku (JP); Akemi Irikura, Shinjuku-ku (JP)

(73) Assignee: Aderans Company Limited, Tokyo (JP)

( * ) Notice: Subject to any disclaimer, the term of this patent is extended or adjusted under 35 U.S.C. 154(b) by 348 days.

(21) Appl. No.: 12/375,531

(22) PCT Filed: Aug. 7, 2007

(86) PCT No.: PCT/JP2007/065429
§ 371 (c)(1),
(2), (4) Date: Jan. 28, 2009

(87) PCT Pub. No.: WO2008/020552
PCT Pub. Date: Feb. 21, 2008

(65) Prior Publication Data

US 2009/0320866 A1 Dec. 31, 2009

(30) Foreign Application Priority Data

Aug. 14, 2006 (JP) ..... 2006-220901
Jul. 31, 2007 (JP) ..... 2007-199924

(51) Int. Cl.

| | |
|---|---|
| ***D02G 3/00*** | (2006.01) |
| ***C08K 3/34*** | (2006.01) |
| ***A45D 7/02*** | (2006.01) |
| ***B32B 3/02*** | (2006.01) |
| ***A41G 3/00*** | (2006.01) |
| ***D01F 8/12*** | (2006.01) |

(52) U.S. Cl.
CPC ..... *A41G 3/0083* (2013.01); *D01F 8/12* (2013.01)
USPC ..... 428/373; 524/445; 132/212; 428/85

(58) Field of Classification Search
USPC ..... 132/53, 56, 212; 428/370, 373, 374, 85; 524/445
See application file for complete search history.

(56) References Cited

U.S. PATENT DOCUMENTS 4,792,489 A 12/1988 Kakiuchi et al.
4,970,042 A 11/1990 Kakiuchi et al.

(Continued)

FOREIGN PATENT DOCUMENTS

DE 4314023 A1 11/1994
EP 1010784 A1 6/2000

(Continued)

OTHER PUBLICATIONS

English machine translation of JP-08 060439 A, published Mar. 1996.*
Kawabata, "Characterization Method of the Physical Property of Fabrics and the Measuring System for Hand-feeling Evaluation" Sen'ikikai Gakkaishi (Journal of Textile Machine Society, Textile Engineering), 1973, 27, pp. 721-728, English abstract included.

(Continued)

*Primary Examiner* — Jennifer Chriss
*Assistant Examiner* — Ricardo E Lopez
(74) *Attorney, Agent, or Firm* — Chen Yoshimua LLP

(57) ABSTRACT

An artificial hair and a wig using the same are provided which have the property of thermal deformation expanding upon heating by a hair drier or others used for hair styling.
The artificial hair 1 is made by mixing at the pre-determined ratio a semi-aromatic polyamide having a glass transition temperature between 60-120° C. and a resin not expanding in said temperature range. The artificial hair may have a sheath/core structure comprising a core portion 5B and a sheath portion covering the core portion. As the resin not expanding in said temperature range, polyethylene terephthalate or others can be used, and as the sheath, nylon 6 or nylon 66 can be used. Said artificial hair 1 can maintain its shape at room temperature or after shampooing due to thermal deformation by heating in steam atmosphere at temperature of glass transition or higher or about 80-100° C.

14 Claims, 27 Drawing Sheets

(56) References Cited

U.S. PATENT DOCUMENTS

| | | | | | |
|---|---|---|---|---|---|
| 5,153,066 | A | * | 10/1992 | Tanaka et al. | 428/373 |
| 5,895,718 | A | | 4/1999 | Ishimura et al. | |
| 6,159,598 | A | * | 12/2000 | Ishimura | 428/370 |
| 6,749,935 | B2 | | 6/2004 | Ishimura | |
| 6,906,160 | B2 | | 6/2005 | Stevens et al. | |
| 7,199,203 | B2 | | 4/2007 | Stevens et al. | |
| 7,344,775 | B2 | | 3/2008 | Stevens et al. | |
| 2003/0039779 | A1 | * | 2/2003 | Share et al. | 428/35.7 |
| 2003/0144402 | A1 | * | 7/2003 | Schenck | 524/445 |
| 2007/0184264 | A1 | | 8/2007 | Masuda | |
| 2008/0314402 | A1 | | 12/2008 | Shirakashi et al. | |
| 2009/0126749 | A1 | | 5/2009 | Shirakashi et al. | |
| 2009/0320866 | A1 | | 12/2009 | Shirakashi et al. | |
| 2010/0229882 | A1 | | 9/2010 | Sotokawa et al. | |

FOREIGN PATENT DOCUMENTS

| | | | | |
|---|---|---|---|---|
| JP | S64-6114 | A | | 1/1989 |
| JP | 01-282309 | | * | 11/1989 |
| JP | 03-185103 | | * | 8/1991 |
| JP | 3-185103 | A | | 8/1991 |
| JP | 6287807 | A | | 10/1994 |
| JP | 07-157909 | | * | 6/1995 |
| JP | 08060439 | A | * | 3/1996 |
| JP | H10-127950 | A | | 5/1998 |
| JP | 2000-178833 | A | | 6/2000 |
| JP | 2001-123328 | A | | 5/2001 |
| JP | 2002-129432 | A | | 5/2002 |
| JP | 2002-161423 | A | | 6/2002 |
| JP | 2003-221733 | A | | 8/2003 |
| JP | 2-4-052184 | | * | 2/2004 |
| JP | 2004-052184 | A | | 2/2004 |
| JP | 2005-9049 | A | | 1/2005 |
| JP | 2006-28700 | A | | 2/2006 |
| WO | 2005/089821 | A1 | | 9/2005 |
| WO | 2006-087911 | A1 | | 8/2006 |
| WO | 2006/087911 | A1 | | 8/2006 |

OTHER PUBLICATIONS

Katotech Ltd., Handling Manual of KES-SH Single Hair Bending Tester.

International Search Report (ISR) for PCT/JP2007/065429.

PCT/ISA/237 in PCT/JP2007/065429 and its English translation of Section V.

Schneider, "Flexibility and Phase Transitions of Polymers", Journal of Applied Polymer Science, Feb. 21, 2003, vol. 88, pp. 1590-1599 Cited in European Search Report.

Baschek et al., "Effect of water absorption in polymers at low and high temperatures", Polymer, Jun. 1, 1999, pp. 3433-3441 Cited in European Search Report.

European Search Report dated Aug. 20, 2010, in a counterpart European patent application No. 07792098.1.

Arpe et al., "Ullmann's Encyclopedia of Industrial Chemistry," 1992, pp. 178-181, 188-193, vol. A 21, VCH Publishers, Inc. Additional reference for MXD6 nylon, described in paragraph [0062] of the as-filed Specification.

U.S. Appl. No. 11/816,084, filed Dec. 1, 2008.

International Search Report (ISR) issued in PCT/JP2006/301647 mailed in Apr. 2006. (This ISR was issued in the related U.S. Appl. No. 11/816,084.).

Written Opinion (PCT/ISA/237) issued in PCT/JP2006/301647 mailed in Apr. 2006 and its translation of Section V. (This Written Opinion was issued in the related U.S. Appl. No. 11/816,084.).

English translation of Written Opinion (PCT/ISA/237) issued in PCT/JP2006/301647 mailed in Apr. 2006 and its transmittal form of IB338 and IB373. (This Written Opinion was issued in the related U.S. Appl. No. 11/816,084.).

English machine translation of JP H06-287807. (This original Japanese document has been submitted in a previous IDS.).

Japanese Office Action dated Nov. 1, 2011, in a counterpart Japanese patent application No. 2007-199924.

Japanese Office Action dated Apr. 3, 2012, in a counterpart Japanese patent application No. 2007-199924.

* cited by examiner

FIG. 13

(A) Ex.:Example C.Ex.: Comparative Example

| | Composition | | | Curl Diameter(mm) | | | | | |
|---|---|---|---|---|---|---|---|---|---|
| | MXD6 (%) | PET (%) | nylon6 (%) | Thermal Treatment 180℃ 2hours | Thermal Treatment 170℃ 1hour | Hair Drier 1 minute | Leaving for 24 hours | 40℃ Shampoo | Steaming for Recovery |
| Ex.1 | 97 | 3 | ––– | 25 | ––– | 48 | 45 | 45 | 30 |
| Ex.2 | 95 | 5 | | 25 | | 45 | 44 | 43 | 28 |
| Ex.3 | 90 | 10 | | 25 | | 42 | 41 | 40 | 27 |
| Ex.4 | 85 | 15 | | 25 | | 40 | 39 | 39 | 27 |
| Ex.5 | 80 | 20 | | 25 | | 38 | 38 | 36 | 26 |
| Ex.6 | 75 | 25 | | 25 | | 35 | 34 | 33 | 25 |
| Ex.7 | 70 | 30 | | 25 | | 30 | 30 | 30 | 25 |
| C.Ex.1 | 100 | 0 | ––– | 25 | ––– | 50 | 50 | 50 | 35 |
| C.Ex.2 | 99 | 1 | | 25 | | 50 | 49 | 49 | 32 |
| C.Ex.3 | 65 | 35 | | 25 | | 27 | 27 | 27 | 25 |
| C.Ex.4 | 60 | 40 | | 25 | | 26 | 25 | 25 | 25 |
| C.Ex.5 | 0 | 100 | | ––– | 25 | 25 | 25 | 25 | 25 |
| C.Ex.6 | ––– | ––– | 100 | ––– | 30 | 34 | 33 | 31 | 31 |

(B)

| | Deformation Ratio(%) | | |
|---|---|---|---|
| | Hair Drier 1 minute | Leaving for 24 hours | 40℃ Shampoo |
| Ex.1 | 192 | 94 | 94 |
| Ex.2 | 180 | 98 | 96 |
| Ex.3 | 168 | 98 | 95 |
| Ex.4 | 160 | 98 | 98 |
| Ex.5 | 152 | 100 | 95 |
| Ex.6 | 140 | 97 | 94 |
| Ex.7 | 120 | 100 | 100 |
| C.Ex.1 | 200 | 100 | 100 |
| C.Ex.2 | 200 | 98 | 98 |
| C.Ex.3 | 108 | 100 | 100 |
| C.Ex.4 | 104 | 96 | 96 |
| C.Ex.5 | 100 | 100 | 100 |
| C.Ex.6 | 113 | 97 | 91 |

(C)

| | Curl Diameter (mm) (Hair Drier 2 minutes) | Hair Drier Deformation Ratio (%) |
|---|---|---|
| Ex.1 | 55 | 220 |
| Ex.2 | 52 | 208 |
| Ex.3 | 50 | 200 |
| Ex.4 | 48 | 192 |
| Ex.5 | 46 | 184 |
| Ex.6 | 42 | 168 |
| Ex.7 | 35 | 140 |
| C.Ex.1 | 59 | 236 |
| C.Ex.2 | 58 | 232 |
| C.Ex.3 | 30 | 120 |
| C.Ex.4 | 28 | 112 |
| C.Ex.5 | 26 | 104 |
| C.Ex.6 | 35 | 117 |

FIG. 14

(A) Ex.:Example C.Ex.: Comparative Example

| | Composition | | | Curl Diameter (mm) | | | | | |
|---|---|---|---|---|---|---|---|---|---|
| | MXD6 (%) | PET (%) | nylon6 (%) | Thermal Treatment 180℃ 2hours | Thermal Treatment 170℃ 1hour | Hair Drier 1 minute | Leaving for 24 hours | 40℃ Shampoo | Steaming for Recovery |
| Ex.1 | 97 | 3 | | 21 | | 47 | 45 | 45 | 24 |
| Ex.2 | 95 | 5 | | 21 | | 43 | 42 | 41 | 23 |
| Ex.3 | 90 | 10 | | 21 | | 41 | 39 | 38 | 22 |
| Ex.4 | 85 | 15 | --- | 21 | --- | 39 | 35 | 35 | 22 |
| Ex.5 | 80 | 20 | | 21 | | 33 | 33 | 33 | 21 |
| Ex.6 | 75 | 25 | | 21 | | 31 | 29 | 28 | 21 |
| Ex.7 | 70 | 30 | | 21 | | 29 | 29 | 28 | 21 |
| C.Ex.1 | 100 | 0 | | 21 | | 50 | 49 | 49 | 29 |
| C.Ex.2 | 99 | 1 | | 21 | --- | 49 | 49 | 48 | 28 |
| C.Ex.3 | 65 | 35 | --- | 21 | | 25 | 25 | 24 | 21 |
| C.Ex.4 | 60 | 40 | | 21 | | 23 | 23 | 23 | 21 |
| C.Ex.5 | 0 | 100 | | --- | 21 | 22 | 21 | 21 | 21 |
| C.Ex.6 | --- | --- | 100 | --- | 26 | 29 | 28 | 26 | 26 |

(B)

| | Deformation Ratio (%) | | |
|---|---|---|---|
| | Hair Drier 1 minute | Leaving for 24 hours | 40℃ Shampoo |
| Ex.1 | 224 | 96 | 96 |
| Ex.2 | 205 | 98 | 95 |
| Ex.3 | 195 | 95 | 93 |
| Ex.4 | 186 | 90 | 90 |
| Ex.5 | 157 | 100 | 100 |
| Ex.6 | 148 | 94 | 90 |
| Ex.7 | 138 | 100 | 97 |
| C.Ex.1 | 238 | 98 | 98 |
| C.Ex.2 | 233 | 100 | 98 |
| C.Ex.3 | 119 | 100 | 96 |
| C.Ex.4 | 110 | 100 | 100 |
| C.Ex.5 | 105 | 95 | 95 |
| C.Ex.6 | 112 | 97 | 90 |

(C)

| | Curl Diameter (mm) (Hair Drier 2 minutes) | Hair Drier Deformation Ratio (%) |
|---|---|---|
| Ex.1 | 54 | 257 |
| Ex.2 | 52 | 248 |
| Ex.3 | 49 | 233 |
| Ex.4 | 47 | 224 |
| Ex.5 | 46 | 219 |
| Ex.6 | 40 | 190 |
| Ex.7 | 34 | 162 |
| C.Ex.1 | 59 | 281 |
| C.Ex.2 | 57 | 271 |
| C.Ex.3 | 30 | 143 |
| C.Ex.4 | 27 | 129 |
| C.Ex.5 | 23 | 105 |
| C.Ex.6 | 32 | 112 |

FIG. 15

(A) Ex.:Example C.Ex.: Comparative Example

| | Composition | | | Curl Diameter(mm) | | | | | |
|---|---|---|---|---|---|---|---|---|---|
| | MXD6 (%) | PET (%) | nylon6 (%) | Thermal Treatment 180℃ 2hours | Thermal Treatment 170℃ 1hour | Hair Drier 1 minute | Leaving for 24 hours | 40℃ Shampoo | Steaming for Recovery |
| Ex.1 | 97 | 3 | --- | 35 | --- | 57 | 57 | 56 | 37 |
| Ex.2 | 95 | 5 | | 35 | | 55 | 54 | 54 | 37 |
| Ex.3 | 90 | 10 | | 35 | | 54 | 54 | 53 | 36 |
| Ex.4 | 85 | 15 | | 35 | | 50 | 50 | 50 | 36 |
| Ex.5 | 80 | 20 | | 34 | | 47 | 46 | 46 | 35 |
| Ex.6 | 75 | 25 | | 34 | | 44 | 45 | 45 | 36 |
| Ex.7 | 70 | 30 | | 34 | | 43 | 44 | 43 | 35 |
| C.Ex.1 | 100 | 0 | --- | 35 | --- | 60 | 58 | 58 | 44 |
| C.Ex.2 | 99 | 1 | | 35 | | 60 | 57 | 56 | 42 |
| C.Ex.3 | 65 | 35 | | 34 | | 38 | 38 | 38 | 36 |
| C.Ex.4 | 60 | 40 | | 34 | | 38 | 35 | 37 | 35 |
| C.Ex.5 | 0 | 100 | | --- | 33 | 33 | 35 | 37 | 35 |
| C.Ex.6 | --- | --- | 100 | --- | 46 | 50 | 49 | 47 | 47 |

(B)

| | Deformation Ratio(%) | | |
|---|---|---|---|
| | Hair Drier 1 minute | Leaving for 24 hours | 40℃ Shampoo |
| Ex.1 | 163 | 100 | 98 |
| Ex.2 | 157 | 98 | 98 |
| Ex.3 | 154 | 100 | 98 |
| Ex.4 | 143 | 100 | 100 |
| Ex.5 | 138 | 98 | 98 |
| Ex.6 | 129 | 102 | 102 |
| Ex.7 | 126 | 102 | 100 |
| C.Ex.1 | 171 | 97 | 97 |
| C.Ex.2 | 171 | 95 | 93 |
| C.Ex.3 | 112 | 100 | 100 |
| C.Ex.4 | 112 | 100 | 97 |
| C.Ex.5 | 100 | 106 | 112 |
| C.Ex.6 | 109 | 98 | 94 |

(C)

| | Curl Diameter (mm) (Hair Drier 2 minutes) | Hair Drier Deformation Ratio (%) |
|---|---|---|
| Ex.1 | 64 | 183 |
| Ex.2 | 60 | 171 |
| Ex.3 | 59 | 169 |
| Ex.4 | 55 | 157 |
| Ex.5 | 54 | 159 |
| Ex.6 | 48 | 141 |
| Ex.7 | 48 | 141 |
| C.Ex.1 | 65 | 186 |
| C.Ex.2 | 65 | 186 |
| C.Ex.3 | 45 | 132 |
| C.Ex.4 | 40 | 118 |
| C.Ex.5 | 36 | 109 |
| C.Ex.6 | 52 | 113 |

FIG. 16

(A) Ex.:Example C.Ex.: Comparative Example

| | Composition | | | Curl Diameter (mm) | | | | | |
|---|---|---|---|---|---|---|---|---|---|
| | MXD6 (%) | PET (%) | nylon6 (%) | Thermal Treatment 180℃ 2hours | Thermal Treatment 170℃ 1hour | Hair Drier 1 minute | Leaving for 24 hours | 40℃ Shampoo | Steaming for Recovery |
| Ex.1 | 97 | 3 | --- | 55 | --- | 30 | 30 | 32 | 56 |
| Ex.2 | 95 | 5 | | 55 | | 30 | 30 | 32 | 55 |
| Ex.3 | 90 | 10 | | 55 | | 34 | 34 | 35 | 55 |
| Ex.4 | 85 | 15 | | 54 | | 35 | 36 | 38 | 54 |
| Ex.5 | 80 | 20 | | 54 | | 38 | 39 | 40 | 54 |
| Ex.6 | 75 | 25 | | 53 | | 39 | 40 | 40 | 53 |
| Ex.7 | 70 | 30 | | 53 | | 40 | 41 | 43 | 53 |
| C.Ex.1 | 100 | 0 | --- | 55 | --- | 30 | 31 | 32 | 59 |
| C.Ex.2 | 99 | 1 | | 55 | | 30 | 30 | 33 | 58 |
| C.Ex.3 | 65 | 35 | | 53 | | 44 | 46 | 47 | 53 |
| C.Ex.4 | 60 | 40 | | 53 | | 45 | 46 | 47 | 53 |
| C.Ex.5 | 0 | 100 | | --- | 50 | 48 | 50 | 50 | 50 |
| C.Ex.6 | --- | --- | 100 | --- | 62 | 55 | 60 | 64 | 64 |

(B)

| | Deformation Ratio (%) | | |
|---|---|---|---|
| | Hair Drier 1 minute | Leaving for 24 hours | 40℃ Shampoo |
| Ex.1 | 55 | 100 | 107 |
| Ex.2 | 55 | 100 | 107 |
| Ex.3 | 62 | 100 | 103 |
| Ex.4 | 65 | 103 | 109 |
| Ex.5 | 70 | 103 | 105 |
| Ex.6 | 74 | 103 | 103 |
| Ex.7 | 75 | 103 | 108 |
| C.Ex.1 | 55 | 103 | 107 |
| C.Ex.2 | 55 | 100 | 110 |
| C.Ex.3 | 83 | 105 | 107 |
| C.Ex.4 | 85 | 102 | 104 |
| C.Ex.5 | 96 | 104 | 104 |
| C.Ex.6 | 89 | 109 | 116 |

(C)

| | Curl Diameter (mm) (Hair Drier 2 minutes) | Hair Drier Deformation Ratio (%) |
|---|---|---|
| Ex.1 | 25 | 45 |
| Ex.2 | 26 | 47 |
| Ex.3 | 26 | 47 |
| Ex.4 | 29 | 54 |
| Ex.5 | 30 | 56 |
| Ex.6 | 35 | 66 |
| Ex.7 | 38 | 72 |
| C.Ex.1 | 25 | 45 |
| C.Ex.2 | 25 | 45 |
| C.Ex.3 | 40 | 75 |
| C.Ex.4 | 41 | 77 |
| C.Ex.5 | 47 | 94 |
| C.Ex.6 | 50 | 81 |

FIG. 23

(A) Ex.:Example C.Ex.: Comparative Example

| | Composition | | Curl Diameter (mm) | | | | |
|---|---|---|---|---|---|---|---|
| | MXD6 (%) | PET (%) | Thermal Treatment 180℃ 2hours | Hair Drier 1 minute | Leaving for 24 hours | 40℃ Shampoo | Steaming for Recovery |
| Ex.8 | 97 | 3 | 25 | 49 | 45 | 45 | 30 |
| Ex.9 | 95 | 5 | 25 | 46 | 41 | 43 | 30 |
| Ex.10 | 90 | 10 | 25 | 43 | 40 | 40 | 30 |
| Ex.11 | 85 | 15 | 25 | 40 | 40 | 37 | 28 |
| Ex.12 | 80 | 20 | 25 | 38 | 38 | 34 | 28 |
| Ex.13 | 75 | 25 | 25 | 35 | 34 | 32 | 27 |
| Ex.14 | 70 | 30 | 25 | 30 | 30 | 28 | 26 |
| C.Ex.7 | 100 | 0 | 25 | 50 | 50 | 50 | 35 |
| C.Ex.8 | 99 | 1 | 25 | 50 | 49 | 49 | 32 |
| C.Ex.9 | 65 | 35 | 25 | 27 | 27 | 27 | 25 |
| C.Ex.10 | 60 | 40 | 25 | 26 | 25 | 25 | 25 |

(B)

| | Deformation Ratio (%) | | |
|---|---|---|---|
| | Hair Drier 1 minute | Leaving for 24 hours | 40℃ Shampoo |
| Ex.8 | 196 | 92 | 92 |
| Ex.9 | 184 | 89 | 93 |
| Ex.10 | 172 | 93 | 93 |
| Ex.11 | 160 | 100 | 93 |
| Ex.12 | 152 | 100 | 89 |
| Ex.13 | 140 | 97 | 91 |
| Ex.14 | 120 | 100 | 93 |
| C.Ex.7 | 200 | 100 | 100 |
| C.Ex.8 | 200 | 98 | 98 |
| C.Ex.9 | 108 | 100 | 100 |
| C.Ex.10 | 104 | 96 | 96 |

(C)

| | Curl Diameter (Hair Drier 2 minutes) | Hair Drier Deformation Ratio (%) |
|---|---|---|
| Ex.8 | 55 | 220 |
| Ex.9 | 50 | 200 |
| Ex.10 | 50 | 200 |
| Ex.11 | 46 | 184 |
| Ex.12 | 45 | 180 |
| Ex.13 | 42 | 168 |
| Ex.14 | 35 | 140 |
| C.Ex.7 | 59 | 236 |
| C.Ex.8 | 57 | 228 |
| C.Ex.9 | 30 | 120 |
| C.Ex.10 | 28 | 112 |

FIG. 24

(A) Ex.:Example C.Ex.: Comparative Example

| | Composition | | Curl Diameter(mm) | | | | |
|---|---|---|---|---|---|---|---|
| | MXD6 (%) | PET (%) | Thermal Treatment 180℃ 2hours | Hair Drier 1 minute | Leaving for 24 hours | 40℃ Shampoo | Steaming for Recovery |
| Ex.8 | 97 | 3 | 22 | 49 | 45 | 44 | 24 |
| Ex.9 | 95 | 5 | 22 | 45 | 42 | 40 | 23 |
| Ex.10 | 90 | 10 | 21 | 42 | 40 | 37 | 23 |
| Ex.11 | 85 | 15 | 22 | 39 | 35 | 35 | 23 |
| Ex.12 | 80 | 20 | 21 | 33 | 32 | 32 | 22 |
| Ex.13 | 75 | 25 | 21 | 32 | 29 | 28 | 22 |
| Ex.14 | 70 | 30 | 21 | 30 | 29 | 27 | 22 |
| C.Ex.7 | 100 | 0 | 22 | 50 | 47 | 48 | 30 |
| C.Ex.8 | 99 | 1 | 22 | 49 | 47 | 48 | 29 |
| C.Ex.9 | 65 | 35 | 21 | 26 | 25 | 24 | 22 |
| C.Ex.10 | 60 | 40 | 21 | 23 | 23 | 23 | 21 |

(B)

| | Deformation Ratio(%) | | |
|---|---|---|---|
| | Hair Drier 1 minute | Leaving for 24 hours | 40℃ Shampoo |
| Ex.8 | 223 | 92 | 90 |
| Ex.9 | 205 | 93 | 89 |
| Ex.10 | 200 | 95 | 88 |
| Ex.11 | 177 | 90 | 90 |
| Ex.12 | 157 | 97 | 97 |
| Ex.13 | 152 | 91 | 88 |
| Ex.14 | 143 | 97 | 90 |
| C.Ex.7 | 227 | 94 | 96 |
| C.Ex.8 | 223 | 96 | 98 |
| C.Ex.9 | 124 | 96 | 92 |
| C.Ex.10 | 110 | 100 | 100 |

(C)

| | Curl Diameter (Hair Drier 2 minutes) | Hair Drier Deformation Ratio (%) |
|---|---|---|
| Ex.8 | 53 | 241 |
| Ex.9 | 49 | 223 |
| Ex.10 | 49 | 233 |
| Ex.11 | 45 | 205 |
| Ex.12 | 45 | 214 |
| Ex.13 | 40 | 190 |
| Ex.14 | 34 | 162 |
| C.Ex.7 | 56 | 255 |
| C.Ex.8 | 55 | 250 |
| C.Ex.9 | 30 | 143 |
| C.Ex.10 | 28 | 133 |

FIG. 25

(A) Ex.:Example C.Ex.: Comparative Example

| | Composition | | Curl Diameter (mm) | | | | |
|---|---|---|---|---|---|---|---|
| | MXD6 (%) | PET (%) | Thermal Treatment 180℃ 2hours | Hair Drier 1 minute | Leaving for 24 hours | 40℃ Shampoo | Steaming for Recovery |
| Ex.8 | 97 | 3 | 37 | 59 | 58 | 57 | 38 |
| Ex.9 | 95 | 5 | 35 | 56 | 54 | 55 | 38 |
| Ex.10 | 90 | 10 | 35 | 56 | 55 | 54 | 37 |
| Ex.11 | 85 | 15 | 35 | 51 | 51 | 50 | 37 |
| Ex.12 | 80 | 20 | 35 | 48 | 46 | 45 | 35 |
| Ex.13 | 75 | 25 | 35 | 44 | 45 | 43 | 36 |
| Ex.14 | 70 | 30 | 34 | 43 | 44 | 43 | 35 |
| C.Ex.7 | 100 | 0 | 38 | 61 | 60 | 60 | 47 |
| C.Ex.8 | 99 | 1 | 37 | 61 | 59 | 58 | 46 |
| C.Ex.9 | 65 | 35 | 34 | 38 | 38 | 38 | 36 |
| C.Ex.10 | 60 | 40 | 34 | 38 | 38 | 37 | 36 |

(B)

| | Deformation Ratio (%) | | |
|---|---|---|---|
| | Hair Drier 1 minute | Leaving for 24 hours | 40℃ Shampoo |
| Ex.8 | 159 | 98 | 97 |
| Ex.9 | 160 | 96 | 98 |
| Ex.10 | 160 | 98 | 96 |
| Ex.11 | 146 | 100 | 98 |
| Ex.12 | 137 | 96 | 94 |
| Ex.13 | 126 | 102 | 98 |
| Ex.14 | 126 | 102 | 100 |
| C.Ex.7 | 161 | 98 | 98 |
| C.Ex.8 | 165 | 97 | 95 |
| C.Ex.9 | 112 | 100 | 100 |
| C.Ex.10 | 112 | 100 | 97 |

(C)

| | Curl Diameter (Hair Drier 2 minutes) | Hair Drier Deformation Ratio (%) |
|---|---|---|
| Ex.8 | 64 | 173 |
| Ex.9 | 59 | 169 |
| Ex.10 | 59 | 169 |
| Ex.11 | 54 | 154 |
| Ex.12 | 54 | 154 |
| Ex.13 | 48 | 137 |
| Ex.14 | 48 | 141 |
| C.Ex.7 | 64 | 168 |
| C.Ex.8 | 64 | 173 |
| C.Ex.9 | 45 | 132 |
| C.Ex.10 | 40 | 118 |

FIG. 26

(A) Ex.:Example C.Ex.: Comparative Example

| | Composition | | Curl Diameter (mm) | | | | |
|---|---|---|---|---|---|---|---|
| | MXD6 (%) | PET (%) | Thermal Treatment 180℃ 2hours | Hair Drier 1 minute | Leaving for 24 hours | 40℃ Shampoo | Steaming for Recovery |
| Ex.8 | 97 | 3 | 57 | 33 | 33 | 35 | 57 |
| Ex.9 | 95 | 5 | 56 | 33 | 34 | 35 | 56 |
| Ex.10 | 90 | 10 | 56 | 34 | 34 | 35 | 56 |
| Ex.11 | 85 | 15 | 55 | 35 | 36 | 38 | 55 |
| Ex.12 | 80 | 20 | 54 | 39 | 39 | 40 | 54 |
| Ex.13 | 75 | 25 | 54 | 39 | 40 | 40 | 54 |
| Ex.14 | 70 | 30 | 53 | 40 | 41 | 43 | 53 |
| C.Ex.7 | 100 | 0 | 58 | 34 | 35 | 37 | 60 |
| C.Ex.8 | 99 | 1 | 57 | 34 | 35 | 36 | 60 |
| C.Ex.9 | 65 | 35 | 53 | 45 | 46 | 47 | 54 |
| C.Ex.10 | 60 | 40 | 53 | 47 | 47 | 47 | 53 |

(B)

| | Deformation Ratio (%) | | |
|---|---|---|---|
| | Hair Drier 1 minute | Leaving for 24 hours | 40℃ Shampoo |
| Ex.8 | 58 | 100 | 106 |
| Ex.9 | 59 | 103 | 106 |
| Ex.10 | 61 | 100 | 103 |
| Ex.11 | 64 | 103 | 109 |
| Ex.12 | 72 | 100 | 103 |
| Ex.13 | 72 | 103 | 103 |
| Ex.14 | 75 | 103 | 108 |
| C.Ex.7 | 59 | 103 | 109 |
| C.Ex.8 | 60 | 103 | 106 |
| C.Ex.9 | 85 | 102 | 104 |
| C.Ex.10 | 89 | 100 | 100 |

(C)

| | Curl Diameter (Hair Drier 2 minutes) | Hair Drier Deformation Ratio (%) |
|---|---|---|
| Ex.8 | 27 | 47 |
| Ex.9 | 27 | 48 |
| Ex.10 | 27 | 48 |
| Ex.11 | 29 | 53 |
| Ex.12 | 32 | 59 |
| Ex.13 | 37 | 69 |
| Ex.14 | 39 | 74 |
| C.Ex.7 | 27 | 47 |
| C.Ex.8 | 27 | 47 |
| C.Ex.9 | 42 | 79 |
| C.Ex.10 | 44 | 83 |

ARTIFICIAL HAIR AND WIG USING THE SAME

TECHNICAL FIELD

This invention relates to artificial hair having thermally deforming property upon heating by a hair drier or else for hair dressing and a wig using the same.

BACKGROUND ART

Wigs have been manufactured and used since ancient age with natural hair as the material, but recently such problems as the supply limitation of natural hair material and others caused the manufacture to increase using synthetic fibers as hair material for wigs. In this case, the synthetic fiber to be used is selected with the primary target that it is basically close to natural hair in terms of feeling and physical properties.

The artificial hair materials to be used are synthetic fibers of acrylic, polyester, and polyamide in many cases, but acrylic fibers in general have low melting point and poor heat stability, so that they have such weak points as poor shape preservation after style setting by heat treatment, resulting in distortion of setting, for example, such as curl and the like when contacted to warm water. Polyester fibers excel in strength and heat stability, but have too high bending rigidity, in addition to extremely low moisture absorbency compared with natural hair, resulting in appearance, feeling, or physical properties different from natural hair, for example, in the environment of high humidity, and they give markedly uncomfortable feeling when used for wigs.

Here, the bending rigidity is the physical property correlating to such feeling as tactile and texture of fibers, and is widely recognized in fiber and textile industries as such that capable of numerical expression by KAWABATA method of measurement (See Non-Patent Reference 1.) Also, an apparatus has been developed which can measure the bending rigidity using a single strand of fiber or hair (See Non-Patent Reference 2.) Said bending rigidity is also called bending hardness, and is defined as the reciprocal number of curvature change generated when a unit bending moment is applied to artificial hair. The larger the bending rigidity of artificial hair, the less bendable, the more resistant to bending, that is, the harder and the less bendable is artificial hair. In other words, the smaller the bending rigidity, the more bendable and softer is artificial hair.

Since polyamide fibers can offer appearance and physical properties similar to natural hair in many aspects, they have so far been in practical use as the hair for wigs. Especially, the invention by the present applicant of the method of manufacture that can remove unnatural gloss by surface processing provided excellent wigs (See Patent Reference 1.)

Polyamide fibers include linear saturated aliphatic polyamide in which only methylene chains are connected with amide bond as a main chain, for example, such as nylon 6 and nylon 66, and semi-aromatic polyamide in which phenylene units are included in the main chain, for example, such as nylon 6T of TOYOBO Co., LTD. and MXD6 of MITSUBISHI GAS CHEMICAL COMPANY, INC. Patent Reference 1 discloses surface-processed artificial hair of nylon 6 fiber as the material.

On the other hand, the artificial hair using nylon 6T has the bending rigidity higher than the natural hair, and hence it is difficult to manufacture the hair of the same property as natural hair. Therefore, it might be considered to manufacture the fiber having the bending rigidity close to natural hair by melt-spinning of nylon 6 and nylon 6T. But these two resins have too different melting points, and if melt temperature is determined fitting to nylon 6T of higher melting point, then there is too serious a problem in the manufacturing process that nylon 6 having low melting point and relatively poor heat stability is deteriorated by thermal oxidation during melting. Consequently, nylon 6T, the single filament of its sole body or mixture with other resin, has not so far been in practical use as an artificial hair material.

The fiber of sheath/core structure is known as the method to utilize both properties of two kinds of resins. Said fiber comprises as one strand of fiber a core fiber and a sheath fiber surrounding it, and can be a generic fiber, or artificial hair material for wigs, by utilizing respective properties of different two kinds of resins. For example, Patent Reference 2 discloses the fiber of sheath/core structure made of vinylidene chloride, polypropylene, and others, and Patent Reference 3 discloses a polyamide, but modified fiber by blending protein bridged gel into the core part.

Further, since using an ordinary synthetic fiber having transparency as artificial hair causes unnatural gloss, various attempts have been tried to suppress it by making uneven surface to cause opacity, thereby to give the appearance and feeling close to natural hair. The above-mentioned Patent Reference 1 discloses the method of making uneven surface by causing spherulite to be generated and grow, and Patent Reference 4 by treating the fiber surface with chemical reagents. In addition, the method of blast-treating of the artificial hair surface with fine powders such as sand, ice, and dry ice is also known.

Artificial hair to be used for wigs is required primarily to have feeling (appearance, tactile and texture) and physical properties close to natural hair, and in addition, ideally speaking, the physical properties superior to natural hair. As mentioned above, various synthetic fiber materials have their own merits and weak points, respectively, and among them, specific polyamide fibers, especially nylon 6 and nylon 66, are in practical use because of their superior properties, but even they can not be hair-dressed using a hair drier as natural hair.

Patent References 5 and 6 disclose thermoplastic resins capable of deforming their shapes by temperature or external stress, and a string-shaped false hair using said resins which can be used for the hair of dolls.

[Patent Reference 1] Japanese Patent Laid Open Application No. JP S64-6114 A (1989)

[Patent Reference 2] Japanese Patent Laid Open Application No. JP 2002-129432 A (2002)

[Patent Reference 3] Japanese Patent Laid Open Application No. JP 2005-9049 A (2005)

[Patent Reference 4] Japanese Patent Laid Open Application No. JP 2002-161423 A (2002)

[Patent Reference 5] Japanese Patent Laid Open Application No. JP H10-127950 A (1998)

[Patent Reference 6] Japanese Patent Laid Open Application No. JP 2006-28700 A (2006)

[Non-Patent Reference 1] Sen'ikikai Gakkaishi (Journal of Textile Machine Society, Textile Engineering), Sueo KAWABATA, 26, 10, pp. 721-728, 1973

[Non-Patent Reference 2] KATOTECH LTD., Handling Manual of KES-SH Single Hair Bending Tester

DISCLOSURE OF INVENTION

Problems to be Solved by the Invention

Artificial hair to be used for wigs is required primarily to have feeling (appearance, tactile and texture) and physical properties close to natural hair, and in addition, ideally speaking, the physical properties superior to natural hair. As mentioned above, various synthetic fiber materials have their own merits and weak points, respectively, and among them, specific polyamide fibers, especially nylon 6 and nylon 66, are in practical use because of their superior properties.

However, not only the artificial hair of said polyamide resins but also the artificial hair with a material of polyester resins or others can not be hair-dressed using a hair drier as natural hair, so that they are provided to users after being curled beforehand at the relatively high temperature of about 150° C., and then being shape-memorized before shipping out of wigs. For example, when a wig using the artificial hair of nylon 6 is provided to a user, a wig is manufactured using artificial hair having curl curvature changed according to the user's preference, the pre-determined hair style is prepared, and then it is shipped out to the user.

Therefore, once a wig is manufactured, then it is impossible to change the hair style of when the wig was originally manufactured, even if it is tried to change the hair style using a hair drier. However, since it is not natural that even a wig wearer keeps an unchanged wig hair style, the wig wearer has necessity or desire to change the hair style, if only to a small extent, at times and in occasions by making different hair styles using a hair drier, or by changing a hair style by changing wavings or hair flow directions, even if the hair style can not be changed to a large extent. Unfortunately, however, there is such a problem that artificial hair is not currently obtained which is capable of changing a hair style by using a hair drier as natural hair in case of a wig using artificial hair.

An object of the present invention is, in view of the above-mentioned problems, to provide a novel artificial hair and a wig using it, wherein said artificial hair is capable of setting hair styles according to individual one's preference using a hair drier as is natural hair, and of maintaining said hair styles.

Means to Solve Problems

The present inventors discovered as the result of strenuous study that, for the fiber fabricated with a polyamide synthetic resin as the main component and mixing a specific resin into it in a specific ratio, after an initial shape forming occurred by heating at around the softening temperature of said fiber, a thermal deformation different from the initial shape forming occurred thereafter by heating to the pre-determined temperature above room temperature and below the temperature at which the initial shape is forming. They discovered also that the shape of the fiber after deformation can be maintained. By further study, it was discovered that the extent of thermal deformation can be arbitrarily changed by changing the mixing ratio of said specific resin, this is freely controllable, and the initial shape-memorized state can be anytime recovered. Thus, the present invention has been completed by preparing artificial hair utilizing such properties of fiber.

On the other hand, prior to the problems to study in the present invention, the present inventors have acquired the knowledge that such a fiber is optimal as the artificial hair having the feeling (appearance, tactile and texture) and physical properties quite close to natural hair utilizing two resins by making a double structure of sheath/core ratio within a specific range wherein the core portion is made of a polyamide fiber of high bending rigidity, and the sheath portion is made of a polyamide fiber of bending rigidity lower than the core portion, utilizing the characteristics of polyamide synthetic fibers. Further study revealed that the artificial hair can be obtained which shows the thermal deformation characteristics similar to that of said fiber and bending rigidity and its humidity dependency similar to natural hair by such sheath/core double structure as mentioned above with a specific resin mixed into the core portion at the pre-determined ratio, resulting in the completion of the present invention.

In order to achieve the above-mentioned object, a first artificial hair of the present invention is characterized to be prepared by mixing a semi-aromatic polyamide resin having a glass transition temperature in the range of 60-120° C. and a resin which does not expand in said temperature range in the pre-determined ratio.

According to the constitution mentioned above, the degree of curling, namely, the curl diameter of an artificial hair can be changed by shape-memorizing after spinning at relatively high temperature over 150° C., followed by blowing hot air at 60-120° C., the temperature higher than room temperature, for example, in the range of hair drier using temperature. This is referred to as secondary shape forming in the present invention. Moreover, said secondary shape forming can be maintained not only in the ordinary state of use, but also after hair washing using shampoo. Therefore, a wig wearer can obtain the degree of freedom of hair styling, according to one's preference using a hair drier as if for one's own hair, and in addition, can change the hair style freely. Further, the thermal deformation by secondary shape forming can be returned to the initial shaped form by thermal treatment at temperature higher than glass transition temperature or by treating in steam atmosphere at 80-100° C. Therefore, since a hair stylist or a customer can recover the initial shape memory state from the secondarily shaped form even if secondary shape forming is not successful, remarkably improved convenience can be attained.

A second artificial hair of the present invention is characterized to have a sheath/core structure comprising a core portion and a sheath portion covering said core portion, wherein the core portion is the resin prepared by co-dissolving a semi-aromatic polyamide resin having a glass transition temperature in the range of 60-120° C. and a resin which does not expand in said temperature range in the pre-determined ratio, and the sheath portion is a polyamide resin of bending rigidity lower than that of the core portion. Thereby, it can be an artificial hair having thermally deforming property like that of the above-mentioned first artificial hair, as well as its rigidity changes depending on temperature and humidity, showing the behavior more similar to natural hair. Furthermore, a wig wearer can obtain the degree of freedom of hair styling, according to one's preference using a hair drier as if for one's own hair.

In said structure, a semi-aromatic polyamide resin is preferably an alternate copolymer of hexamethylenediamine and terephthalic acid, or an alternate copolymer of metaxylylenediamine and adipic acid, and the resin not expandable in the above-mentioned temperature range is either polyethylene terephthalate or polybutylene terephthalate.

Preferably, a semi-aromatic polyamide resin is an alternate copolymer of metaxylylenediamine and adipic acid, the resin not expandable in the above-mentioned temperature range is polyethylene terephthalate, which is incorporated by 3-30 weight % into said alternate copolymer of metaxylylenediamine and adipic acid. The sheath portion is preferably made of a linear saturated aliphatic polyamide resin. The linear saturated aliphatic polyamide resin may be a caprolactam ring-opening polymer, and/or an alternate copolymer of hexamethylenediamine and adipic acid.

According to the constitution mentioned above, the thermally deforming characteristics of artificial hair can be arbitrarily adjusted by changing the content of the resin such as polyethylene terephthalate, and the curl diameter can be controlled freely.

In the constitution mentioned above, the surface of artificial hair has minute concave and convex portions resulting in deglossing, and if said minute concave and convex portions are formed by spherulite and/or a blast processing, then the same extent of glossiness with suppressed gloss as natural hair can be attained. Arbitrary color can be obtained by having pigments and/or dyes contained in artificial hair. It is preferred that the sheath/core weight ratio of the sheath and the core portions is 10/90-35/65. According to the constitution mentioned above, since minute concavity and convexity are formed on the surface of artificial hair, glossiness is suppressed because the irradiated light is diffusely reflected, resulting in the same extent of gloss as natural hair.

In order to achieve the above-mentioned second object, a wig of the present invention is characterized to comprise a wig base and artificial hair tied on the wig base, wherein the artificial hair is prepared by co-dissolving a semi-aromatic polyamide resin having a glass transition temperature in the range of 60-120° C. and a resin which does not expand in said temperature range in the pre-determined ratio. Or the artificial hair has a sheath/core structure comprising a core portion and a sheath portion covering said core portion, the core portion is made of a resin prepared by co-dissolving a semi-aromatic polyamide resin having a glass transition temperature in the range of 60-120° C. and a resin which does not expand in said temperature range in the pre-determined ratio, and the sheath portion is made of a polyamide resin of bending rigidity lower than that of the core portion.

By using artificial hair of the above-described constitution for a wig of the present invention, such a wig can be provided that the hair style so far impossible by conventional artificial hair made of nylon 6 or others, namely the desired hair style becomes possible by giving thermal deformation to the artificial hair using such commercial hair dressing tools as a hair drier. Therefore, after a wig is manufactured and provided to a customer, the customer can make a desired hair style freely by oneself, while wearing the wig, using a hair drier. Further, since the value of bending rigidity of artificial hair is closer to that of natural hair than the artificial hair made of nylon 6, a wig can be obtained which extremely excels particularly in such feeling as appearance, tactile, and texture feelings, and which is natural in outlook. Therefore, hair styling of artificial hair becomes possible, and with the artificial hair of bending rigidity changing by temperature and humidity, showing behavior closer to human hair, appearance is attained as if one's own hair growing naturally from the scalp, thereby wearing a wig is not exposed.

Effect of the Invention

According to the present invention, secondary shape forming is possible by initial shape memory at temperature higher than glass transition temperature of the semi-aromatic polyamide resin contained in artificial hair, followed by thermal deformation to artificial hair at temperature higher than room temperature, for example, by blowing hot air by a hair drier. Said secondary shape forming can be maintained, not only in the ordinary state of use, but also after hair washing with shampoo. Further, Recovery to the initial shape memory state is anytime possible by thermal treatment at temperature higher than glass transition temperature or by treating in steam atmosphere at 80-100° C. Even if secondary shape forming is not successful, since the secondarily shaped form can be returned to the initial shape memory state, remarkably improved convenience can be attained. Therefore, a wig can be offered which can make various hair styles heretofore impossible with artificial hair made of nylon 6 or the like, but now possible to make at will by a client as if treating the client's own hair. Since also the artificial hair tied to a wig of the present invention has a value of bending rigidity closer to natural hair than the artificial hair of nylon 6, its appearance looks natural, and particularly excels in feeling such as appearance, tactile, and texture. Therefore, according to artificial hair of the present invention, it is possible for the user to make hair styles at will by the user's preference, and a wig can be offered which has the appearance as if the user's own hair is growing naturally on the scalp, since its bending rigidity changes with temperature and humidity, and it shows the behavior closer to human hair.

BRIEF DESCRIPTION OF DRAWINGS

FIG. 13 is a table showing (A) curl diameter changes by thermal treatment, and (B) and (C) their changing ratios, respectively, for the artificial hairs of Examples 1-7 and Comparative Examples 1-6.

FIG. 14 is a table, for another secondary shape forming of Examples 1-7 and Comparative Examples 1-6, showing (A) Curl diameter changes by thermal treatment, and (B) and (C) their changing ratios.

FIG. 15 is a table, for another secondary shape forming of Examples 1-7 and Comparative Examples 1-6, showing (A) Curl diameter changes by thermal treatment, and (B) and (C) their changing ratios.

FIG. 16 is a table, for another secondary shape forming of Examples 1-7 and Comparative Examples 1-6, showing (A) Curl diameter changes by thermal treatment, and (B) and (C) their changing ratios.

FIG. 23 is a table showing (A) curl diameter changes by thermal treatment, and (B) and (C) their changing ratios, respectively, for the artificial hairs of Examples 8-14 and Comparative Examples 7-10, after winding around aluminum pipe having a diameter of 22 mm to be in the initial shape memory state, followed by winding around aluminum pipe having a diameter of 70 mm and thermal treating.

FIG. 24 is a table showing (A) curl diameter changes by thermal treatment, and (B) and (C) their changing ratios, respectively, for the artificial hairs of Examples 8-14 and Comparative Examples 7-10.

FIG. 25 is a table showing (A) curl diameter changes by thermal treatment, and (B) and (C) their changing ratios, respectively, for another secondary shape forming of the artificial hairs of Examples 8-14 and Comparative Examples 7-10.

FIG. 26 is a table showing (A) curl diameter changes by thermal treatment, and (B) and (C) their changing ratios, respectively, for another secondary shape forming of the artificial hairs of Examples 8-14 and Comparative Examples 7-10.

EXPLANATION OF MARKS AND SYMBOLS

Figure 1:
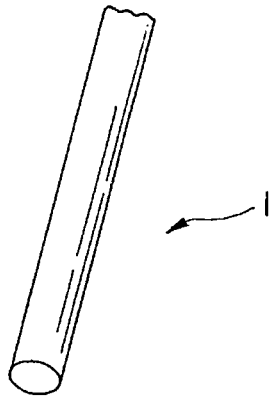
FIG. 1 illustrates a structure of an artificial hair 1 in accordance with a first embodiment of the present invention.

1, 2, 5, 6: Artificial hair
2*a*: Concave and convex portions
6A: Sheath
5B: Core
5C: Concave and convex portions
11: Wig base
20: Wig
30, 50: Manufacturing apparatus
31, 51, 52: Feed stock tanks
31A, 61A, 52A: Melt liquid
32, 51D, 52D: Melt extruder
32A, 53C: Outlet
33, 54: Warm bath
34, 36, 38, 40, 55, 57, 59, 62: Extension roll
35, 37, 39, 56, 58, 60: Dry air bath
41, 64: Winding roll
51B, 52B: Gear pump
53: Discharge part
53A: Outer ring
53B: Center circle
61: Electrostatic prevention oiling apparatus
63: Blast machine

BEST MODES FOR CARRYING OUT THE INVENTION

Hereinafter, the present invention will be explained in details with reference to the embodiments illustrated in the figures.

The artificial hair in accordance with a first embodiment of the present invention comprises a single fiber structure (used here for distinction from a sheath/core double fiber structure described below) prepared by co-dissolving in the pre-determined ratio α semi-aromatic polyamide resin having glass transition temperature in the range of 60-120° C. and a resin which does not expand in said temperature range. Here, co-dissolving includes the state where said semi-aromatic polyamide resin and said resin melt homogeneously without reaction or not separating like floating islands.

FIG. 1 illustrates a structure of artificial hair 1 in accordance with a first embodiment of the present invention. The cross-sectional shape of said artificial hair 1 may be circular, elliptic elongated in any direction, or cocoon-shaped. The artificial hair 1 in accordance with a first embodiment of the present invention may have an arbitrary value for its average diameter, but may have a similar value to natural hair, for example, about 80 μm.

As a polyamide resin as a material of said artificial hair 1, a semi-aromatic polyamide resin of high strength and rigidity, and of glass transition temperature in the range of 60-120° C. is preferable. More preferable glass transition temperature is 60 to about 100° C. For example, a polymer consisting of an alternate copolymer of hexamethylene diamine and terephthalic acid expressed by Chemical Formula 1 (for example, nylon 6T), or a polymer made up by alternately bonding adipic acid and metaxylylene diamine by amide bonds expressed by Chemical formula 2 (for example, nylon MXD6) may be mentioned. Here, the polymer material expressed by Chemical formula 2 is more advantageous in easy hair setting compared with the polymer material expressed by Chemical formula 1.

[Chemical Formula 1]

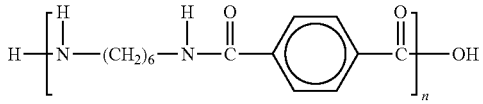

(1)

[Chemical Formula 2]

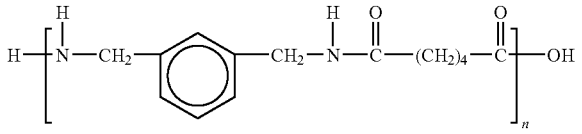

(2)

As the resin which does not expand in the temperature range 60-120° C., for example, polyethylene terephthalate or polybutylene terephthalate may be mentioned. Polyethylene terephthalate is a polymer obtained by condensation polymerization essentially of terephthalic acid and ethylene glycol, and polybutylene terephthalate is a polymer obtained by condensation polymerization essentially of terephthalic acid and 1,4-butanediol.

When an alternate copolymer of metaxylylene diamine and adipic acid is used as the semi-aromatic polyamide resin of artificial hair, and polyethylene terephthalate is used as the resin, it is preferable to mix polyethylene terephthalate into an alternate copolymer of metaxylylene diamine and adipic acid by 3-30 weight %.

Explanation is next made of a modified example of artificial hair 1.

Figure 2:
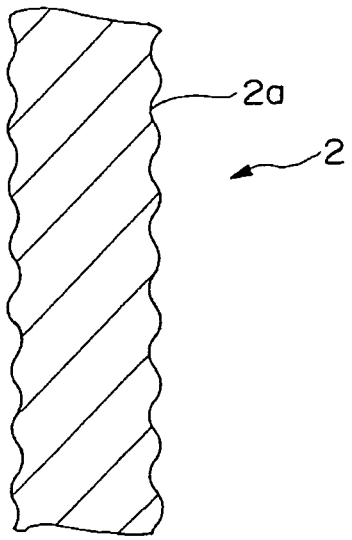
FIG. 2 is a cross sectional view in the length direction illustrating a modified example of the artificial hair of the present invention.

FIG. 2 is a cross sectional view in the length direction illustrating artificial hair 2 as a modified example of artificial hair 1 of the present invention. This artificial hair 2 is also of a single fiber structure, but different from FIG. 1, fine concave and convex portion 2*a* is formed on the surface of artificial hair 2. In case of such artificial hair 2 having concave and convex portion 2*a* on the surface, since diffuse reflection occurs upon light irradiation, the gloss no longer easily occurs due to the reflection from light irradiation on the surface of artificial hair 2, thereby deglossing effect can be caused suppressing gloss like human natural hair. The concave and convex portion 2*a* is preferably formed in the higher order than visible light wavelength so as to diffusely reflect light. Said concave and convex portion 2*a* may also be formed by spherulites on the surface of artificial hair upon the artificial hair spinning, or by blast processing after spinning. The components of artificial hair 2 may be the same as in the first embodiment.

In the artificial hair of the above-mentioned embodiments, pigments or dyes may be contained as components to cause the pre-determined coloring. Coloring after spinning may also do.

According to artificial hair 1 and 2 of the present invention, shape memory is possible at relatively high 150° C. or higher after spinning. In the present invention, said shape memory is hereinafter to be properly called initial shape memory state or primary shape forming. By initial shape memory treatment, a wig is shipped out after completion by, for example, being curled with a large curvature and tied to a wig base. Thereafter, upon properly fixing the initial shape memory treated wig to a wig fixing device or wearing it on a head, a hair stylist or a customer can change the curl diameter of artificial hair 1 and 2 by blowing hot air at 60-120° C. as the above-mentioned glass transition temperature, or more preferably, at about 70-90° C., the working temperature of such commercial beautification machines as a hair drier. Such thermal deformation is properly called secondary shape forming in the present invention. Thus, by hair setting by blowing hot air at the pre-determined temperature to artificial hair of the present invention using a hair drier, various curling, as well as various hair styling can be realized. The expansion of artificial hair by heat is brought by the fact that the major component of artificial hair is a semi-aromatic polyamide which causes thermoplasticity due to its glass transitional state and hence amorphous state. In this case, if the content of polyethylene terephthalate is lower than 3%, the thermal expansion of artificial hair due to semi-aromatic polyamide is too large. If thermal expansion of artificial hair is too large, then secondary shape forming is performed within extremely short period. Therefore, it is not preferable, because time is too short for the desired secondary shape forming, and control is impossible. On the other hand, if the content of polyethylene terephthalate exceeds 30%, it is not preferable because thermal expansion of artificial hair becomes small. That is, the secondary shape forming effect of artificial hair is too small to be practical.

The shape of artificial hair 1 and 2 with the applied thermal deformation, that is, secondary shape forming, does not change from that of the secondary shape forming by leaving at room temperature or washing with shampoo. In order to recover the shape of the secondary shape forming to the initial shape memory state, artificial hair may be thermally treated at temperature higher than glass transition temperature. Said thermal treatment may be either dry or wet heating. In case of dry heating, artificial hair may be thermally deteriorated, or the initially formed shape (primary shape forming) may be lost unless highly accurate temperature control is performed.

On the other hand, in case of so-called wet heating with moisture, since glass transition temperature is lower by 10° C. or more than in case of dry heating, the initial shape memory state can be fully recovered by thermal treatment in steam atmosphere at 80-100° C. which is about the upper limit of said glass transition temperature range more or less higher than thermal deformation treating temperature (secondary shape forming), and hence it is more preferable.

Thereby, according to artificial hair 1 and 2 of the present invention, compared with conventional artificial hair made of nylon 6, thermal deformability by secondary shape forming as a novel function is given. Moreover, said thermal deformability by secondary shape forming can be returned to the initial shaped form by thermal treatment at temperature higher than glass transition temperature or steam environment treatment at 80-100° C. Therefore, since a hair stylist or a customer can recover the initial shape memory state from the secondarily shaped form even if secondary shape forming is not successful, remarkably improved convenience can be attained.

Explanation is next made of the second embodiment of artificial hair.

Figure 3:
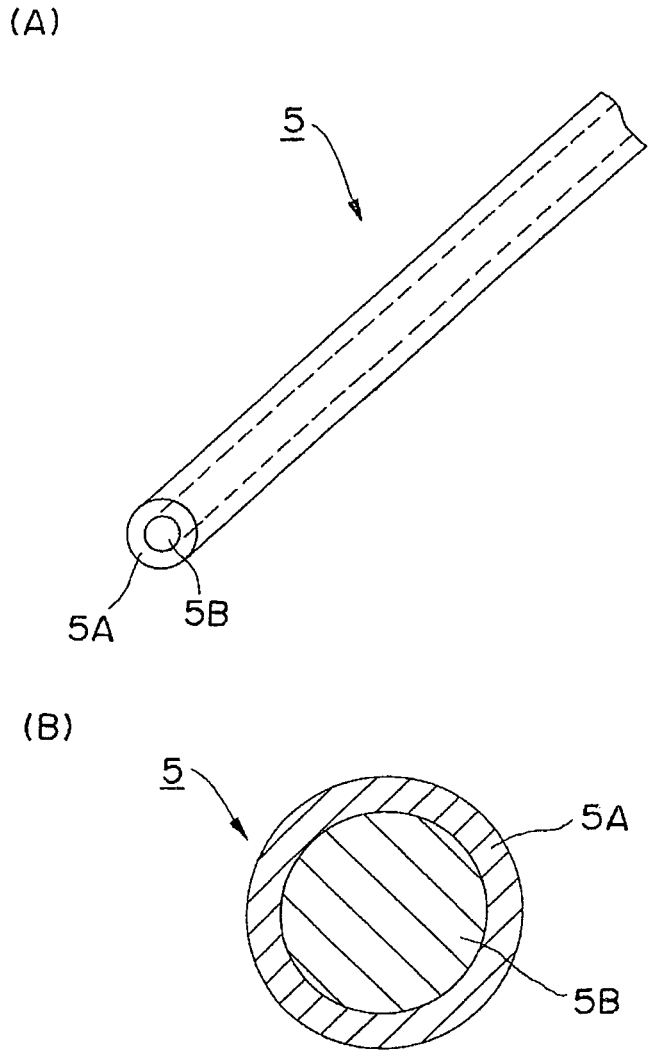
FIG. 3 diagrammatically illustrates a preferable structure of an artificial hair in accordance with a second embodiment, and (A) is a diagonal view, and (B) is a vertical cross sectional view in the length direction of the artificial hair.

FIG. 3 diagrammatically illustrates the preferred makeup of artificial hair 5 in accordance with the second embodiment, wherein (A) is a diagonal view, and (B) is a vertical cross-sectional view in the longitudinal direction of artificial hair 5. The artificial hair 5 differs from that of a single fiber structure in accordance with the first embodiment, in that it has a sheath/core double structure in which a core portion 5B is covered with a sheath portion 5A on the surface. The sheath portion 5A is made of a polyamide resin, and the core portion has the similar makeup to artificial hair 1 in accordance with said first embodiment. In case of illustration, the sheath/core structure is illustrated as an example of arrangement as an approximately concentric circle, but both the core portion 5B and the sheath portion 5A may have a different shape other than an approximately concentric circle, and the cross-sectional shape of the second artificial hair 5 may be circular, ellipsoidal, cocoon-shaped, or others.

As the polyamide resins for the material of said sheath portion 5A, polyamide resins of lower bending rigidity than the core 5B may be used, and a linear saturated aliphatic polyamide, for example, is preferable. As said linear saturated aliphatic polyamide, such may be mentioned as the polymer consisting of a ring-opening polymer of caprolactam (Nylon 6, for example) expressed in Chemical Formula 3, or the polymer consisting of an alternate copolymer of hexamethylenediamine and adipic acid (Nylon 66, for example) expressed in Chemical Formula 4.

[Chemical Formula 3]

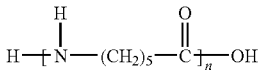

(3)

[Chemical Formula 4]

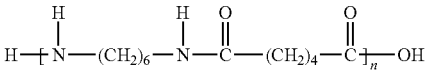

(4)

Figure 4:
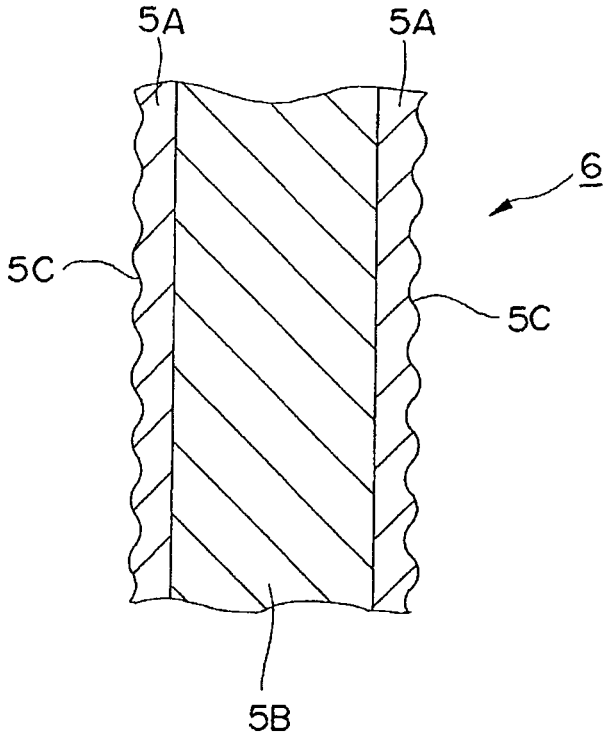
FIG. 4 is a cross sectional view in the length direction diagrammatically illustrating a modified example of the artificial hair

If the surface of the sheath portion 6A of artificial hair 5 is smooth, then gloss is caused, so that, in order to suppress this unnatural gloss on the surface of artificial hair 5, it is preferred to apply so-called deglossing treatment. FIG. 4 is a cross-sectional view in the longitudinal direction diagrammatically illustrating the makeup of artificial hair 6 as a modified example of artificial hair 5. As is illustrated, on the surface of the sheath portion 5A of artificial hair 6, a fine concave and convex portion 5C is formed. By said fine concave and convex portion 5C, gloss due to the reflection from the light irradiation on the surface of artificial hair 6 is suppressed to about the same extent as human hair, bringing about so-called deglossing effect.

Here, the fine concave and convex portion 5C can be given by blast processing with fine powder such as sand, ice, dry ice, and others either during spinning of the artificial hair 5 or on to the fiber after spinning. In case during spinning of the artificial hair 5, it may be made by spherulite forming on the outermost surface of artificial hair 5. In this case, it may be the combined processes of spherulite forming and blast processing with fine powder such as said sand, ice, dry ice, and others. The concave and convex portion formed by combination of such spherulite formation and blast processing may be formed to be the concave and convex portion 5C larger than the order of visible light wavelength so the light is diffuse reflected.

The artificial hair 5, 6 can be colored depending upon the wearer's preference. Said coloring may be by formulating pigment and/or dye during polymer kneading as the material for spinning, or by coloring after spinning.

According to the artificial hair 5, 6 of the present invention, a novel function of thermal deformation by secondary shape forming is given like the artificial hair 1, 2, compared with the conventional artificial hair made of nylon 6. Moreover, said thermal deformability by secondary shape forming can be returned to the initial primary shape forming shape by thermal treatment at temperature higher than glass transition temperature or steam environment treatment at 80-100° C. Further, the artificial hair 5, 6 of the present invention uses a mixed resin of a semi-aromatic polyamide of high bending rigidity and polyethylene terephthalate for the core portion 5B, and a sheath/core structure using a polyamide of bending rigidity lower than the core portion 5B for the sheath portion 6A, thereby it can be the artificial hair the rigidity of which changes depending upon temperature and humidity, and which shows behavior closer to natural hair.

In general, compared with natural hair, there has been such a property that polyethylene terephthalate fiber has strong bending rigidity, and nylon 6 fiber has weak bending rigidity, but, in the artificial hair 5, 6 of the present invention, bending rigidity is close to that of natural hair, and appearance, tactile, and texture feelings to the same extent as natural hair can be attained by adopting a sheath/core structure. In addition, a wig wearer can make a hair style of the wearer's own preference using a hair drier as if the wearer's own hair, resulting in freedom of hair styling, and the primarily shape forming can be recovered anytime. Therefore, since a hair stylist or a customer can recover the initial shape memory state from the secondarily shape forming even if secondary shape forming of artificial hair 5, 6 is not successful, and hair styling of artificial hair 5, 6 can be repeated again, remarkably improved convenience can be attained.

Explanation is next made of a wig of the present invention.

Figure 5:
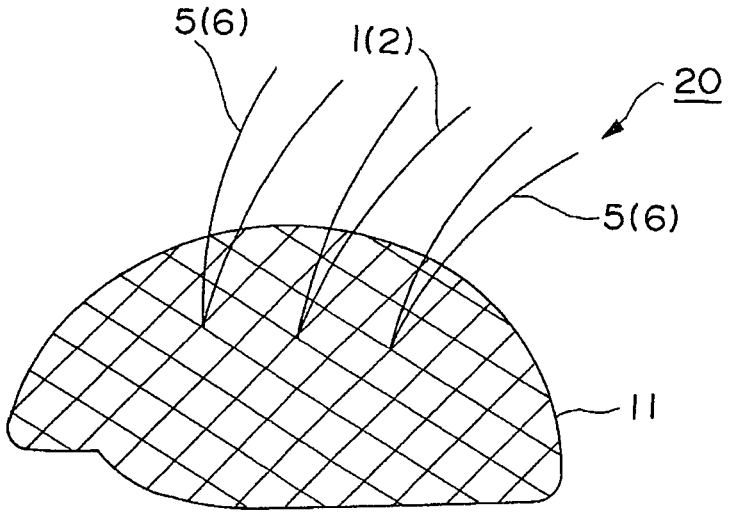
FIG. 5 is a diagonal view diagrammatically illustrating a structure of a wig of the present invention.

FIG. 5 is a diagonal view diagrammatically illustrating the makeup of a wig 20 of the present invention. A wig 20 using the artificial hair 1, 2, 5, 6 of the present invention is that made by tying any or combination of the artificial hair 1, 2, 5, 6 to a wig base 11. The artificial hair 1, 2 comprises as mentioned above a single fiber structure with a resin of polyethylene terephthalate or others mixed into a semi-aromatic polyamide, and has thermal deformability at the temperature higher than room temperature in the range of 60-120° C. The artificial hair 5, 6, having a double structure of sheath/core with the artificial hair 1, 2 as a core and further a sheath portion attached thereon, is the improved artificial hair of which rigidity changes depending upon temperature and humidity, as well as thermal deformability, and which shows behavior closer to natural hair.

The wig base 11 can be made of either a net base or an artificial skin base. In case of the figure, the wig base 11 is shown to be tied to a mesh of a net member. The wig base 11 may be made by combination of a net base and an artificial skin base, and there is no special restriction so far as suitable to wig design or purpose of use.

The artificial hair 2, 5 is preferable as artificial hair the relative-specular glossiness of which is suppressed, and which has gloss similar to natural hair. The color of these artificial hairs may be properly chosen according to the wearer's desire such as black, brown, and blond etc. Natural appearance is increased if the artificial hair is chosen of the color fitting to the wearer's own hair around the bald part. In case of a wig or attached hair for fashion, the artificial hair of the present invention may be made mesh-like by giving a color different from the wearer's own hair, or from a root portion to an end portion, gradation may be given such as, for example, dark and light tint or color is gradually changed.

According to a wig of the present invention, since it has thermal deformability at temperature higher than room temperature in the range of 60-120° C., a wig wearer him or herself or a hair dresser can change the hair style of artificial hair 1, 2, 5, 6 using hair dressing tools capable of heating such as a hair drier, that is, they can hair dress. In this case, the extent of thermal deformation of artificial hair 1, 2, 5, 6 can be adjusted by the content of resins such as polyethylene terephthalate added into a semi-aromatic polyamide. If it is desired to apply thermal deformation mildly, that is, if it is desired to change the curl diameter just a little from the curl diameter of the initial shape memory state applied upon the wig manufacture, the content of resins such as polyethylene terephthalate added into a semi-aromatic polyamide may be increased. On the other hand, if large thermal deformation is desired, that is, if it is desired to make the change in the curl diameter large by thermal deformation of artificial hair 1, 2, 5, and 6, then the content of resins such as polyethylene terephthalate added into a semi-aromatic polyamide may be decreased. Therefore, when a wig is manufactured, the content of resins such as polyethylene terephthalate added into a semi-aromatic polyamide may be adjusted depending upon a customer's preference. Here, since thermal deformation is larger in the latter case than the former, the freedom of hair styles increases, but since hair is largely deformed by a hair drier, there may be some users who feel difficulty in handling, and there may be cases where hair setting takes more or less longer time but preferred hair dressing is easier due to smaller thermal deformation in the former case. Further, artificial hair 1, 2, 5, and 6 can be anytime returned to the initial shape forming. Therefore, since a hair stylist or a customer can recover the initial shape memory state from the secondarily forming shape even if secondary shape forming of artificial hair 1, 2, 5, and 6 is not successful, remarkably improved convenience can be attained. In any case, the artificial hair of thermal deformation according to a user's or a hair dresser's preference can be manufactured by adjusting the content of resins such as polyethylene terephthalate added into the main material of artificial hair of the present invention, and hence it is possible to provide a wig capable of adjustment of settability according to one's own preference by attaching it to a wig.

A method of manufacturing artificial hair of the present invention is explained next. An apparatus used in the method of manufacturing artificial hair of the present invention is explained first. In the explanation below, the resin to add into a semi-aromatic polyamide is polyethylene terephthalate, but it may be as well polybutylene terephthalate or others.

Figure 6:
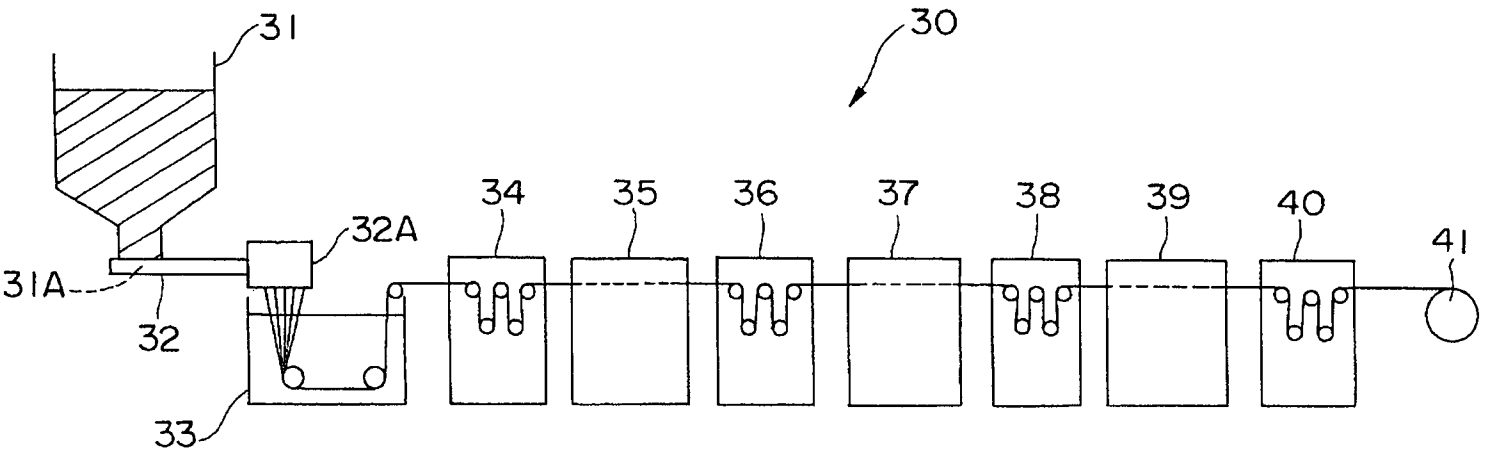
FIG. 6 is a diagrammatical drawing of an apparatus used for manufacturing the artificial hair of the present invention.

FIG. 6 is a diagrammatical view of an apparatus used for manufacturing the artificial hair 1, 2 of the present invention. As shown in FIG. 6, a manufacturing apparatus 30 comprises a hopper 31 to store pellets of a semi-aromatic polyamide and polyethylene terephthalate resin as raw material and the pellets of a semi-aromatic polyamide and polyethylene terephthalate resin containing coloring raw material, an extruder 32 to melt and knead raw material, a quenching bath 33 to solidify the thread-shaped melt discharged from an outlet 32A after being kneaded in the extruder 32, and a rollup machine 41 to roll up artificial hair via three steps stretching thermal treatment process thereafter with each step comprising stretching rolls 34, 36, 38, 40 and dry stretching baths 35, 37, 39, or a wet stretching bath in place of the dry stretching baths 35.

The extruder 32 is provided with a heating device to melt pellets of a semi-aromatic polyamide and polyethlene terephthalate resin as raw material and the pellets of a semi-aromatic polyamide and polyethlene terephthalate resin containing coloring raw material, a kneader to disperse and mix homogeneously, and a gear pump to supply the melt to the outlet 32A.

The outlet 32A of the extruder 32 has the pre-determined number of holes having the pre-determined diameter. The filaments coming out of the outlet 32A of the extruder 32 are rolled up to the rollup machine 41, as illustrated, consequentially via the quenching bath 33, the first stretching roll 34, the first dry stretching bath 35 or the first wet stretching bath in place of the dry stretching baths 35, the second stretching roll 36, the second dry stretching bath 37, the third stretching roll 38, the third dry stretching bath 39, and the fourth stretching roll 40. Here, stretching treatment is applied to the solidified fiber member at the first to the fourth stretching rolls 34 to 40. First of all, a first stretching treatment is applied to the fiber member by increasing the roller speed of the second stretching roll 36 with respect to the roller speed of the first stretching roll 34, next a second stretching treatment is applied to the fiber member by increasing the roller speed of the third stretching roll 38 with respect to the roller speed of the second stretching roll 36, and thereafter tension applied to fiber is relaxed and relaxing stretching treatment is applied to stabilize the size by decreasing the roller speed of the fourth stretching roll 40 with respect to the roller speed of the third stretching roll 38. Here, between the fourth stretching roll 40 and the rollup machine 41, there may be provided an oiling device for electrostatic prevention (not shown).

In case to manufacture artificial hair 2 having fine concave and convex portions 2*a* on the surface of artificial hair 1, there may be provided a blast machine (not shown) for surface treatment between the fourth stretching roll 40 and the rollup machine 41.

Explanation is made of the method of manufacturing artificial hair 1, 2 using the apparatus 30 shown in FIG. 6.

In the manufacturing apparatus 30 shown in FIG. 6, pellets of a semi-aromatic polyamide and the resin pellets for coloring with polyethylene terephthalate as a base and containing coloring pigment are mixed and supplied in the pre-determined ratio into the hopper 31. By changing the mixing ratio of resin pellets for coloring, the hair color of artificial hair 1, 2 as the final product can be changed.

The pellets inside the hopper 31 are supplied into the extruder 32, the melting polymer 31A from kneading the pellets in the extruder 32 is discharged from the outlet 32A, and the fiber-shaped melt is solidified in the quenching bath 33. Temperature of the quenching bath 33 is preferably about 40-80° C. for productivity. If temperature of the quenching bath 33 is low, it is not preferable that, upon contacting the quenching bath 33 after melt resin is discharged, as for outside and inside of the fiber-shaped melt contacting the water first, deviation in molecular structure is caused by crystallization of the inside resin proceeding and that of the outside not proceeding due to rapid cooling, bringing about "not straight such as waving shape". If temperature of the quenching bath 33 is too high, crystallization of fiber-shaped melt proceeds too much, resulting fiber-shaped melt in weak stability to stretching, causing frequent cutoff during stretching and hence poor productivity.

To the solidified fiber member, the first step of stretching treatment is applied by the first and the second stretching rolls 34 and 36, the second step of stretching treatment is applied by the second and the third stretching rolls 36 and 38, and the relaxing treatment is applied by the third and the fourth stretching rolls 38 and 40. By the first and the second stretching treatments, the total stretching ratio is about 4-7 times.

By adjusting such stretching conditions as a hole diameter of the outlet 32A, spinning conditions such as temperature of the quenching bath 33, the first to the fourth stretching roll speeds, temperature of the first dry stretching bath or the wet stretching bath, and of the second to the third dry stretching baths, artificial hair 1, 2 can be manufactured in which polyethylene terephthalate and coloring pigments are added into a semi-aromatic polyamide.

Explanation is next made of a method of manufacturing artificial hair 5,6 having a sheath/core structure in accordance with the present invention.

Figure 7:
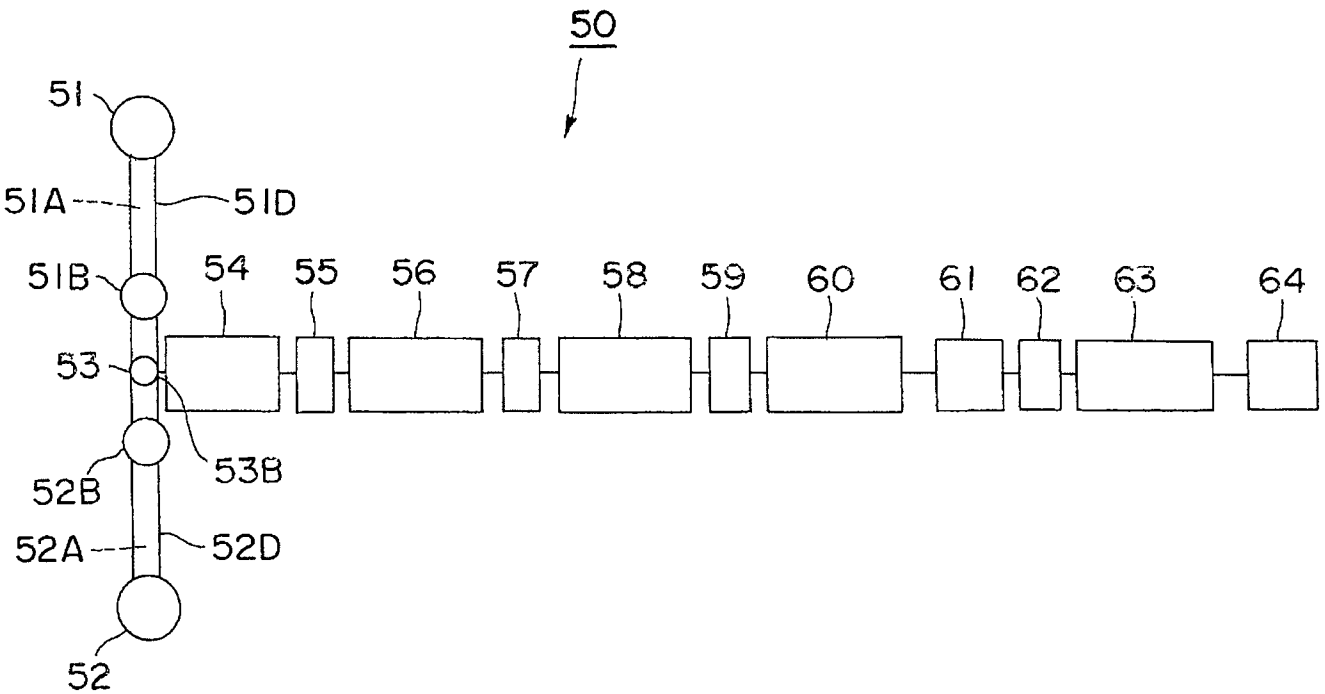
FIG. 7 is a diagrammatical drawing of an apparatus used for manufacturing artificial hair.
Figure 8:
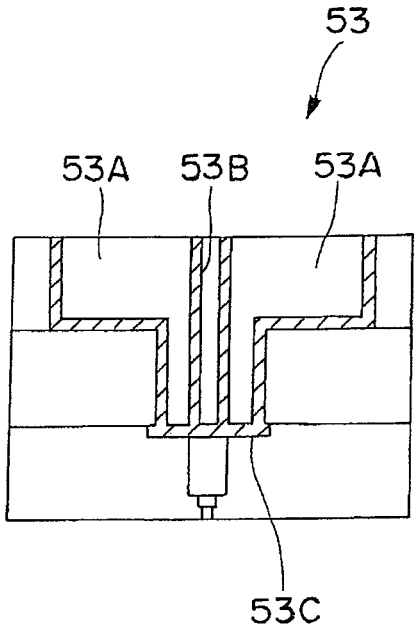
FIG. 8 is a diagrammatical cross sectional view illustrating a discharge part used for the manufacturing apparatus of FIG. 7.
Figure 9:
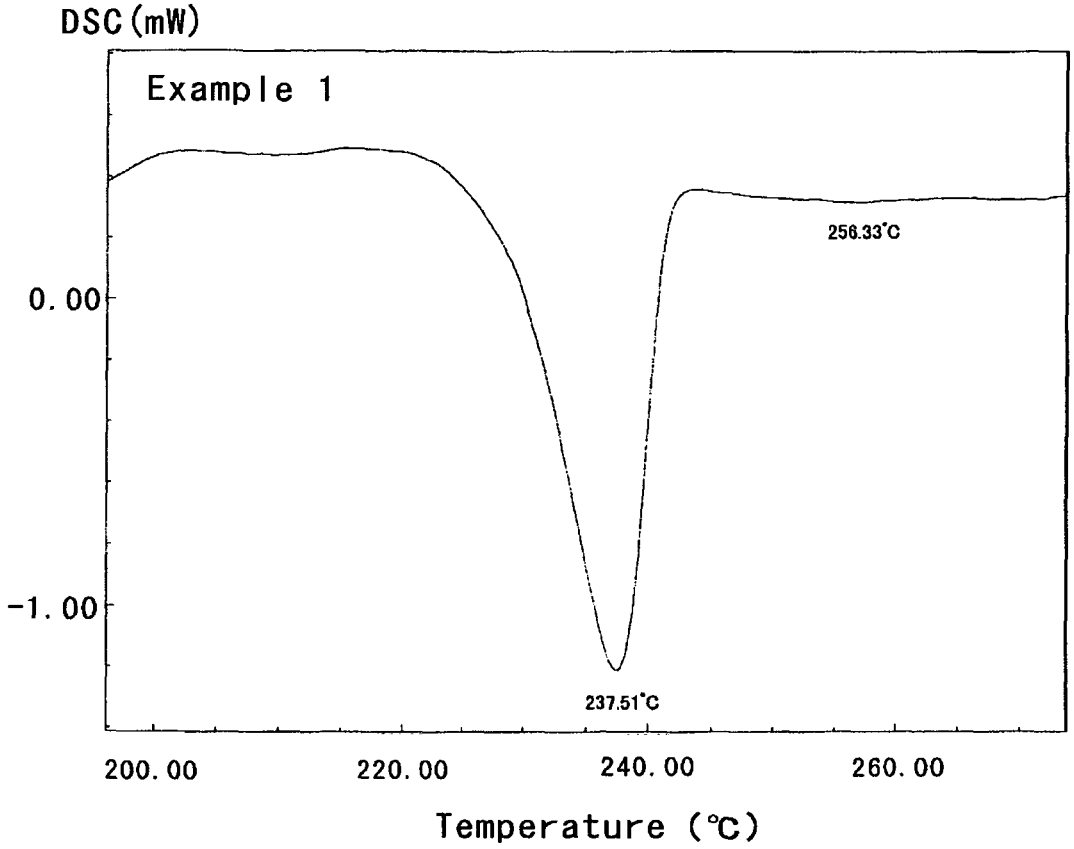
FIG. 9 shows the differential scanning calorimetric measurements of the artificial hair of Example 1.
Figure 10:
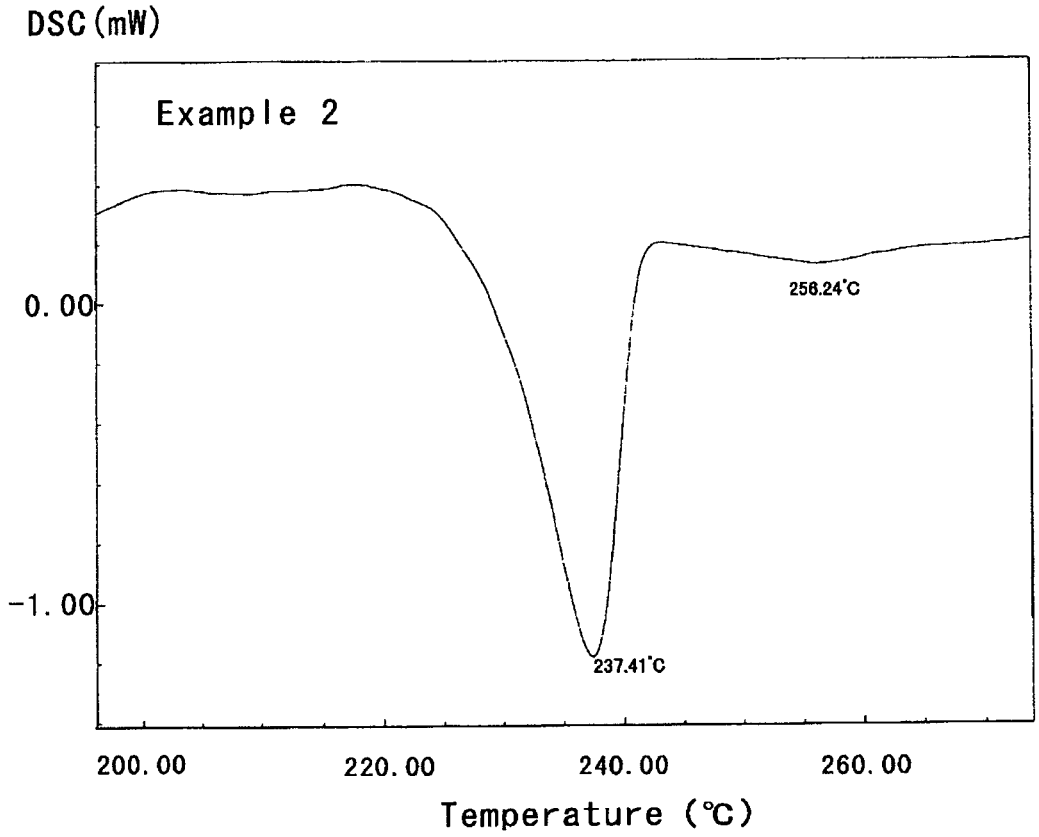
FIG. 10 shows the differential scanning calorimetric measurements of the artificial hair of Example 2.
Figure 11:
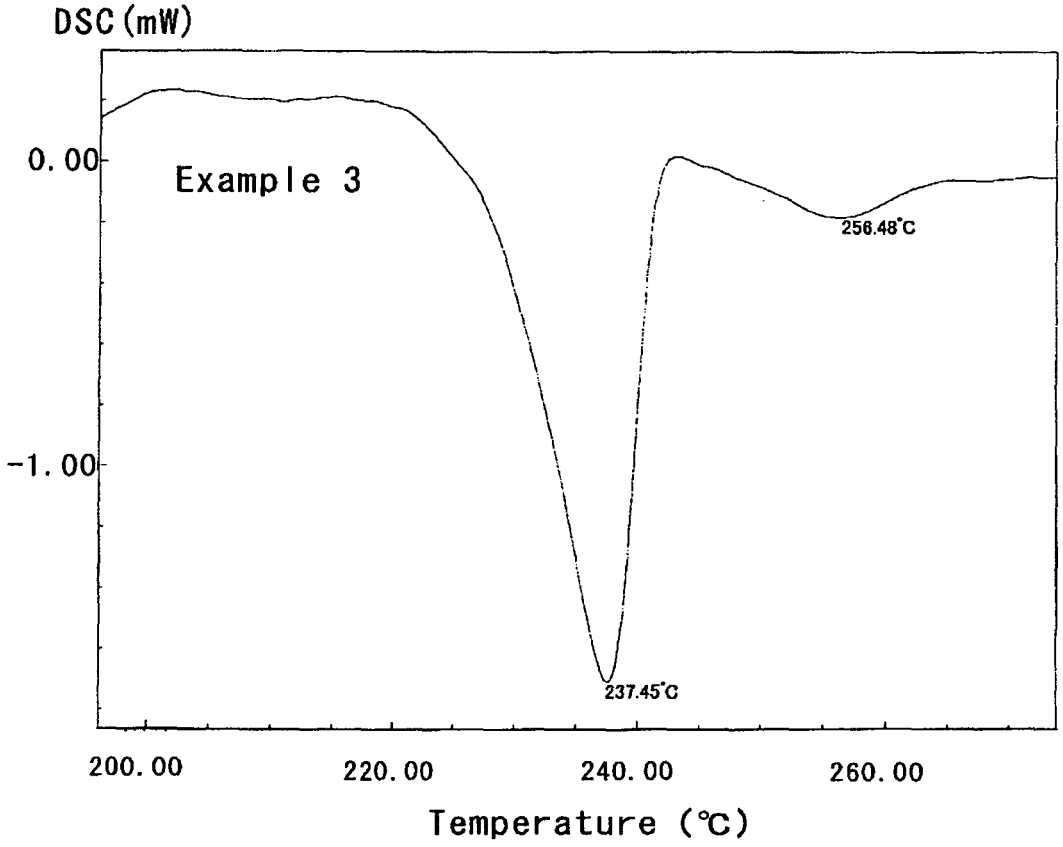
FIG. 11 shows the differential scanning calorimetric measurements of the artificial hair of Example 3.
Figure 12:
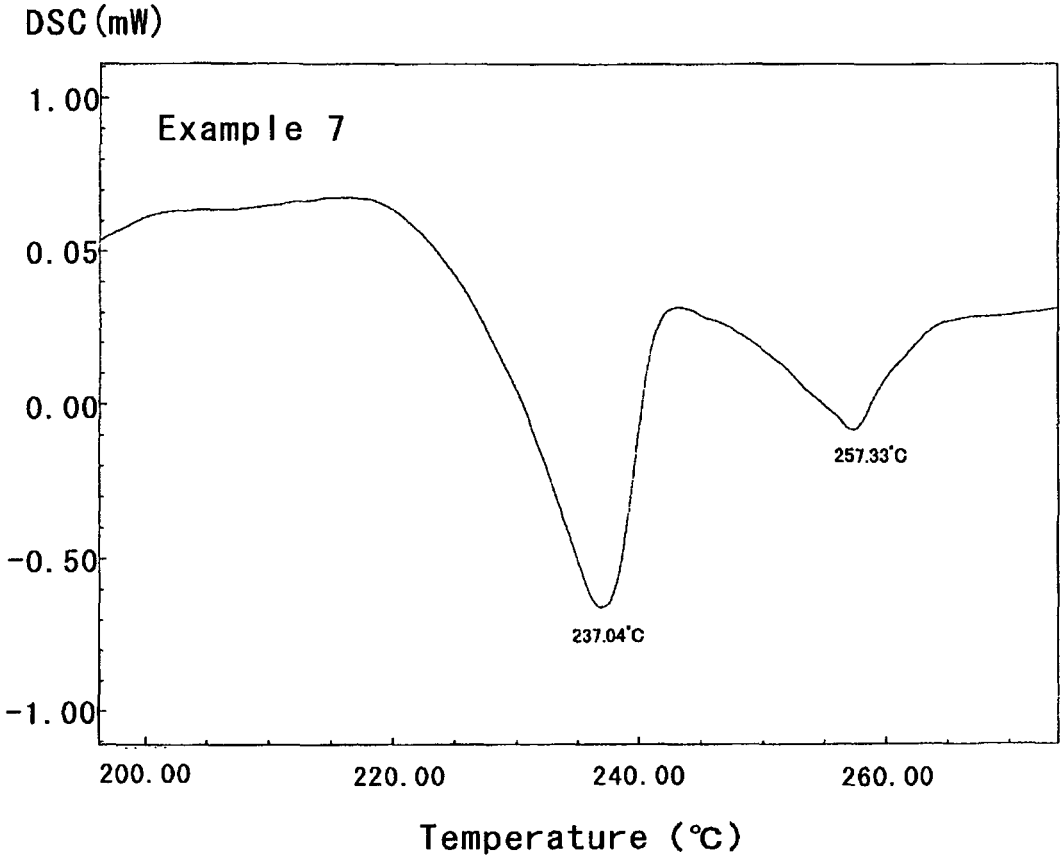
FIG. 12 shows the differential scanning calorimetric measurements of the artificial hair of Example 7.

FIG. 7 is a diagrammatical drawing of an apparatus 50 used for manufacturing the artificial hair 5,6, and FIG. 8 is a diagrammatical cross sectional view illustrating a discharge part used for the manufacturing apparatus of FIG. 7. As shown in FIG. 7, the manufacturing apparatus 50 comprises a first hopper 51 of a polyamide resin for the sheath portion 6A, a second hopper 52 of a semi-aromatic polyamide resin with polyethylene terephthalate added therein for the core portion 5B, the extruder 51D and 52D to melt and knead the raw material supplied from 52, a quenching bath 54 to solidify the melt thread discharged from a discharge part 53 formed from the melting polymer 51A and 52A kneaded in the extruders 51D and 52D, and to form a concave and convex portion on the surface, and thereafter via three steps stretching thermal treatment processing parts with each step comprising stretching rolls 55, 57, and 59, and a dry stretching bath 56 or a wet stretching bath in its place, and again dry stretching baths 58 and 60, a blast machine 63 for forming further the concave and convex portion 5C on the thread surface, and a rollup machine 64 to roll up the artificial hair deglossed to the desired extent with the blast machine 63.

The extruders 51D and 52D are provided with a heating device to melt pellets such as polyamide resins, a kneader to disperse and mix them to homogenize, and gear pumps 51B and 52B to supply the melting polymer 51A and 52A to a discharge part 53. The fiber out of an outlet 53C of a discharge part 53 is rolled up to a rollup machine 64, via a quenching bath, stretching rolls, and dry stretching baths as illustrated, and via an oiling device for electrostatic prevention 61, a stretching roll 62 to relax the tension applied to artificial hair for size stabilization, and a blast machine 63 for surface treatment.

As shown in FIG. 8, the discharge part 53 is provided with a concentric circular double outlet from the inner circle part 53B of which is discharged semi-aromatic polyamide resin melt 52A with polyethylene terephthalate added therein, and from the outer ring part 53A surrounding said inner circle part 53B is discharged linear saturated aliphatic polyamide resin melt 61A, respectively.

Explanation is next made of a method of manufacturing the artificial hair 5, 6 with said manufacturing apparatus 50. Using said manufacturing apparatus 50, artificial hair 5, 6 can be manufactured by melting each polyamide resin at appropriate temperature by extruders 51D, 52D, feeding the melts to the discharge part 53, and by discharging semi-aromatic polyamide resin melt 52A with polyethylene terephthalate added therein from the inner circle part 53B of the outlet and linear saturated aliphatic polyamide resin melt 51A from the outer ring part 53A to make the thread of sheath/core structure.

The ratio of the volume of the linear saturated aliphatic polyamide resin melt 51A fed for a certain time with the gear pump 51B and the volume of semi-aromatic polyamide resin melt with polyethylene terephthalate added therein 52A fed with the gear pump 52B is defined as sheath/core volume ratio in the present invention. In order to approximate the bending rigidity of the artificial hair 5 to that of natural hair, the sheath/core weight ratio, the weight ratio of sheath and core, is preferably in the range of 10/90-35/65. As the manufacturing condition to obtain said weight ratio of sheath and core, the sheath/core volume ratio is preferably 1/2-1/7, and this range is preferred for such properties as bending rigidity of artificial hair 5, 6. If said sheath/core volume ratio is higher than 1/2, that is, the ratio of the sheath portion 6A is large, the core portion 5B of artificial hair 5, 6 has small effect to contribute the increase of bending rigidity. If said sheath/core volume ratio is lower than 1/7, that is, the ratio of the core portion 5B is large, it is not preferred, for the bending rigidity becomes too high to be close to natural hair.

The stretching ratio may be 5-6 times upon spinning of the artificial hair 5, 6. Said stretching ratio is about twice as high as that for the conventional artificial hair of nylon 6 only. For the second artificial hair 5, 6, such as stretching ratio upon spinning, thread diameter, and bending rigidity can be properly determined in accordance with the desired design. In this case, the shape of sheath/core of artificial hair 5, 6 can be made nearly concentric circular by properly controlling spinning conditions.

In the spinning for the artificial hair, the deglossed artificial hair 6 can be manufactured by forming and growing spherulite for the concave and convex portion 5C on the surface of linear saturated aliphatic polyamide resin as the sheath portion 5A by passing the thread drawn from the outlet 53C through the water at 80° C. or higher in the quenching bath 54, thereby giving appearance similar to natural hair, and deglossing to erase unnatural gloss.

As methods to form the fine concave and convex portion 5C on the thread surface, any one of the methods of blasting with such fine particles as sand, ice, and dry ice to the thread surface after spinning, or of chemical treatment of the thread surface, or proper combination of them may be adopted, in addition to the above-mentioned spherulite formation and growth.

In order to give the proper color and appearance as the artificial hair 5, 6, the pigment and/or dye may be formulated during spinning, or the artificial hair 5, 6 itself may be colored after spinning.

As described above, the second artificial hair 5, 6 has the sheath/core structure with a sheath of polyamide resin on the outermost surface, compared with the artificial hair 1, 2. Therefore, the artificial hair 5, 6 of the bending rigidity higher than that of the conventional artificial hair of linear saturated aliphatic polyamide resin only can be manufactured with good reproducibility. Also, by forming the fine concave and convex portion 5C on the surface of the artificial hair 5, natural gloss similar to natural hair can be given, thereby so can the natural appearance as hair.

Example 1

Explanation is next made in detail of examples of the present invention.

Using the spinning machine 30 shown in FIG. 6, artificial hair was manufactured by mixing 3 weight % of polyethylene terephthalate into MXD6 nylon. As a raw material of artificial hair, MXD6 nylon pellets (MITSUBISHI GAS CHEMICAL COMPANY, Inc., Trade Name MX nylon) and polyethylene terephthalate pellets (TOYOBO CO., LTD., RE530AA, density 1.40 g/cm$^3$, melting point 255° C.) were used. The resin pellets for coloring were used in which pigment weight % of black, yellow, orange, and red were 6%, 6%, 5%, and 5%, respectively.

As the spinning condition, melting temperature of pellets was 270° C. as the discharge temperature from the outlet, and the outlet was provided with 15 holes of 0.7 mm diameter. The temperature of the quenching bath 33 was 40° C.

For stretching conditions, the speed of each roller of the first to the fourth stretching rolls 34 to 40 was so adjusted that the average cross-sectional diameter of artificial hair was ultimately 80 μm. That is, the second stretching roll speed 36 was 4.6 times that of the first stretching roll 34, the third stretching roll speed 38 was 1.3 times that of the second stretching roll 36, and the fourth stretching roll speed 40 was 0.93 times that of the third stretching roll 38. Also, temperature of the first wet stretching bath was 90° C. as the first stretching temperature, temperature of the second dry stretching bath 37 was 150° C. as the second stretching temperature, and temperature of the third dry stretching bath 39 was 160° C. as the relaxing stretching temperature. For the artificial hair of Example 1, deglossing treatment was applied by using a blast machine.

Example 2

The artificial hair 2 of the average diameter 80 μm was manufactured by the same condition as Example 1, except that polyethylene terephthalate was 5 weight %.

Example 3

The artificial hair 2 of the average diameter 80 μm was manufactured by the same condition as Example 1, except that polyethylene terephthalate was 10 weight %.

Example 4

The artificial hair 2 of the average diameter 80 μm was manufactured by the same condition as Example 1, except that polyethylene terephthalate was 15 weight %.

Example 5

The artificial hair 2 of the average diameter 80 μm was manufactured by the same condition as Example 1, except that polyethylene terephthalate was 20 weight %.

Example 6

The artificial hair 2 of the average diameter 80 μm was manufactured by the same condition as Example 1, except that polyethylene terephthalate was 25 weight %.

Example 7

The artificial hair 2 of the average diameter 80 μm was manufactured by the same condition as Example 1, except that polyethylene terephthalate was 30 weight %.

Comparative Examples 1-6 are shown next in contrast to Examples 1-7.

Comparative Example 1

The artificial hair of the average diameter 80 μm was manufactured by the same condition as Example 1, except that polyethylene terephthalate was not used, and MXD6 nylon was 100%.

Comparative Example 2

The artificial hair of the average diameter 80 μm was manufactured by the same condition as Example 1, except that polyethylene terephthalate was 1 weight %.

Comparative Example 3

The artificial hair of the average diameter 80 μm was manufactured by the same condition as Example 1, except that polyethylene terephthalate was 35 weight %.

Comparative Example 4

The artificial hair of the average diameter 80 μm was manufactured by the same condition as Example 1, except that polyethylene terephthalate was 40 weight %.

Comparative Example 5

The artificial hair of the average diameter 80 μm was manufactured by the same condition as Example 1, except that polyethylene terephthalate was 100 weight %.

Comparative Example 6

The artificial hair of the average diameter 80 μm was manufactured without using polyethylene terephthalate, and using 100% of nylon 6.

The results of differential scanning calorimetry (DSC) of the artificial hairs manufactured in Examples 1, 2, 3, and 7 are shown next. FIGS. 9-12 are the graphs showing the measurements of differential scanning calorimetry of the artificial hairs manufactured in Examples 1, 2, 3, and 7. In the graph, the abscissa axis is temperature (° C.), and the ordinate axis is dq/dt (mW).

As is clear from FIGS. 9-12, melting peaks are observed at 237.51° C. and 256.33° C. for the artificial hairs of Examples 1, 2, 3, and 7, corresponding to melting points of MXD6 nylon and polyethylene terephthalate, respectively. The artificial hairs of Examples 1, 2, 3, and 7 were spinned by mixing polyethylene terephthalate into MXD6 nylon by the ratio 3, 5, 10, and 30 weight %, respectively, and it turned out from the DSC results after spinning that these two resins are merely mutually mixed without any reaction.

The results of measurements of thermal deformation characteristics of the artificial hairs manufactured in Examples 1-7 and Comparative Examples 1-6 are shown next.

Initial shape memory (also called curling) was applied to said artificial hairs after spinning. More concretely, the artificial hairs 2 of Examples 1-7 and Comparative Examples 1-4 were cut to the length of 150 mm after spinning, were then wound around aluminum pipe of 22 mm diameter, and heat treated at 180° C. for 2 hours. The artificial hairs of Comparative Examples 5 and 6 were curled by the same condition as above except for thermal treatment at 170° C. for 1 hour.

Next, said artificial hairs 2 were wound around aluminum pipes of 70 mm diameter, thermally treated by a hair drier for one minute and for two minutes, and then cooled to room temperature. The surface temperature was set to 75 to 85° C. when hot air from a hair drier reached the artificial hairs 2. The curl diameter of the artificial hair 2 when said thermal treatment was over, the curl diameter of the artificial hair 2 after leaving for 24 hours at room temperature, the curl diameter at room temperature when washed thereafter with shampoo by warm water of 40° C. and dried spontaneous leaving, and the curl diameter of the artificial hair 2 steam-treated at temperature between 95 and 100° C. and then cooled to room temperature were measured for respective Examples and Comparative Examples.

FIG. 13 is a table for the artificial hairs of Examples 1-7 and Comparative Examples 1-6 showing (A) the changes of curl diameters by thermal treatment, (B) and (C) the ratios of the changes, respectively.

As is shown in FIG. 13(A), for the artificial hair 2 of Example 1 (polyethylene terephthalate content 3 weight %, hereinafter properly called PET content), the curl diameter before and after thermal treatment for one minute by a hair drier was changed from 25 mm to 48 mm, that after leaving at room temperature for 24 hours and after shampooing was 45 mm, thus resulting in secondary shape forming. It was 30 mm after steaming, thus it could be seen to have nearly returned to the initial shape memory state.

For the artificial hair 2 of Example 2 (PET content 5 weight %), the curl diameter before and after thermal treatment for one minute by a hair drier was changed from 25 mm to 45 mm, that after leaving at room temperature for 24 hours and after shampooing was 44 mm and 43 mm, respectively, thus resulting in secondary shape forming. It was 28 mm after steaming, thus it could be seen to have nearly returned to the initial shape memory state.

For the artificial hair 2 of Example 3 (PET content 10 weight %), the curl diameter before and after thermal treatment for one minute by a hair drier was changed from 25 mm to 42 mm, that after leaving at room temperature for 24 hours and after shampooing was 41 mm and 40 mm, respectively, thus resulting in secondary shape forming. It was 27 mm after steaming, thus it could be seen to have nearly returned to the initial shape memory state.

For the artificial hair 2 of Example 4 (PET content 15 weight %), the curl diameter before and after thermal treatment for one minute by a hair drier was changed from 25 mm to 40 mm, that after leaving at room temperature for 24 hours and after shampooing was 39 mm, thus resulting in secondary shape forming. It was 27 mm after steaming, thus it could be seen to have nearly returned to the initial shape memory state.

For the artificial hair 2 of Example 5 (PET content 20 weight %), the curl diameter before and after thermal treatment for one minute by a hair drier was changed from 25 mm to 38 mm, that after leaving at room temperature for 24 hours and after shampooing was 38 mm and 36 mm, respectively, thus resulting in secondary shape forming. It was 26 mm after steaming, thus it could be seen to have nearly returned to the initial shape memory state.

For the artificial hair 2 of Example 6 (PET content 25 weight %), the curl diameter before and after thermal treatment for one minute by a hair drier was changed from 25 mm to 35 mm, that after leaving at room temperature for 24 hours and after shampooing was 34 mm and 33 mm, respectively, thus resulting in secondary shape forming. It was 25 mm after steaming, thus it could be seen to have returned completely to the initial shape memory state.

For the artificial hair 2 of Example 7 (PET content 30 weight %), the curl diameter before and after thermal treatment for one minute by a hair drier was changed from 25 mm to 30 mm, that after leaving at room temperature for 24 hours and after shampooing stayed unchanged as 30 mm, thus resulting in secondary shape forming. It was 25 mm after steaming, thus returned completely to the initial shape memory state.

From the results above, as shown in FIG. 13(B) for Examples 1-7, the initial shape memory state of artificial hair 2 was thermally treated by a hair drier, thus resulting in secondary shape forming, and its thermal deformation ratios were 192, 180, 168, 160, 152, 140, and 120%, respectively, which shows that the thermal deformation ratio is lower as polyethylene terephthalate content increases. The thermal deformation ratios of the curl diameter of the artificial hairs 2 after leaving at room temperature for 24 hours and after shampooing were 94-100% for Examples 1-7, which shows that the thermal deformation ratio is lower as polyethylene terephthalate content increases.

On the other hand, for the artificial hair of Comparative Example 1 (PET content 0 weight %), it is seen that the curl diameter before and after thermal treatment for one minute by a hair drier was changed from 25 mm to 50 mm, that after leaving at room temperature for 24 hours and after shampooing was unchanged as 50 mm, and 35 mm after steaming. As for the artificial hair of Comparative Example 2 (PET content 1 weight %), it is seen that the curl diameter before and after thermal treatment for one minute by a hair drier was changed from 25 mm to 50 mm, that after leaving at room temperature for 24 hours and after shampooing was 49 mm, and 32 mm after steaming. It is seen from this that the thermal deformation ratio was higher than in Examples in case of Comparative Example 1 where MXD6 was 100% and polyethylene terephthalate was 1 weight % in Comparative Example 2.

As for the artificial hair of Comparative Example 3 (PET content 35 weight %), it is seen that the curl diameter before and after thermal treatment for one minute by a hair drier was changed from 25 mm to 27 mm, that after leaving at room temperature for 24 hours and after shampooing was unchanged as 27 mm, and 25 mm after steaming, thus showing to have almost no thermal deformation. As for the artificial hair of Comparative Example 4 (PET content 40 weight %), it is seen that the curl diameter after thermal treatment for one minute by a hair drier, that after leaving at room temperature for 24 hours, and after shampooing were all unchanged as 25 mm, and also 25 mm after steaming, thus showing to have no thermal deformation.

From these observations, in case of polyethylene terephthalate over 35 weight % as in Comparative Examples 3 and 4, it is seen that almost or entirely no thermal deformation takes place.

The artificial hair of Comparative Example 5 is that of 100% polyethylene terephthalate, and it is seen that its curl diameter before and after thermal treatment for one minute by a hair drier was unchanged as 25 mm, that after leaving at room temperature for 24 hours, and after shampooing and after steaming were all also 25 mm, thus no thermal deformation occurred at all in the conventional artificial hair of polyethylene terephthalate.

The artificial hair of Comparative Example 6 is made of nylon 6, and it is seen that its curl diameter before and after thermal treatment for one minute by a hair drier was changed from 30 mm to 34 mm, that after leaving at room temperature for 24 hours, and after shampooing were 33 and 31 mm, respectively, thus not resulting in secondary shape forming. It was seen to be 31 mm after steaming, thus nearly returning to initial shape memory state.

It is seen from these observations that, for the conventional artificial hairs of polyethylene terephthalate and nylon 6, almost no thermal deformation occurred, that is, not resulting in secondary shape forming.

FIG. 13(C) shows the curl diameters and the thermal deformation ratios (%) before and after thermal treatment for two minutes. For the artificial hair of Example 1 (PET content 3 weight %), the curl diameter before and after thermal treatment was changed from 25 mm to 55 mm, and the thermal deformation ratio was 220%.

For the artificial hair 2 of Example 2 (PET content 5 weight %), the curl diameter before and after thermal treatment was changed from 25 mm to 52 mm, and the thermal deformation ratio was 208%.

For the artificial hair 2 of Example 3 (PET content 10 weight %), the curl diameter before and after thermal treatment was changed from 25 mm to 50 mm, and the thermal deformation ratio was 200%.

For the artificial hair 2 of Example 4 (PET content 15 weight %), the curl diameter before and after thermal treatment was changed from 25 mm to 48 mm, and the thermal deformation ratio was 192%.

For the artificial hair 2 of Example 5 (PET content 20 weight %), the curl diameter before and after thermal treatment was changed from 25 mm to 46 mm, and the thermal deformation ratio was 184%.

For the artificial hair 2 of Example 6 (PET content 25 weight %), the curl diameter before and after thermal treatment was changed from 25 mm to 42 mm, and the thermal deformation ratio was 168%.

For the artificial hair 2 of Example 7 (PET content 30 weight %), the curl diameter before and after thermal treatment was changed from 25 mm to 35 mm, and the thermal deformation ratio was 140%.

From the results above, it is seen that, in case of thermal treatment time of two minutes like the case of one minute, the curl diameter changing and the thermal deformation ratio were lowered as polyethylene terephthalate content increased.

On the other hand, for the artificial hair of Comparative Example 1 (PET content 0 weight %), the curl diameter before and after thermal treatment for two minutes by a hair drier was changed from 25 mm to 59 mm, and the thermal deformation ratio was 236%. For the artificial hair of Comparative Example 2 (PET content 1 weight %), the curl diameter before and after thermal treatment was changed from 25 mm to 58 mm, and the thermal deformation ratio was 232%.

From these, it is seen that, in case of 100% MXD6 and 1 weight % polyethylene terephthalate in Comparative Example 1, the thermal deformation ratio was higher than in Examples.

For the artificial hair of Comparative Example 3 (PET content 35 weight %), the curl diameter before and after thermal treatment by a hair drier was changed from 25 mm to 30 mm, and the thermal deformation ratio was 120%. For the artificial hair of Comparative Example 4 (PET content 40 weight %), the curl diameter before and after thermal treatment by a hair drier was changed from 25 mm to 28 mm, and the thermal deformation ratio was 112%.

From these, it is seen that, in case of 35 weight % or more of polyethylene terephthalate in Comparative Examples 3 and 4, the thermal deformation ratio does not almost or entirely occur, that is, not resulting in secondary shape forming.

The artificial hair of Comparative Example 5 is that of 100% polyethylene terephthalate, and its curl diameter before and after thermal treatment by a hair drier was changed from 25 mm to 26 mm, and the thermal deformation ratio was 104%. The artificial hair of Comparative Example 6 is made of nylon 6, and its curl diameter before and after thermal treatment by a hair drier was changed from 25 mm to 35 mm, and the thermal deformation ratio was 117%.

From these, it is seen that, for the conventional artificial hairs made of polyethylene terephthalate and nylon 6, the thermal deformation ratio did not almost increase as thermal treatment time was made longer, that is, not resulting in secondary shape forming.

Secondary shape forming was next performed by the same condition as above except that the spun artificial hair 2 was wound around aluminum pipe having a diameter of 18 mm.

FIG. 14 is a Table for another secondary shape forming of Examples 1 to 7 and Comparative Examples 1 to 6, wherein (A) shows the curl diameter change by thermal treatment, and (B) and (C) show the changing ratio. It is seen from FIG. 14(A) that, for artificial hair 2 of Example 1 (PET content 3 weight %), the curl diameter before and after one minute thermal treatment by a hair drier was changed from 21 mm to 47 mm, and 45 mm after leaving at room temperature for 24 hours and after shampooing, thus resulting in secondary shape forming. It was 24 mm after steaming, thus it could be seen to have nearly returned to the initial shape memory state.

For artificial hair 2 of Example 2 (PET content 5 weight %), the curl diameter before and after one minute thermal treatment by a hair drier was changed from 21 mm to 43 mm, and that after leaving at room temperature for 24 hours and after shampooing 42 mm and 41 mm, respectively, thus resulting in secondary shape forming. It was 23 mm after steaming, thus it could be seen to have nearly returned to the initial shape memory state.

For artificial hair 2 of Example 3 (PET content 10 weight %), the curl diameter before and after one minute thermal treatment by a hair drier was changed from 21 mm to 41 mm, and 39 mm and 38 mm, respectively, after leaving at room temperature for 24 hours and after shampooing, thus resulting in secondary shape forming. It was 22 mm after steaming, thus it could be seen to have nearly returned to the initial shape memory state.

For artificial hair 2 of Example 4 (PET content 15 weight %), the curl diameter before and after one minute thermal treatment by a hair drier was changed from 21 mm to 39 mm, and 35 mm after leaving at room temperature for 24 hours and after shampooing, thus resulting in secondary shape forming. It was 22 mm after steaming, thus it could be seen to have nearly returned to the initial shape memory state.

For artificial hair 2 of Example 5 (PET content 20 weight %), the curl diameter before and after one minute thermal treatment by a hair drier was changed from 21 mm to 33 mm, and 33 mm after leaving at room temperature for 24 hours and after shampooing, thus resulting in secondary shape forming. It was 21 mm after steaming, thus it could be seen to have completely returned to the initial shape memory state.

For artificial hair 2 of Example 6 (PET content 25 weight %), the curl diameter before and after one minute thermal treatment by a hair drier was changed from 21 mm to 31 mm, and 29 mm and 28 mm, respectively, after leaving at room temperature for 24 hours and after shampooing, thus resulting in secondary shape forming. It was 21 mm after steaming, thus it could be seen to have completely returned to the initial shape memory state.

For artificial hair 2 of Example 7 (PET content 30 weight %), the curl diameter before and after one minute thermal treatment by a hair drier was changed from 21 mm to 29 mm, and 29 mm and 28 mm, respectively, after leaving at room temperature for 24 hours and after shampooing, thus resulting in secondary shape forming. It was 21 mm after steaming, thus it could be seen to have completely returned to the initial shape memory state.

From the results above, as shown in FIG. 14(B) for Examples 1-7, the initial shape memory state of artificial hair 2 was thermally treated by a hair drier, thus resulting in secondary shape forming, and its thermal deformation ratios were 224, 205, 195, 186, 157, 148, and 138%, respectively, which shows that the thermal deformation ratio is lower as polyethylene terephthalate content increases. The thermal deformation ratios of the curl diameter of the artificial hairs 2 after leaving at room temperature for 24 hours and after shampooing were 94-100% for Examples 1-7, which shows that the thermal deformation ratio is lower as polyethylene terephthalate content increases.

On the other hand, for artificial hair of Comparative Example 1 (PET content 0 weight %), it turned out that the curl diameter before and after thermal treatment for one minute by a hair drier was changed from 21 mm to 50 mm, unchanged as 49 mm after leaving at room temperature for 24 hours and after shampooing, and 29 mm after steaming. For artificial hair of Comparative Example 2 (PET content 1 weight %), it turned out that the curl diameter before and after thermal treatment for one minute by a hair drier was changed from 21 mm to 49 mm, 49 mm and 48 mm, respectively, after leaving at room temperature for 24 hours and after shampooing, and 28 mm after steaming. It is seen from these that, in case that MXD6 was 100% in Comparative Example 1 and polyethylene terephthalate was 1 weight %, thermal deformation ratio is higher than in Examples.

For artificial hair of Comparative Example 3 (PET content 35 weight %), it turned out that the curl diameter before and after one minute thermal treatment by a hair drier was changed from 21 mm to 25 mm, 25 mm and 24 mm, respectively, after leaving at room temperature for 24 hours and after shampooing, and 21 mm after steaming, thus it could be seen to have returned to the initial shape memory state. For artificial hair of Comparative Example 4 (PET content 40 weight %), it turned out that the curl diameter before and after one minute thermal treatment by a hair drier was changed from 21 mm to 23 mm, 23 mm after leaving at room temperature for 24 hours and after shampooing, and 21 mm after steaming, thus it could be seen to have returned to the initial shape memory state. It is seen from these that, in case that polyethylene terephthalate was 35 weight % or more as in Comparative Examples 3 and 4, thermal deformation ratio is low.

The artificial hair of Comparative Example 5 is that of 100% polyethylene terephthalate, and its curl diameter before and after one minute thermal treatment by a hair drier was scarcely changed from 21 mm to 22 mm, 21 mm after leaving at room temperature for 24 hours and after shampooing, and also 21 mm after steaming. The artificial hair of Comparative Example 6 is made of nylon 6, and its curl diameter before and after one minute thermal treatment by a hair drier was changed from 26 mm to 29 mm, 28 mm and 26 mm, respectively, after leaving at room temperature for 24 hours and after shampooing, and 26 mm after steaming, thus it could be seen to have nearly returned to the initial shape memory state. It is seen from this that, for artificial hairs of conventional polyethylene terephthalate and of conventional nylon 6, almost no thermal deformation takes place, that is, secondary shape forming could not be performed.

FIG. 14(C) shows the curl diameter and the thermal deformation ratio (%) before and after thermal treatment for two minutes. For the artificial hair of Example 1 (PET content 3 weight %), the curl diameter before and after thermal treatment was changed from 21 mm to 54 mm, and the thermal deformation ratio was 257%.

For the artificial hair 2 of Example 2 (PET content 5 weight %), the curl diameter before and after thermal treatment was changed from 21 mm to 52 mm, and the thermal deformation ratio was 248%.

For the artificial hair 2 of Example 3 (PET content 10 weight %), the curl diameter before and after thermal treatment was changed from 21 mm to 49 mm, and the thermal deformation ratio was 233%.

For the artificial hair 2 of Example 4 (PET content 15 weight %), the curl diameter before and after thermal treatment was changed from 21 mm to 47 mm, and the thermal deformation ratio was 224%.

For the artificial hair 2 of Example 5 (PET content 20 weight %), the curl diameter before and after thermal treatment was changed from 21 mm to 46 mm, and the thermal deformation ratio was 219%.

For the artificial hair 2 of Example 6 (PET content 25 weight %), the curl diameter before and after thermal treatment was changed from 21 mm to 40 mm, and the thermal deformation ratio was 190%.

For the artificial hair 2 of Example 7 (PET content 30 weight %), the curl diameter before and after thermal treatment was changed from 21 mm to 34 mm, and the thermal deformation ratio was 162%.

From the results above, it is seen that, in case of thermal treatment time of two minutes like the case of one minute, the curl diameter changing and the thermal deformation ratio were lowered as polyethylene terephthalate content increased.

On the other hand, for the artificial hair of Comparative Example 1 (PET content 0 weight %), the curl diameter before and after thermal treatment for two minutes by a hair drier was changed from 21 mm to 59 mm, and the thermal deformation ratio was 281%. For the artificial hair of Comparative Example 2 (PET content 1 weight %), the curl diameter before and after thermal treatment was changed from 21 mm to 57 mm, and the thermal deformation ratio was 271%. It is seen from this that, in case of 100% MXD6 and 1 weight % polyethylene terephthalate in Comparative Example 1, the thermal deformation ratio was higher than in Examples.

For the artificial hair of Comparative Example 3 (PET content 35 weight %), the curl diameter before and after thermal treatment by a hair drier was changed from 21 mm to 30 mm, and the thermal deformation ratio was 143%. For the artificial hair of Comparative Example 4 (PET content 40 weight %), the curl diameter before and after thermal treatment was changed from 21 mm to 27 mm, and the thermal deformation ratio was 129%. It is seen from this that, in case that polyethylene terephthalate is 35 weight % or more as in Comparative Examples 3 and 4, no or almost no thermal deformation ratio occurs.

For the artificial hair of Comparative Example 5 (polyethylene terephthalate 100%), the curl diameter before and after thermal treatment by a hair drier was changed from 21 mm to 23 mm, and the thermal deformation ratio was 105%. For the artificial hair of Comparative Example 6 (nylon 6, 100%), the curl diameter before and after thermal treatment by a hair drier was changed from 26 mm to 32 mm, and the thermal deformation ratio was 112%. From this, for artificial hairs of conventional polyethylene terephthalate and nylon 6, thermal deformation did not increase even by longer thermal treating time, and secondary shape forming could not be performed.

Secondary shape forming was next performed by the same condition as above except that the spun artificial hair 2 was wound around aluminum pipe having a diameter of 32 mm.

FIG. 15 is a Table for another secondary shape forming of Examples 1 to 7 and Comparative Examples 1 to 6, wherein (A) shows the curl diameter change by thermal treatment, and (B) and (C) show the changing ratio.

As is shown in FIG. 15(A) that, for artificial hair 2 of Example 1 (PET content 3 weight %), the curl diameter before and after one minute thermal treatment by a hair drier was changed from 35 mm to 57 mm, and 57 mm and 56 mm, respectively, after leaving at room temperature for 24 hours and after shampooing, thus resulting in secondary shape forming. It was 37 mm after steaming, thus it could be seen to have nearly returned to the initial shape memory state.

For artificial hair 2 of Example 2 (PET content 5 weight %), the curl diameter before and after one minute thermal treatment by a hair drier was changed from 35 mm to 55 mm, and 54 mm after leaving at room temperature for 24 hours and after shampooing, thus resulting in secondary shape forming. It was 37 mm after steaming, thus it could be seen to have nearly returned to the initial shape memory state.

For artificial hair 2 of Example 3 (PET content 10 weight %), the curl diameter before and after one minute thermal treatment by a hair drier was changed from 35 mm to 54 mm, and 54 mm and 53 mm, respectively, after leaving at room temperature for 24 hours and after shampooing, thus resulting in secondary shape forming. It was 36 mm after steaming, thus it could be seen to have nearly returned to the initial shape memory state.

For artificial hair 2 of Example 4 (PET content 15 weight %), the curl diameter before and after one minute thermal treatment by a hair drier was changed from 35 mm to 50 mm, and was unchanged as 50 mm after leaving at room temperature for 24 hours and after shampooing, thus resulting in secondary shape forming. It was 36 mm after steaming, thus it could be seen to have nearly returned to the initial shape memory state.

For artificial hair 2 of Example 5 (PET content 20 weight %), the curl diameter before and after one minute thermal treatment by a hair drier was changed from 34 mm to 47 mm, and 46 mm after leaving at room temperature for 24 hours and after shampooing, thus resulting in secondary shape forming. It was 35 mm after steaming, thus it could be seen to have nearly returned to the initial shape memory state.

For artificial hair 2 of Example 6 (PET content 25 weight %), the curl diameter before and after one minute thermal treatment by a hair drier was changed from 34 mm to 44 mm, and 45 mm after leaving at room temperature for 24 hours and after shampooing, thus resulting in secondary shape forming. It was 36 mm after steaming, thus it could be seen to have nearly returned to the initial shape memory state.

For artificial hair 2 of Example 7 (PET content 30 weight %), the curl diameter before and after one minute thermal treatment by a hair drier was changed from 34 mm to 44 mm, and 44 mm and 43 mm, respectively, after leaving at room temperature for 24 hours and after shampooing, thus resulting in secondary shape forming. It was 35 mm after steaming, thus it could be seen to have nearly returned to the initial shape memory state.

From the results above, as shown in FIG. 15(B) for Examples 1-7, the thermal deformation ratios from the initial shape memory state of artificial hair 2 after one minute thermal treatment by a hair drier were 163, 157, 154, 143, 138, 129, and 126%, respectively, which shows that the thermal deformation ratio is lower as polyethylene terephthalate content increases. The thermal deformation ratios of the curl diameter of the artificial hairs 2 after leaving at room temperature for 24 hours and after shampooing were 98-102% for Examples 1-7, which shows that the thermal deformation ratio is lower as polyethylene terephthalate content increases.

On the other hand, for the artificial hair of Comparative Example 1 (PET content 0 weight %), it turned out that the curl diameter before and after thermal treatment for one minute by a hair drier was changed from 35 mm to 60 mm, 58 mm after leaving at room temperature for 24 hours and after shampooing, and 44 mm after steaming. For the artificial hair of Comparative Example 2 (PET content 1 weight %), it turned out that the curl diameter before and after thermal treatment for one minute by a hair drier was changed from 35 mm to 60 mm, 57 mm and 56 mm, respectively, after leaving at room temperature for 24 hours and after shampooing, and 42 mm after steaming.

It is seen from this that, in case of 100% MXD6 and 1 weight % polyethylene terephthalate in Comparative Example 1, the thermal deformation ratio was higher than in Examples.

For the artificial hair of Comparative Example 3 (PET content 35 weight %), it turned out that the curl diameter before and after thermal treatment for one minute by a hair drier was changed from 34 mm to 38 mm, was unchanged as 38 mm after leaving at room temperature for 24 hours and after shampooing, and 36 mm after steaming. For the artificial hair of Comparative Example 4 (PET content 40 weight %), it turned out that the curl diameter before and after thermal treatment for one minute by a hair drier was changed from 34 mm to 38 mm, and after leaving at room temperature for 24 hours and after shampooing, it was, 35 mm and 37 mm, respectively, after leaving at room temperature for 24 hours and after shampooing, and 35 mm after steaming. It is seen from this that when polyethylene terephthalate is 35 weight % or more as in Comparative Examples 3 and 4, secondary shape forming could not be performed.

For the artificial hair of Comparative Example 5 (polyethylene terephthalate 100%), it turned out that the curl diameter before and after thermal treatment for one minute by a hair drier was unchanged as 33 mm, and 35 mm and 37 mm, respectively, after leaving at room temperature for 24 hours and after shampooing. It was 35 mm after steaming. For the artificial hair of Comparative Example 6 (nylon 6, 100%), the curl diameter before and after thermal treatment for one minute by a hair drier was changed from 46 mm to 50 mm, and 49 mm and 47 mm, respectively, after leaving at room temperature for 24 hours and after shampooing. It was 47 mm after steaming. From this, for artificial hairs of conventional polyethylene terephthalate and nylon 6, secondary shape forming could not be performed.

FIG. 15(C) shows the curl diameter and the thermal deformation ratio (%) after thermal treatment for two minutes by a hair drier. For the artificial hair of Example 1 (PET content 3 weight %), the curl diameter before and after thermal treatment was changed from 35 mm to 64 mm, and the thermal deformation ratio was 183%.

For the artificial hair 2 of Example 2 (PET content 5 weight %), the curl diameter before and after thermal treatment was changed from 35 mm to 60 mm, and the thermal deformation ratio was 171%.

For the artificial hair 2 of Example 3 (PET content 10 weight %), the curl diameter before and after thermal treatment was changed from 35 mm to 59 mm, and the thermal deformation ratio was 169%.

For the artificial hair 2 of Example 4 (PET content 15 weight %), the curl diameter before and after thermal treatment was changed from 35 mm to 55 mm, and the thermal deformation ratio was 157%.

For the artificial hair 2 of Example 5 (PET content 20 weight %), the curl diameter before and after thermal treatment was changed from 34 mm to 54 mm, and the thermal deformation ratio was 159%.

For the artificial hair 2 of Example 6 (PET content 25 weight %), the curl diameter before and after thermal treatment was changed from 34 mm to 48 mm, and the thermal deformation ratio was 141%.

For the artificial hair 2 of Example 7 (PET content 30 weight %), the curl diameter before and after thermal treatment was changed from 34 mm to 48 mm, and the thermal deformation ratio was 141%.

From the results above, it is seen that, in case of thermal treatment time of two minutes like the case of one minute, the curl diameter changing and the thermal deformation ratio were lowered as polyethylene terephthalate content increased.

On the other hand, for the artificial hair of Comparative Example 1 (PET content 0 weight %), the curl diameter before and after thermal treatment for two minutes by a hair drier was changed from 35 mm to 65 mm, and the thermal deformation ratio was 186%. For the artificial hair of Comparative Example 2 (PET content 1 weight %), the curl diameter before and after thermal treatment was changed from 35 mm to 65 mm, and the thermal deformation ratio was 186%. It is seen from this that, in case of 100% MXD6 and 1 weight % polyethylene terephthalate in Comparative Example 1, the thermal deformation ratio was higher than in Examples.

For the artificial hair of Comparative Example 3 (PET content 35 weight %), the curl diameter before and after thermal treatment for two minutes by a hair drier was changed from 34 mm to 45 mm, and the thermal deformation ratio was 132%. For the artificial hair of Comparative Example 4 (PET content 40 weight %), the curl diameter before and after thermal treatment was changed from 34 mm to 40 mm, and the thermal deformation ratio was 118%. It is seen from this that when polyethylene terephthalate is 35 weight % or more as in Comparative Examples 3 and 4, thermal deformation ratio is low.

For the artificial hair of Comparative Example 5 (polyethylene terephthalate 100%), the curl diameter before and after thermal treatment by a hair drier was changed from 33 mm to 36 mm, and the thermal deformation ratio was 109%. For the artificial hair of Comparative Example 6 (nylon 6, 100%), the curl diameter before and after thermal treatment by a hair drier was changed from 46 mm to 52 mm, and the thermal deformation ratio was 113%. From this, for artificial hairs of conventional polyethylene terephthalate and nylon 6, secondary shape forming could not be performed even by longer thermal treating time.

Next, after curling by the same condition as above except that the spun artificial hair 2 was wound around aluminum pipe having a diameter of 50 mm, wound again around aluminum pipe having a diameter of 22 mm, and it was thermally treated by a hair drier.

FIG. 16 is a Table for another secondary shape forming of artificial hairs of Examples 1 to 7 and Comparative Examples 1 to 6, wherein (A) shows the curl diameter change by thermal treatment, and (B) and (C) show the changing ratio. From FIG. 16(A), for artificial hair 2 of Example 1 (PET content 3 weight %), the curl diameter before and after one minute thermal treatment by a hair drier was changed from 55 mm to 30 mm, and 30 mm and 32 mm, respectively, after leaving at room temperature for 24 hours and after shampooing, thus resulting in secondary shape forming. It was 56 mm after steaming, thus it could be seen to have nearly returned to the initial shape memory state.

For artificial hair 2 of Example 2 (PET content 5 weight %), the curl diameter before and after one minute thermal treatment by a hair drier was changed from 55 mm to 30 mm, and 30 mm and 32 mm, respectively, after leaving at room temperature for 24 hours and after shampooing, thus resulting in secondary shape forming. It was 55 mm after steaming, thus it could be seen to have completely returned to the initial shape memory state.

For artificial hair 2 of Example 3 (PET content 10 weight %), the curl diameter before and after one minute thermal treatment by a hair drier was changed from 55 mm to 34 mm, and 34 mm and 35 mm, respectively, after leaving at room temperature for 24 hours and after shampooing, thus resulting in secondary shape forming. It was 55 mm after steaming, thus it could be seen to have completely returned to the initial shape memory state.

For artificial hair 2 of Example 4 (PET content 15 weight %), the curl diameter before and after one minute thermal treatment by a hair drier was changed from 54 mm to 35 mm, and 36 mm and 38 mm, respectively, after leaving at room temperature for 24 hours and after shampooing, thus resulting in secondary shape forming. It was 54 mm after steaming, thus it could be seen to have nearly returned to the initial shape memory state.

For artificial hair 2 of Example 5 (PET content 20 weight %), the curl diameter before and after one minute thermal treatment by a hair drier was changed from 54 mm to 38 mm, and 39 mm and 40 mm, respectively, after leaving at room temperature for 24 hours and after shampooing, thus resulting in secondary shape forming. It was 54 mm after steaming, thus it could be seen to have completely returned to the initial shape memory state.

For artificial hair 2 of Example 6 (PET content 25 weight %), the curl diameter before and after one minute thermal treatment by a hair drier was changed from 53 mm to 39 mm, and 40 mm after leaving at room temperature for 24 hours and after shampooing, thus resulting in secondary shape forming. It was 53 mm after steaming, thus it could be seen to have completely returned to the initial shape memory state.

For artificial hair 2 of Example 7 (PET content 30 weight %), the curl diameter before and after one minute thermal treatment by a hair drier was changed from 53 mm to 40 mm, and 41 mm and 43 mm, respectively, after leaving at room temperature for 24 hours and after shampooing, thus resulting in secondary shape forming. It was 53 mm after steaming, thus it could be seen to have completely returned to the initial shape memory state.

From the results above, as shown in FIG. 16(B) for Examples 1-7, the thermal deformation ratios from the initial shape memory state of artificial hair 2 after one minute thermal treatment by a hair drier were 55, 55, 62, 65, 70, 74, and 75%, respectively, which shows that the thermal deformation ratio is lower as polyethylene terephthalate content increases. The thermal deformation ratios of the curl diameter of the artificial hairs 2 after leaving at room temperature for 24 hours and after shampooing were 100-103% for Examples 1-7, which shows that the thermal deformation ratio is lower as polyethylene terephthalate content increases.

On the other hand, for the artificial hair of Comparative Example 1 (PET content 0 weight %), it is seen that the curl diameter before and after thermal treatment for one minute by a hair drier was changed from 55 mm to 30 mm, 31 mm and 32 mm, respectively, after leaving at room temperature for 24 hours and after shampooing, and 59 mm after steaming. For artificial hair of Comparative Example 2 (PET content 1 weight %), it turned out that the curl diameter before and after thermal treatment for one minute by a hair drier was changed from 55 mm to 30 mm, 30 mm and 33 mm, respectively, after leaving at room temperature for 24 hours and after shampooing, and 58 mm after steaming. It is seen from this that, in case of 100% MXD6 and 1 weight % polyethylene terephthalate in Comparative Example 1, the thermal deformation ratio was higher than in Examples.

For the artificial hair of Comparative Example 3 (PET content 35 weight %), it is seen that the curl diameter before and after thermal treatment for one minute by a hair drier was changed from 53 mm to 44 mm, 46 mm and 47 mm, respectively, after leaving at room temperature for 24 hours and after shampooing, and 53 mm after steaming, thus it could be seen to have returned to the initial shape memory state. For the artificial hair of Comparative Example 4 (PET content 40 weight %), it is seen that the curl diameter before and after thermal treatment for one minute by a hair drier was changed from 53 mm to 45 mm, 46 mm and 47 mm, respectively, after leaving at room temperature for 24 hours and after shampooing, and 53 mm after steaming, thus it could be seen to have returned to the initial shape memory state. It is seen from this that, in case that polyethylene terephthalate is 35 weight % or more as in Comparative Examples 3 and 4, no or almost no secondary shape forming could be performed.

For the artificial hair of Comparative Example 5 (polyethylene terephthalate 100%), the curl diameter before and after thermal treatment for one minute by a hair drier was changed from 50 mm to 48 mm, and 50 mm after leaving at room temperature for 24 hours, after shampooing, and also after steaming. For the artificial hair of Comparative Example 6 (nylon 6, 100%), the curl diameter before and after thermal treatment for one minute by a hair drier was changed from 62 mm to 55 mm, 60 mm and 64 mm, respectively, after leaving at room temperature for 24 hours and after shampooing, and 64 mm after steaming. It is seen from this that, in case of artificial hairs of conventional polyethylene terephthalate and of conventional nylon 6, secondary shape forming could not be performed.

FIG. 16(C) shows the curl diameter and the thermal deformation ratio after thermal treatment for two minutes by a hair drier. For the artificial hair of Example 1 (PET content 3 weight %), the curl diameter before and after thermal treatment was changed from 55 mm to 25 mm, and the thermal deformation ratio was 45%.

For the artificial hair 2 of Example 2 (PET content 5 weight %), the curl diameter before and after thermal treatment was changed from 55 mm to 26 mm, and the thermal deformation ratio was 47%.

For the artificial hair 2 of Example 3 (PET content 10 weight %), the curl diameter before and after thermal treatment was changed from 55 mm to 26 mm, and the thermal deformation ratio was 47%.

For the artificial hair 2 of Example 4 (PET content 15 weight %), the curl diameter before and after thermal treatment was changed from 54 mm to 29 mm, and the thermal deformation ratio was 54%.

For the artificial hair 2 of Example 5 (PET content 20 weight %), the curl diameter before and after thermal treatment was changed from 54 mm to 30 mm, and the thermal deformation ratio was 56%.

For the artificial hair 2 of Example 6 (PET content 25 weight %), the curl diameter before and after thermal treatment was changed from 53 mm to 35 mm, and the thermal deformation ratio was 66%.

For the artificial hair 2 of Example 7 (PET content 30 weight %), the curl diameter before and after thermal treatment was changed from 53 mm to 38 mm, and the thermal deformation ratio was 72%.

From the results above, it is seen that, in case of thermal treatment time of two minutes like the case of one minute, the curl diameter changing and the thermal deformation ratio were lowered as polyethylene terephthalate content increased.

On the other hand, for the artificial hair of Comparative Example 1 (PET content 0 weight %), the curl diameter before and after thermal treatment for two minutes by a hair drier was changed from 55 mm to 25 mm, and the thermal deformation ratio was 45%. For the artificial hair of Comparative Example 2 (PET content 1 weight %), the curl diameter before and after thermal treatment was changed from 55 mm to 25 mm, and the thermal deformation ratio was 45%. It is seen from this that, in case of 100% MXD6 and 1 weight % polyethylene terephthalate in Comparative Example 1, the thermal deformation ratio was higher than in Examples.

For the artificial hair of Comparative Example 3 (PET content 35 weight %), the curl diameter before and after thermal treatment for two minutes by a hair drier was changed from 53 mm to 40 mm, and the thermal deformation ratio was 75%. For the artificial hair of Comparative Example 4 (PET content 40 weight %), the curl diameter before and after thermal treatment was changed from 53 mm to 41 mm, and the thermal deformation ratio was 77%. It is seen from this that when polyethylene terephthalate is 35 weight % or more as in Comparative Examples 3 and 4, no or almost no thermal deformation ratio occurs.

For the artificial hair of Comparative Example 5 (polyethylene terephthalate 100%), the curl diameter before and after thermal treatment for two minutes by a hair drier was changed from 50 mm to 47 mm, and the thermal deformation ratio was 94%. For the artificial hair of Comparative Example 6 (nylon 6, 100%), the curl diameter before and after thermal treatment for two minutes by a hair drier was changed from 62 mm to 50 mm, and the thermal deformation ratio was 81%. It is seen from this that, for artificial hairs of conventional polyethylene terephthalate and nylon 6, thermal deformation ratio did not almost increase even by longer thermal treating time.

Example 8

Using the spinning machine 50 shown in FIG. 7, the artificial hair 6 of a sheath/core structure was manufactured. More concretely, as a resin for the core portion 1B, MXD6 nylon (MITSUBISHI GAS CHEMICAL COMPANY, Inc., Trade Name MX nylon) with 3 weight % of polyethylene terephthalate (TOYOBO CO., LTD., density 1.40 g/cm$^3$, melting point 255° C.) mixed therein was used, and nylon 6 (TOYOBO, CO., LTD.) was used as a polyamide resin for the sheath portion 1A, to manufacture artificial hair. For the quenching bath 24, warm water of 40° C. was used. By setting the sheath/core volume ratio as 1/5, and the outlet temperature at 275° C., the artificial hair 6 was manufactured.

As a coloring agent, resin chips were used which were made by blending a polyamide resin used either for said sheath 1A or for core 1B and a pigment in pre-determined ratio, heating and melting, and cooling after kneading. These resin chips used as a coloring agent were defined as the master batch. As the master batch used in Example, the resin chips containing 3 weight % black inorganic pigment, the resin chips containing 3 weight % yellow organic pigment, and the resin chips containing 4 weight % red organic pigment were used.

The spinning machine was that spinning 15 strands of fibers through the outlet of 15 holes. The fiber of the sheath/core structure coming out of the outlet 53C was passed through the quenching bath 54 of 1.5 m length and 40° C. warm water to form spherulite on the surface.

Thereafter, it was drawn by passing through hot water of 90° C. in the first stretching roll 55, heat-set by passing through the second stretching roll 57 and the second dry stretching bath 58 at 150° C., annealed for thread diameter size stabilization by passing through the third stretching roll 59 and the third dry stretching bath 60 at 160° C., and was passed through the oiling device 61 for electrostatic prevention.

As a final step, the fiber surface was made coarse by blasting fine alumina powder onto the surface through the fourth stretching roll 62 and the blast machine 63, and rolled up to the rollup machine 64. The stretching ratio of said first and second stretching steps was 5.6, and then the relaxing stretching stress of stretching speed 0.9 times was applied. The speeds of the first to the fourth stretching rolls 55, 57, 59, 62 were adjusted so to make rollup speed 150 m/min. The diameter of thus manufactured artificial hair 6 was 80 μm.

Example 9

The artificial hair 6 of average diameter 80 μm was manufactured by the same condition as Example 8, except that polyethylene terephthalate of the core portion was made 5 weight %.

Example 10

The artificial hair 6 of average diameter 80 μm was manufactured by the same condition as Example 8, except that polyethylene terephthalate of the core portion was made 10 weight %.

Example 11

The artificial hair 6 of average diameter 80 μm was manufactured by the same condition as Example 8, except that polyethylene terephthalate of the core portion was made 15 weight %.

Example 12

The artificial hair 6 of average diameter 80 μm was manufactured by the same condition as Example 8, except that polyethylene terephthalate of the core portion was made 20 weight %.

Example 13

The artificial hair 6 of average diameter 80 μm was manufactured by the same condition as Example 8, except that polyethylene terephthalate of the core portion was made 25 weight %.

Example 14

The artificial hair 6 of average diameter 80 μm was manufactured by the same condition as Example 8, except that polyethylene terephthalate of the core portion was made 30 weight %.

Comparative Examples 7-10 are shown next with regard to Examples 8-14.

Comparative Example 7

The artificial hair of average diameter 80 μm was manufactured by the same condition as Example 8, except that polyethylene terephthalate was not used for the core portion, and hence MXD6 nylon was 100%.

Comparative Example 8

The artificial hair of average diameter 80 μm was manufactured by the same condition as Example 8, except that polyethylene terephthalate was 1 weight % for the core portion.

Comparative Example 9

The artificial hair of average diameter 80 μm was manufactured by the same condition as Example 8, except that polyethylene terephthalate was 35 weight % for the core portion.

Comparative Example 10

The artificial hair of average diameter 80 μm was manufactured by the same condition as Example 8, except that polyethylene terephthalate was 40 weight % for the core portion.

Explanation is made of various characteristics of the artificial hairs 6 manufactured in said Examples 8-14 and Comparative Examples 7-10.

Figure 17:
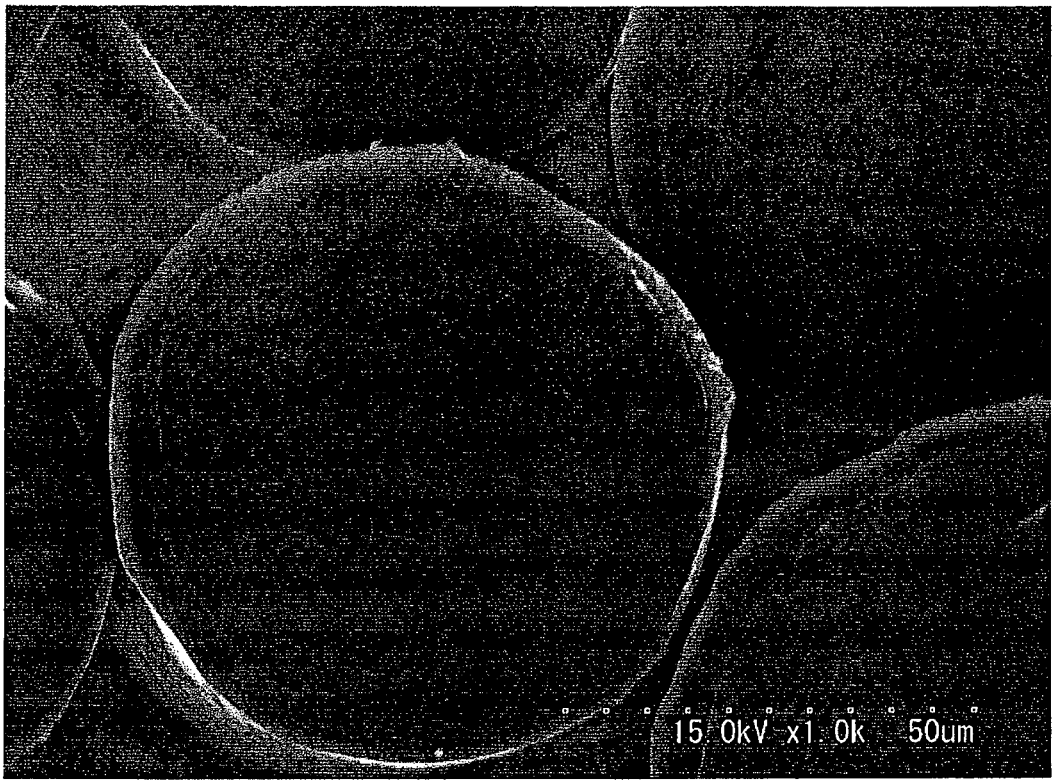
FIG. 17 is an image of the cross section of artificial hair manufactured in Example 10 by a scanning electron microscope.

FIG. 17 is an image of the cross section of artificial hair 6 manufactured in Example 10 by a scanning electron microscope. The electron accelerating voltage was 15 kV, and magnification was 1000. the sheath/core volume ratio of this artificial hair was 1/5, its diameter 80 μm, and the stretching ratio was 5.6 times. As is obvious from the figure, it is seen that a sheath/core structure was formed with MXD6 nylon with polyethylene terephthalate mixed therein as a core portion 1B, and a linear saturated aliphatic polyamide (nylon 6) around it as a sheath portion 1A.

Figure 18:
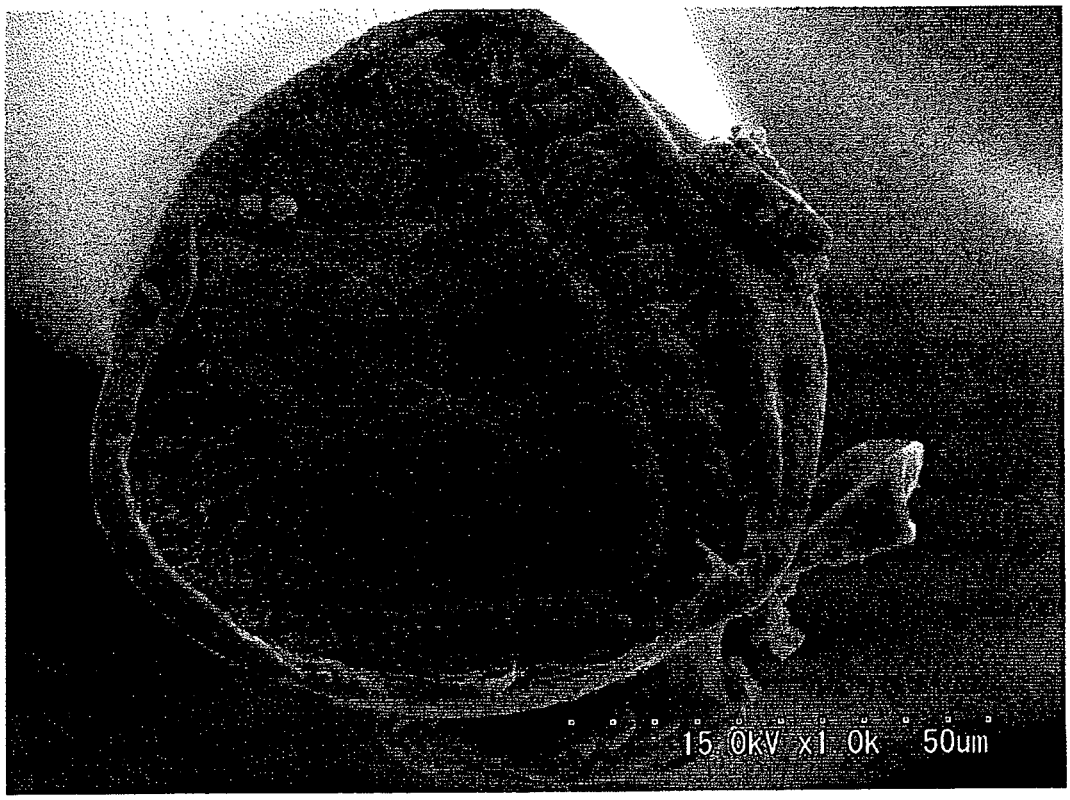
FIG. 18 is an image of the cross section of artificial hair shown in FIG. 17 and treated with alkali solution by a scanning electron microscope.

FIG. 18 is an image of the cross section of artificial hair 6 shown in FIG. 17 treated with an alkali solution by a scanning electron microscope. The electron accelerating voltage was 15 kV, and magnification was 1000. As is obvious from the figure, it is seen that the core portion was corroded while the sheath portion was not. This is because polyethylene terephthalate of the core portion was corroded with alkali solution. However, the cross sectional surface of the core portion is seen not to be corroded as island-like.

Figure 19:
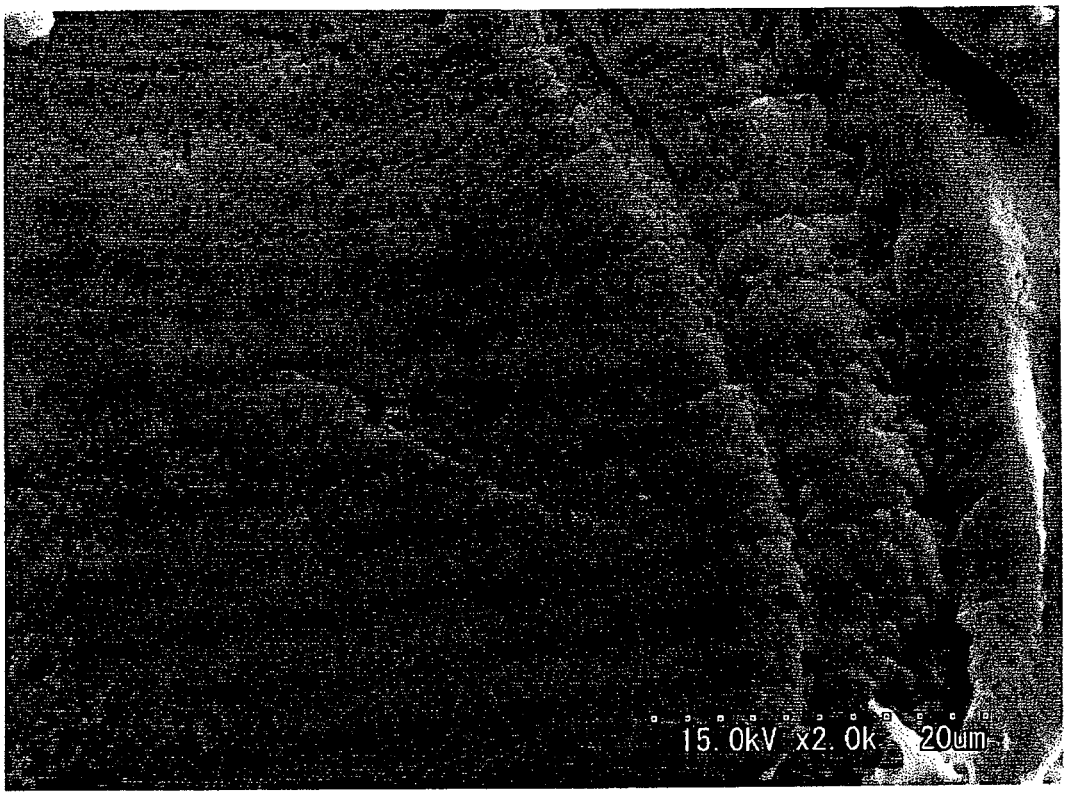
FIG. 19 is an enlarged view of the cross section of artificial hair of Example 10 shown in FIG. 18 by a scanning electron microscope.

FIG. 19 is an image of the cross section of artificial hair of Example 10 enlarged from FIG. 18 by a scanning electron microscope. The electron accelerating voltage was 15 kV, and magnification was 2000. As is obvious from the figure, pits were distributed about homogeneously on the cross section, which proved that polyethylene terephthalate is not partially coagulating in MXD6 of the core portion.

Figure 20:
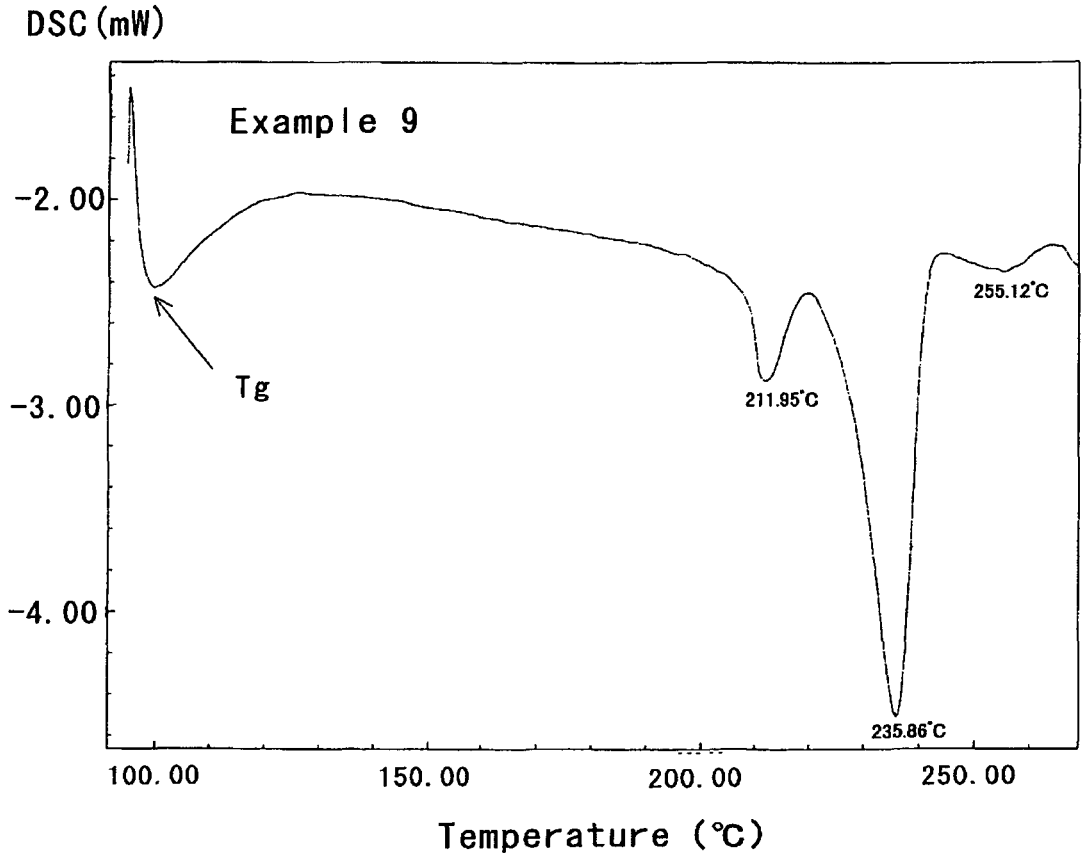
FIG. 20 shows the differential scanning calorimetric measurements of the artificial hair of Example 9.
Figure 21:
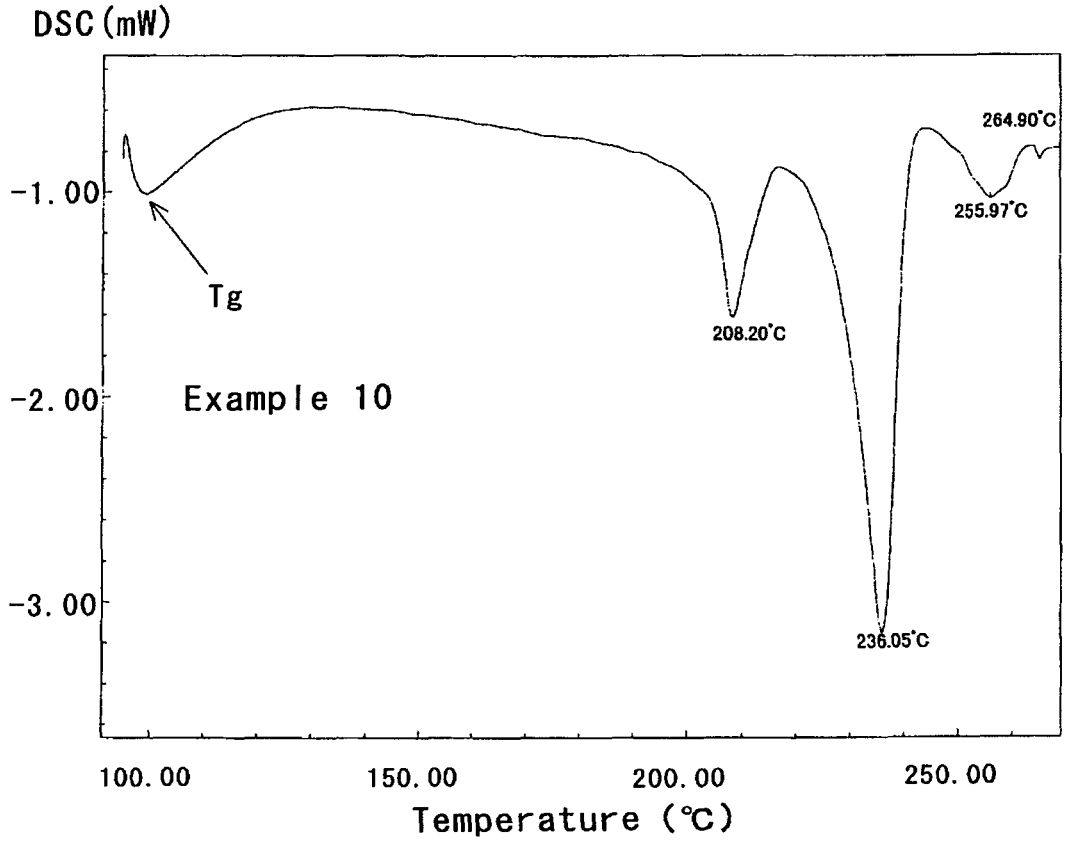
FIG. 21 shows the differential scanning calorimetric measurements of the artificial hair of Example 10.

FIGS. 20 and 21 show the differential scanning calorimetric measurements of the artificial hairs 6 of Examples 9 and 10, respectively, the abscissa axis is temperature (° C.) and the ordinate axis is dq/dt (mW). As is obvious from FIGS. 20 and 21, the artificial hairs 6 of Examples 9 and 10 caused glass transition at around 100° C. (See arrows Tg in FIGS. 20 and 21.), melting peaks were observed at 211.95° C., 235.86° C., and 255.12° C. for the artificial hair 6 of Example 9, and at 208.20° C., 236.05° C., and 255.97° C. for the artificial hair 6 of Example 10, each corresponding to melting points of nylon 6 of the sheath portion and MXD6 nylon and polyethylene terephthalate of the core portion. The artificial hairs of Examples 9 and 10 were spun by mixing polyethylene terephthalate into MXD6 nylon by the ratios of 5 and 10 weight %, respectively, and it is seen from the results of DSC after spinning that the two resins in the core portion do not react with one another, but are mixed with one another homogeneously.

Figure 22:
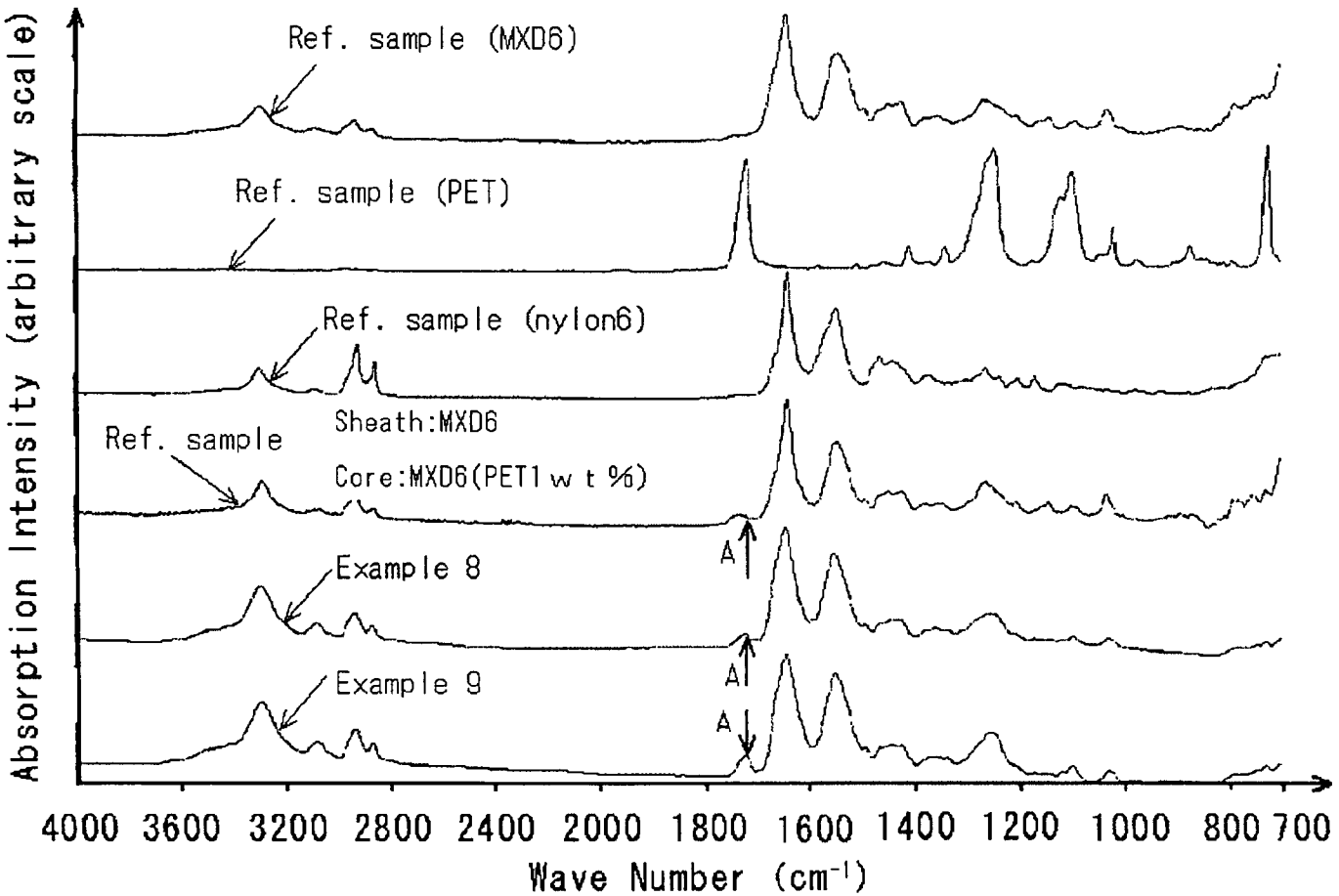
FIG. 22 shows the infrared absorption characteristics of artificial hair 6 explained in Examples 8-14.

FIG. 22 shows infrared absorption characteristics of the artificial hair 6 of Examples 8 and 9. In the figure, the abscissa axis represents wave number ($cm^{-1}$), and the ordinate axis represents absorption intensity (in arbitrary scale). FIG. 22 also shows infrared absorption characteristics of the artificial hair of MXD6 nylon, PET, nylon 6, and a sheath/core structure as the reference sample. The artificial hair as the reference sample had the sheath made of MXD6 nylon, and the core made of MXD6 nylon and 1 weight % of polyethylene terephthalate. The sheath/core ratio was 1/5 by spin discharging volume ratio, and 22/78 by weight ratio.

As is obvious from FIG. 22, it is seen that no new infrared absorption other than each infrared absorption peak of MXD6 nylon, PET, and nylon 6 was detected in any of artificial hair 6 of Example 8 (PET content 3 weight %), artificial hair 6 of Example 9 (PET content 5 weight %), and artificial hair as the reference sample (PET content 1 weight %). The arrow mark A in the figure indicates the infrared absorption peak (about 1730 $cm^{-1}$) due to PET, and the infrared absorption peaks due to PET increase sequentially in the order of artificial hair as the reference sample, artificial hair 6 of Example 8, and of Example 9, thus it is seen to be corresponding to the increase of PET content. It is seen from this that two resins in the core portion do not react, but are mixed with one another homogeneously.

The results of thermal deformation characteristics are shown next for the artificial hairs 6 manufactured in Examples 8-14 and in Comparative Examples 7-10. The method of measurement was same as in case of Examples 1-7.

FIG. 23 is tables showing (A) the curl diameter changes by thermal treatment, (B) and (C) their changing ratios, respectively, for the artificial hairs 6 of Examples 8-14 and Comparative Examples 7-10, each in case that they were wound around aluminum pipe having a diameter of 22 mm, set at the initial shape memory state, and then thermally treated by winding around aluminum pipe having a diameter of 70 mm.

From FIG. 23(A), it is seen that, for the artificial hair 6 of Example 8 (PET content 3 weight %), the curl diameter before and after thermal treatment for one minute by a hair drier was changed from 25 mm to 49 mm, that after leaving at room temperature for 24 hours and after shampooing was 45 mm, thus resulting in secondary shape forming. It was 30 mm after steaming, and was seen to have nearly returned to the initial shape memory state.

For the artificial hair 6 of Example 9 (PET content 5 weight %), the curl diameter before and after thermal treatment for one minute by a hair drier was changed from 25 mm to 46 mm, that after leaving at room temperature for 24 hours and after shampooing was 41 mm and 43 mm, respectively, thus resulting in secondary shape forming. It was 30 mm after steaming, and was seen to have nearly returned to the initial shape memory state.

For the artificial hair 6 of Example 10 (PET content 10 weight %), the curl diameter before and after thermal treatment for one minute by a hair drier was changed from 25 mm to 43 mm, that after leaving at room temperature for 24 hours and after shampooing was 40 mm, thus resulting in secondary shape forming. It was 30 mm after steaming, and was seen to have nearly returned to the initial shape memory state.

It is seen that, for the artificial hair 6 of Example 11 (PET content 15 weight %), the curl diameter before and after thermal treatment for one minute by a hair drier was changed from 25 mm to 40 mm, that after leaving at room temperature for 24 hours and after shampooing was 40 mm and 37 mm, respectively, thus resulting in secondary shape forming. It was 28 mm after steaming, and was seen to have nearly returned to the initial shape memory state.

For the artificial hair 6 of Example 12 (PET content 20 weight %), the curl diameter before and after thermal treatment for one minute by a hair drier was changed from 25 mm to 38 mm, that after leaving at room temperature for 24 hours and after shampooing was 38 mm and 34 mm, respectively, thus resulting in secondary shape forming. It was 28 mm after steaming, and was seen to have nearly returned to the initial shape memory state.

For the artificial hair 6 of Example 13 (PET content 25 weight %), the curl diameter before and after thermal treatment for one minute by a hair drier was changed from 25 mm to 35 mm, that after leaving at room temperature for 24 hours and after shampooing was 34 mm and 32 mm, respectively, thus resulting in secondary shape forming. It was 27 mm after steaming, and was seen to have nearly returned to the initial shape memory state.

For the artificial hair 6 of Example 14 (PET content 30 weight %), the curl diameter before and after thermal treatment for one minute by a hair drier was changed from 25 mm to 30 mm, that after leaving at room temperature for 24 hours and after shampooing was 30 mm and 28 mm, respectively, thus resulting in secondary shape forming. It was 26 mm after steaming, and was seen to have nearly returned to the initial shape memory state.

From the results above, as shown in FIG. 23(B) for the artificial hairs 6 of Examples 8-14, the thermal deformation ratios of the artificial hairs 6 from the initial shape memory state after thermal treatment by a hair drier were 196, 184, 172, 160, 152, 140, and 120%, respectively, which shows that the thermal deformation ratio is lower as polyethylene terephthalate content increases. This characteristics is about same as Examples 1-7. The thermal deformation ratios of the curl diameters of the artificial hairs 6 after leaving at room temperature for 24 hours and after shampooing were 89-100% for Examples 8-14, which shows that the thermal deformation ratio is lower as polyethylene terephthalate content increases.

On the other hand, it is seen that, for the artificial hair of Comparative Example 7 (PET content 0 weight %), the curl diameter before and after thermal treatment for one minute by a hair drier was changed from 25 mm to 50 mm, that after leaving at room temperature for 24 hours and after shampooing was unchanged as 50 mm, and 35 mm after steaming. For the artificial hair of Comparative Example 8 (PET content 1 weight %), the curl diameter before and after thermal treatment for one minute by a hair drier was changed from 25 mm to 50 mm, that after leaving at room temperature for 24 hours and after shampooing was 49 mm, and 32 mm after steaming. From these, it is seen that, in case of 100% MXD6 and 1 weight % polyethylene terephthalate in Comparative Examples 7 and 8, the thermal deformation ratio was higher than in Examples 8-14.

It is seen that, for the artificial hair of Comparative Example 9 (PET content 35 weight %), the curl diameter before and after thermal treatment for one minute by a hair drier was changed from 25 mm to 27 mm, that after leaving at room temperature for 24 hours and after shampooing was unchanged as 27 mm, and 25 mm after steaming, thus returned to the initial shape memory state.

It is seen that, for the artificial hair of Comparative Example 10 (PET content 40 weight %), the curl diameter before and after thermal treatment for one minute by a hair drier was changed from 25 mm to 26 mm, that after leaving at room temperature for 24 hours and after shampooing was unchanged as 25 mm, and 25 mm after steaming, which shows there is no thermal deformation.

From these, it is seen that, in case of 35 weight % or more of polyethylene terephthalate in Comparative Examples 9 and 10, the thermal deformation ratio does not almost or entirely occur.

FIG. 23(C) shows the length and thermal deformation ratio (%) after thermal treatment for two minutes by a hair drier. For the artificial hair 6 of Example 8 (PET content 3 weight %), the curl diameter before and after thermal treatment was changed from 25 mm to 55 mm and the thermal deformation ratio was 220%.

For the artificial hair 6 of Example 9 (PET content 5 weight %), the curl diameter before and after thermal treatment was changed from 25 mm to 50 mm and the thermal deformation ratio was 200%.

For the artificial hair 6 of Example 10 (PET content 10 weight %), the curl diameter before and after thermal treatment was changed from 25 mm to 50 mm and the thermal deformation ratio was 200%.

For the artificial hair 6 of Example 11 (PET content 15 weight %), the curl diameter before and after thermal treatment was changed from 25 mm to 46 mm and the thermal deformation ratio was 184%.

For the artificial hair 6 of Example 12 (PET content 20 weight %), the curl diameter before and after thermal treatment was changed from 25 mm to 45 mm and the thermal deformation ratio was 180%.

For the artificial hair 6 of Example 13 (PET content 25 weight %), the curl diameter before and after thermal treatment was changed from 25 mm to 42 mm and the thermal deformation ratio was 168%.

For the artificial hair 6 of Example 14 (PET content 30 weight %), the curl diameter before and after thermal treatment was changed from 25 mm to 35 mm and the thermal deformation ratio was 140%.

From the results above, it is seen that, in case of two minutes thermal treatment above, similarly to the case of one minute, the curl diameter change and its thermal deformation ratio (%) were lower as polyethylene terephthalate content increased. The curl diameter change by said thermal deformation was about same as in Examples 1-7.

On the other hand, for the artificial hair of Comparative Example 7 (PET content 0 weight %), the curl diameter before and after thermal treatment for two minutes by a hair drier was changed from 25 mm to 59 mm, and the thermal deformation ratio was 236%. For the artificial hair of Comparative Example 8 (PET content 1 weight %), the curl diameter before and after thermal treatment was changed from 25 mm to 57 mm, and the thermal deformation ratio was 228%. It is seen from these that, in case of 100% MXD6 and 1 weight % polyethylene terephthalate in Comparative Examples 7 and 8, the thermal deformation ratio was higher than in Examples 8-14.

For the artificial hair of Comparative Example 9 (PET content 35 weight %), the curl diameter before and after thermal treatment for two minutes by a hair drier was changed from 25 mm to 30 mm, and the thermal deformation ratio was 120%. For the artificial hair of Comparative Example 10 (PET content 40 weight %), the curl diameter before and after thermal treatment by a hair drier was changed from 25 mm to 28 mm, and the thermal deformation ratio was 112%. It is seen from these that, in case of 35 weight % or more of polyethylene terephthalate as in Comparative Examples 9 and 10, the thermal deformation ratio does not almost or entirely occur.

The secondary shape forming was performed next on the spun artificial hair 6 by the same condition as above except for winding around aluminum pipe having a diameter of 18 mm. FIG. 24 is tables showing (A) the curl diameter changes by thermal treatment, (B) and (C) their changing ratios, respectively, for the secondary shape forming of the artificial hairs 6 of Examples 8-14 and Comparative Examples 7-10. From FIG. 24(A), it is seen that, for the artificial hair 6 of Example 8 (PET content 3 weight %), the curl diameter before and after thermal treatment for one minute by a hair drier was changed from 22 mm to 49 mm, that after leaving at room temperature for 24 hours and after shampooing was 45 mm and 44 mm, respectively, thus resulting in secondary shape forming. It was 24 mm after steaming, and was seen to have nearly returned to the initial shape memory state.

For the artificial hair 6 of Example 9 (PET content 5 weight %), the curl diameter before and after thermal treatment for one minute by a hair drier was changed from 22 mm to 45 mm, that after leaving at room temperature for 24 hours and after shampooing was 42 mm and 40 mm, respectively, thus resulting in secondary shape forming. It was 23 mm after steaming, and was seen to have nearly returned to the initial shape memory state.

For the artificial hair 6 of Example 10 (PET content 10 weight %), the curl diameter before and after thermal treatment for one minute by a hair drier was changed from 21 mm to 42 mm, that after leaving at room temperature for 24 hours and after shampooing was 39 mm and 35 mm, respectively, thus resulting in secondary shape forming. It was 23 mm after steaming, and was seen to have nearly returned to the initial shape memory state.

For the artificial hair 6 of Example 11 (PET content 15 weight %), the curl diameter before and after thermal treatment for one minute by a hair drier was changed from 22 mm to 39 mm, that after leaving at room temperature for 24 hours and after shampooing was 35 mm, thus resulting in secondary shape forming. It was 23 mm after steaming, and was seen to have nearly returned to the initial shape memory state.

For the artificial hair 6 of Example 12 (PET content 20 weight %), the curl diameter before and after thermal treatment for one minute by a hair drier was changed from 21 mm to 33 mm, that after leaving at room temperature for 24 hours and after shampooing was 32 mm, thus resulting in secondary shape forming. It was 22 mm after steaming, and was seen to have nearly returned to the initial shape memory state.

For the artificial hair 6 of Example 13 (PET content 25 weight %), the curl diameter before and after thermal treatment for one minute by a hair drier was changed from 21 mm to 32 mm, that after leaving at room temperature for 24 hours and after shampooing was 29 mm and 28 mm, respectively, thus resulting in secondary shape forming. It was 22 mm after steaming, and was seen to have nearly returned to the initial shape memory state.

For the artificial hair 6 of Example 14 (PET content 30 weight %), the curl diameter before and after thermal treatment for one minute by a hair drier was changed from 21 mm to 30 mm, that after leaving at room temperature for 24 hours and after shampooing was 29 mm and 27 mm, respectively, thus resulting in secondary shape forming. It was 22 mm after steaming, and was seen to have nearly returned to the initial shape memory state.

From the results above, as shown in FIG. 24(B) for the artificial hairs 6 of Examples 8-14, the thermal deformation ratios of the artificial hairs 6 from the initial shape memory state after thermal treatment for one minute by a hair drier were 223, 205, 200, 177, 157, 152, and 143%, respectively, which shows that the thermal deformation ratio is lower as polyethylene terephthalate content increases. This characteristics is about same as Examples 1-7. The thermal deformation ratios of the curl diameters of the artificial hairs 6 after leaving at room temperature for 24 hours and after shampooing were 88-97% for Examples 8-14, which shows that the thermal deformation ratio is lower as polyethylene terephthalate content increases.

On the other hand, for the artificial hair of Comparative Example 7 (PET content 0 weight %), it was seen that the curl diameter before and after thermal treatment for one minute by a hair drier was changed from 22 mm to 50 mm, that after leaving at room temperature for 24 hours and after shampooing was 47 mm and 48 mm, respectively, and it was 30 mm after steaming. For the artificial hair of Comparative Example 8 (PET content 1 weight %), it was seen that the curl diameter before and after thermal treatment for one minute by a hair drier was changed from 22 mm to 49 mm, that after leaving at room temperature for 24 hours and after shampooing was 47 mm and 48 mm, respectively, and it was 29 mm after steaming. It is seen from these that, in case that MXD6 was 100% and polyethylene terephthalate was 1 weight % as in Comparative Examples 7 and 8, the thermal deformation ratio was higher than in Examples 8-14.

For the artificial hair of Comparative Example 9 (PET content 35 weight %), it was seen that the curl diameter before and after thermal treatment for one minute by a hair drier was changed from 21 mm to 26 mm, that after leaving at room temperature for 24 hours and after shampooing was 25 mm and 24 mm, respectively, and it was 22 mm after steaming, thus it has nearly returned to the initial shape memory state. For the artificial hair of Comparative Example 10 (PET content 40 weight %), it was seen that the curl diameter before and after thermal treatment for one minute by a hair drier was changed from 21 mm to 23 mm, that after leaving at room temperature for 24 hours and after shampooing was unchanged as 23 mm, and it was 21 mm after steaming showing no thermal deformation. It is seen from these that, in case that polyethylene terephthalate was 35 weight % or more as in Comparative Examples 9 and 10, the thermal deformation ratio did not occur either nearly or at all.

FIG. 24(C) shows the length and thermal deformation ratio (%) before and after thermal treatment for two minutes by a hair drier.

For the artificial hair 6 of Example 8 (PET content 3 weight %), the curl diameter before and after thermal treatment was changed from 22 mm to 53 mm and the thermal deformation ratio was 241%.

For the artificial hair 6 of Example 9 (PET content 5 weight %), the curl diameter before and after thermal treatment was changed from 22 mm to 49 mm and the thermal deformation ratio was 223%.

For the artificial hair 6 of Example 10 (PET content 10 weight %), the curl diameter before and after thermal treatment was changed from 21 mm to 49 mm and the thermal deformation ratio was 233%.

For the artificial hair 6 of Example 11 (PET content 15 weight %), the curl diameter before and after thermal treatment was changed from 22 mm to 45 mm and the thermal deformation ratio was 205%.

For the artificial hair 6 of Example 12 (PET content 20 weight %), the curl diameter before and after thermal treatment was changed from 21 mm to 45 mm and the thermal deformation ratio was 214%.

For the artificial hair 6 of Example 13 (PET content 25 weight %), the curl diameter before and after thermal treatment was changed from 21 mm to 40 mm and the thermal deformation ratio was 190%.

For the artificial hair 6 of Example 14 (PET content 30 weight %), the curl diameter before and after thermal treatment was changed from 21 mm to 34 mm and the thermal deformation ratio was 162%.

From the results above, it is seen that, in case of two minutes thermal treatment above, similarly to the case of one minute, the curl diameter change and its thermal deformation ratio (%) were lower as polyethylene terephthalate content increased. The curl diameter change by said thermal deformation was about same as in Examples 1-7.

On the other hand, for the artificial hair of Comparative Example 7 (PET content 0 weight %), the curl diameter before and after thermal treatment for two minutes by a hair drier was changed from 22 mm to 56 mm, and the thermal deformation ratio was 255%. For the artificial hair of Comparative Example 8 (PET content 1 weight %), the curl diameter before and after thermal treatment was changed from 22 mm to 55 mm, and the thermal deformation ratio was 250%. It is seen from these that, in case of 100% MXD6 and 1 weight % polyethylene terephthalate in Comparative Examples 7 and 8, the thermal deformation ratio was higher than in Examples 8-14.

For the artificial hair of Comparative Example 9 (PET content 35 weight %), the curl diameter before and after thermal treatment for two minutes by a hair drier was changed from 21 mm to 30 mm, and the thermal deformation ratio was 143%. For the artificial hair of Comparative Example 10 (PET content 40 weight %), the curl diameter before and after thermal treatment by a hair drier was changed from 21 mm to 28 mm, and the thermal deformation ratio was 133%. It is seen from these that, in case of 35 weight % or more of polyethylene terephthalate as in Comparative Examples 9 and 10, secondary shape forming could not be performed.

The secondary shape forming was performed next on the spun artificial hair 6 by the same condition as above except for winding around aluminum pipe having a diameter of 32 mm. FIG. 25 shows tables (A) the curl diameter changes by thermal treatment, (B) and (C) their changing ratios, respectively, for the artificial hairs 6 of Examples 8-14 and Comparative Examples 7-10. From FIG. 25(A), it is seen that, for the artificial hair 6 of Example 8 (PET content 3 weight %), the curl diameter before and after thermal treatment for one minute by a hair drier was changed from 37 mm to 59 mm, that after leaving at room temperature for 24 hours and after shampooing was 58 mm and 57 mm, respectively, thus resulting in secondary shape forming. It was 38 mm after steaming, and was seen to have nearly returned to the initial shape memory state.

For the artificial hair 6 of Example 9 (PET content 5 weight %), the curl diameter before and after thermal treatment for one minute by a hair drier was changed from 35 mm to 56 mm, and that after leaving at room temperature for 24 hours and after shampooing was 54 mm and 55 mm, respectively, thus resulting in secondary shape forming. It was 38 mm after steaming, and was seen to have nearly returned to the initial shape memory state.

For the artificial hair 6 of Example 10 (PET content 10 weight %), the curl diameter before and after thermal treatment for one minute by a hair drier was changed from 35 mm to 56 mm, and that after leaving at room temperature for 24 hours and after shampooing was 55 mm and 54 mm, respectively, thus resulting in secondary shape forming. It was 37 mm after steaming, and was seen to have nearly returned to the initial shape memory state.

For the artificial hair 6 of Example 11 (PET content 15 weight %), the curl diameter before and after thermal treatment for one minute by a hair drier was changed from 35 mm to 51 mm, and that after leaving at room temperature for 24 hours and after shampooing was 51 mm and 50 mm, respectively, thus resulting in secondary shape forming. It was 37 mm after steaming, and was seen to have nearly returned to the initial shape memory state.

For the artificial hair 6 of Example 12 (PET content 20 weight %), the curl diameter before and after thermal treatment for one minute by a hair drier was changed from 35 mm to 48 mm, and that after leaving at room temperature for 24 hours and after shampooing was 46 mm and 45 mm, respectively, thus resulting in secondary shape forming. It was 35 mm after steaming, and was seen to have completely returned to the initial shape memory state.

For the artificial hair 6 of Example 13 (PET content 25 weight %), the curl diameter before and after thermal treatment for one minute by a hair drier was changed from 35 mm to 44 mm, and that after leaving at room temperature for 24 hours and after shampooing was 45 mm and 43 mm, respectively, thus resulting in secondary shape forming. It was 36 mm after steaming, and was seen to have nearly returned to the initial shape memory state.

For the artificial hair 6 of Example 14 (PET content 30 weight %), the curl diameter before and after thermal treatment for one minute by a hair drier was changed from 34 mm to 43 mm, and that after leaving at room temperature for 24 hours and after shampooing was 44 mm and 43 mm, respectively, thus resulting in secondary shape forming. It was 35 mm after steaming, and was seen to have nearly returned to the initial shape memory state.

From the results above, as shown in FIG. 25(B) for the artificial hairs 6 of Examples 8-14, the thermal deformation ratios of the artificial hairs 6 from the initial shape memory state after thermal treatment for one minute by a hair drier were 159, 160, 160, 146, 137, 126, and 126%, respectively, which shows that the thermal deformation ratio is lower as polyethylene terephthalate content increases. This characteristics is about same as Examples 1-7. The thermal deformation ratios of the curl diameters of the artificial hairs 6 after leaving at room temperature for 24 hours and after shampooing were 94-102% for Examples 8-14, which shows that the thermal deformation ratio is lower as polyethylene terephthalate content increases.

On the other hand, for the artificial hair of Comparative Example 7 (PET content 0 weight %), it was seen that the curl diameter before and after thermal treatment for one minute by a hair drier was changed from 38 mm to 61 mm, that after leaving at room temperature for 24 hours and after shampooing was unchanged as 60 mm, and it was 47 mm after steaming. For the artificial hair of Comparative Example 8 (PET content 1 weight %), it was seen that the curl diameter before and after thermal treatment for one minute by a hair drier was changed from 37 mm to 61 mm, that after leaving at room temperature for 24 hours and after shampooing was 59 mm and 58 mm, respectively, and it was 46 mm after steaming. It is seen from these that, in case that MXD6 was 100% and polyethylene terephthalate was 1 weight % as in Comparative Examples 7 and 8, the thermal deformation ratio was higher for secondary shape forming, but inferior in recovery ratio to primary shape forming than in Examples 8-14.

For the artificial hair of Comparative Example 9 (PET content 35 weight %), it was seen that the curl diameter before and after thermal treatment for one minute by a hair drier was changed from 34 mm to 38 mm, that after leaving at room temperature for 24 hours and after shampooing was unchanged as 38 mm, and it was 36 mm after steaming.

For the artificial hair of Comparative Example 10 (PET content 40 weight %), it was seen that the curl diameter before and after thermal treatment for one minute by a hair drier was changed from 34 mm to 38 mm, that after leaving at room temperature for 24 hours and after shampooing was 38 mm and 37 mm, respectively, and it was 36 mm after steaming, showing that there is no thermal deformation. It is seen from these that, in case that polyethylene terephthalate was 35 weight % or more as in Comparative Examples 9 and 10, secondary shape forming was not performed either nearly or at all.

FIG. 25(C) shows the length and thermal deformation ratio (%) after thermal treatment for two minutes by a hair drier. For the artificial hair 6 of Example 8 (PET content 3 weight %), the curl diameter before and after thermal treatment was changed from 37 mm to 64 mm and the thermal deformation ratio was 173%.

For the artificial hair 6 of Example 9 (PET content 5 weight %), the curl diameter before and after thermal treatment was changed from 35 mm to 59 mm and the thermal deformation ratio was 169%.

For the artificial hair 6 of Example 10 (PET content 10 weight %), the curl diameter before and after thermal treatment was changed from 35 mm to 59 mm and the thermal deformation ratio was 169%.

For the artificial hair 6 of Example 11 (PET content 15 weight %), the curl diameter before and after thermal treatment was changed from 35 mm to 54 mm and the thermal deformation ratio was 154%.

For the artificial hair 6 of Example 12 (PET content 20 weight %), the curl diameter before and after thermal treatment was changed from 35 mm to 48 mm and the thermal deformation ratio was 137%.

For the artificial hair 6 of Example 13 (PET content 25 weight %), the curl diameter before and after thermal treatment was changed from 35 mm to 48 mm and the thermal deformation ratio was 137%.

For the artificial hair 6 of Example 14 (PET content 30 weight %), the curl diameter before and after thermal treatment was changed from 34 mm to 48 mm and the thermal deformation ratio was 141%.

From the results above, it is seen that, in case of two minutes thermal treatment above, similarly to the case of one minute, the curl diameter change and its thermal deformation ratio (%) were lower as polyethylene terephthalate content increased. The curl diameter change by said thermal deformation was about same as in Examples 1-7.

On the other hand, for the artificial hair of Comparative Example 7 (PET content 0 weight %), the curl diameter before and after thermal treatment for two minutes by a hair drier was changed from 38 mm to 64 mm, and the thermal deformation ratio was 168%. For the artificial hair of Comparative Example 8 (PET content 1 weight %), the curl diameter before and after thermal treatment was changed from 37 mm to 64 mm, and the thermal deformation ratio was 173%. It is seen from these that, in case of 100% MXD6 and 1 weight % polyethylene terephthalate in Comparative Examples 7 and 8, the thermal deformation ratio was higher than in Examples 8-14.

For the artificial hair of Comparative Example 9 (PET content 35 weight %), the curl diameter before and after thermal treatment for two minutes by a hair drier was changed from 34 mm to 45 mm, and the thermal deformation ratio was 132%. For the artificial hair of Comparative Example 10 (PET content 40 weight %), the curl diameter before and after thermal treatment was changed from 34 mm to 40 mm, and the thermal deformation ratio was 118%. It is seen from these that, in case of 35 weight % or more of polyethylene terephthalate as in Comparative Examples 9 and 10, thermal deformation ratio did not occur either almost or at all.

The secondary shape forming was performed next on the spun artificial hair 2 by the same condition as above except for winding around aluminum pipe having a diameter of 50 mm. FIG. 26 is tables showing (A) the curl diameter changes by thermal treatment, (B) and (C) their changing ratios, respectively, for another secondary shape forming of the artificial hairs 6 of Examples 8-14 and Comparative Examples 7-10. From FIG. 26(A), for the artificial hair 6 of Example 8 (PET content 3 weight %), the curl diameter before and after thermal treatment for one minute by a hair drier was changed from 57 mm to 33 mm, that after leaving at room temperature for 24 hours and after shampooing was 33 mm and 35 mm, respectively, thus resulting in secondary shape forming. It was 57 mm after steaming, and was seen to have completely returned to the initial shape memory state.

For the artificial hair 6 of Example 9 (PET content 5 weight %), the curl diameter before and after thermal treatment for one minute by a hair drier was changed from 56 mm to 33 mm, that after leaving at room temperature for 24 hours and after shampooing was 34 mm and 35 mm, respectively, thus resulting in secondary shape forming. It was 56 mm after steaming, and was seen to have completely returned to the initial shape memory state.

For the artificial hair 6 of Example 10 (PET content 10 weight %), the curl diameter before and after thermal treatment for one minute by a hair drier was changed from 56 mm to 34 mm, that after leaving at room temperature for 24 hours and after shampooing was 34 mm and 35 mm, respectively, thus resulting in secondary shape forming. It was 56 mm after steaming, and was seen to have completely returned to the initial shape memory state.

For the artificial hair 6 of Example 11 (PET content 15 weight %), the curl diameter before and after thermal treatment for one minute by a hair drier was changed from 55 mm to 35 mm, that after leaving at room temperature for 24 hours and after shampooing was 36 mm and 38 mm, respectively, thus resulting in secondary shape forming. It was 55 mm after steaming, and was seen to have completely returned to the initial shape memory state.

For the artificial hair 6 of Example 12 (PET content 20 weight %), the curl diameter before and after thermal treatment for one minute by a hair drier was changed from 54 mm to 39 mm, that after leaving at room temperature for 24 hours and after shampooing was 39 mm and 40 mm, respectively, thus resulting in secondary shape forming. It was 54 mm after steaming, and was seen to have completely returned to the initial shape memory state.

For the artificial hair 6 of Example 13 (PET content 25 weight %), the curl diameter before and after thermal treatment for one minute by a hair drier was changed from 54 mm to 39 mm, that after leaving at room temperature for 24 hours and after shampooing was unchanged as 40 mm, thus resulting in secondary shape forming. It was 54 mm after steaming, and was seen to have completely returned to the initial shape memory state.

For the artificial hair 6 of Example 14 (PET content 30 weight %), the curl diameter before and after thermal treatment for one minute by a hair drier was changed from 53 mm to 40 mm, that after leaving at room temperature for 24 hours and after shampooing was 41 mm and 43 mm, respectively, thus resulting in secondary shape forming. It was 53 mm after steaming, and was seen to have completely returned to the initial shape memory state.

From the results above, as shown in FIG. 26(B) for the artificial hairs 6 of Examples 8-14, the thermal deformation ratios of the artificial hairs 6 from the initial shape memory state after thermal treatment for one minute by a hair drier were 58, 59, 61, 64, 72, 72, and 75%, respectively, which shows that the thermal deformation ratio is lower as polyethylene terephthalate content increases. This characteristics is about same as Examples 1-7. The thermal deformation ratios of the curl diameters of the artificial hairs 6 after leaving at room temperature for 24 hours and after shampooing were 100-108% for Examples 8-14, which shows that the thermal deformation ratio is lower as polyethylene terephthalate content increases.

On the other hand, for the artificial hair of Comparative Example 7 (PET content 0 weight %), it was seen that the curl diameter before and after thermal treatment for one minute by a hair drier was changed from 58 mm to 34 mm, that after leaving at room temperature for 24 hours and after shampooing was 35 mm and 37 mm, respectively, and it was 60 mm after steaming. For the artificial hair of Comparative Example 8 (PET content 1 weight %), it was seen that the curl diameter before and after thermal treatment for one minute by a hair drier was changed from 57 mm to 34 mm, that after leaving at room temperature for 24 hours and after shampooing was 46 mm and 47 mm, respectively, and it was 54 mm after steaming. It is seen from these that, in case that MXD6 was 100% and polyethylene terephthalate was 1 weight % as in Comparative Examples 7 and 8, the thermal deformation ratio was higher than in Examples 8-14.

For the artificial hair of Comparative Example 9 (PET content 35 weight %), it was seen that the curl diameter before and after thermal treatment for one minute by a hair drier was changed from 53 mm to 45 mm, that after leaving at room temperature for 24 hours and after shampooing was 46 mm and 47 mm, respectively. It was 54 mm after steaming, and was seen to have nearly returned to the initial shape memory state.

For the artificial hair of Comparative Example 10 (PET content 40 weight %), it was seen that the curl diameter before and after thermal treatment for one minute by a hair drier was from 53 mm to 47 mm, that after leaving at room temperature for 24 hours and after shampooing was unchanged as 47 mm. It was 53 mm after steaming, showing that there is no thermal deformation.

It is seen from these that, in case that polyethylene terephthalate was 35 weight % or more as in Comparative Examples 9 and 10, secondary shape forming was not performed either nearly or at all.

FIG. 26(C) shows the length and thermal deformation ratio (%) after thermal treatment for two minutes by a hair drier. For the artificial hair 6 of Example 8 (PET content 3 weight %), the curl diameter before and after thermal treatment was changed from 57 mm to 27 mm and the thermal deformation ratio was 47%.

For the artificial hair 6 of Example 9 (PET content 5 weight %), the curl diameter before and after thermal treatment was changed from 56 mm to 27 mm and the thermal deformation ratio was 48%.

For the artificial hair 6 of Example 10 (PET content 10 weight %), the curl diameter before and after thermal treatment was changed from 56 mm to 27 mm and the thermal deformation ratio was 48%.

For the artificial hair 6 of Example 11 (PET content 15 weight %), the curl diameter before and after thermal treatment was changed from 55 mm to 29 mm and the thermal deformation ratio was 53%.

For the artificial hair 6 of Example 12 (PET content 20 weight %), the curl diameter before and after thermal treatment was changed from 54 mm to 32 mm and the thermal deformation ratio was 59%.

For the artificial hair 6 of Example 13 (PET content 25 weight %), the curl diameter before and after thermal treatment was changed from 54 mm to 37 mm and the thermal deformation ratio was 69%.

For the artificial hair 6 of Example 14 (PET content 30 weight %), the curl diameter before and after thermal treatment was changed from 53 mm to 39 mm and the thermal deformation ratio was 74%.

From the results above, it is seen that, in case of two minutes thermal treatment above, similarly to the case of one minute, the curl diameter change and its thermal deformation ratio (%) were lower as polyethylene terephthalate content increased. The curl diameter change by said thermal deformation was about the same as in Examples 1-7.

On the other hand, for the artificial hair of Comparative Example 7 (PET content 0 weight %), the curl diameter before and after thermal treatment for two minutes by a hair drier was changed from 58 mm to 27 mm, and the thermal deformation ratio was 47%. For the artificial hair of Comparative Example 8 (PET content 1 weight %), the curl diameter before and after thermal treatment was changed from 57 mm to 27 mm, and the thermal deformation ratio was 47%. It is seen from these that, in case of 100% MXD6 and 1 weight % polyethylene terephthalate in Comparative Examples 7 and 8, the thermal deformation ratio was higher than in Examples 8-14.

For the artificial hair of Comparative Example 9 (PET content 35 weight %), the curl diameter before and after thermal treatment for two minutes by a hair drier was changed from 53 mm to 42 mm, and the thermal deformation ratio was 79%. For the artificial hair of Comparative Example 10 (PET content 40 weight %), the curl diameter before and after thermal treatment was changed from 53 mm to 44 mm, and the thermal deformation ratio was 83%. It is seen from these that, in case of 35 weight % or more of polyethylene terephthalate as in Comparative Examples 9 and 10, secondary shape forming could not be performed either almost or at all.

Explanation is next made of the measurement results of bending rigidities of artificial hair in Examples and in Comparative Examples. Bending rigidity is a property applied to fiber or the like in general, and has been recently recognized as the property correlating to such sensuous properties as feeling (appearance, tactile, and texture). For the measurement of bending rigidity of fiber, Kawabata Method of Measurement and its principle are widely known for textile, and using a Single Hair Bending Tester (Katotech, Ltd., Model KES-FB2-SH) modified from the above, bending rigidity of artificial hair was measured. As the measurement method, for artificial and natural hairs as samples in all the cases of Examples and Comparative Examples of the present invention, whole of a single strand of 1 cm length was bent arc-shaped at a constant rate to a certain curvature, a minute bending momentum accompanying it was detected, and the relationship between the bending momentum and the curvature was measured. From this, a bending rigidity was obtained by bending momentum/curvature change. Some typical measurement conditions are shown below.

(Measurement Conditions)

Distance between Chucks: 1 cm

Torque Detector Twist Detection by Torsion Wire (Steel Wire)

Torque Sensitivity: 1.0 gf·cm (at Full Scale 10 V)

Curvature: ±12.5 $cm^{-1}$

Bending Deviation Rate: 0.5 $cm^{-1}$/sec

Measurement Cycle One forth and Back

Here, the chuck is a mechanism to pinch said each hair of 1 cm length.

Figure 27:
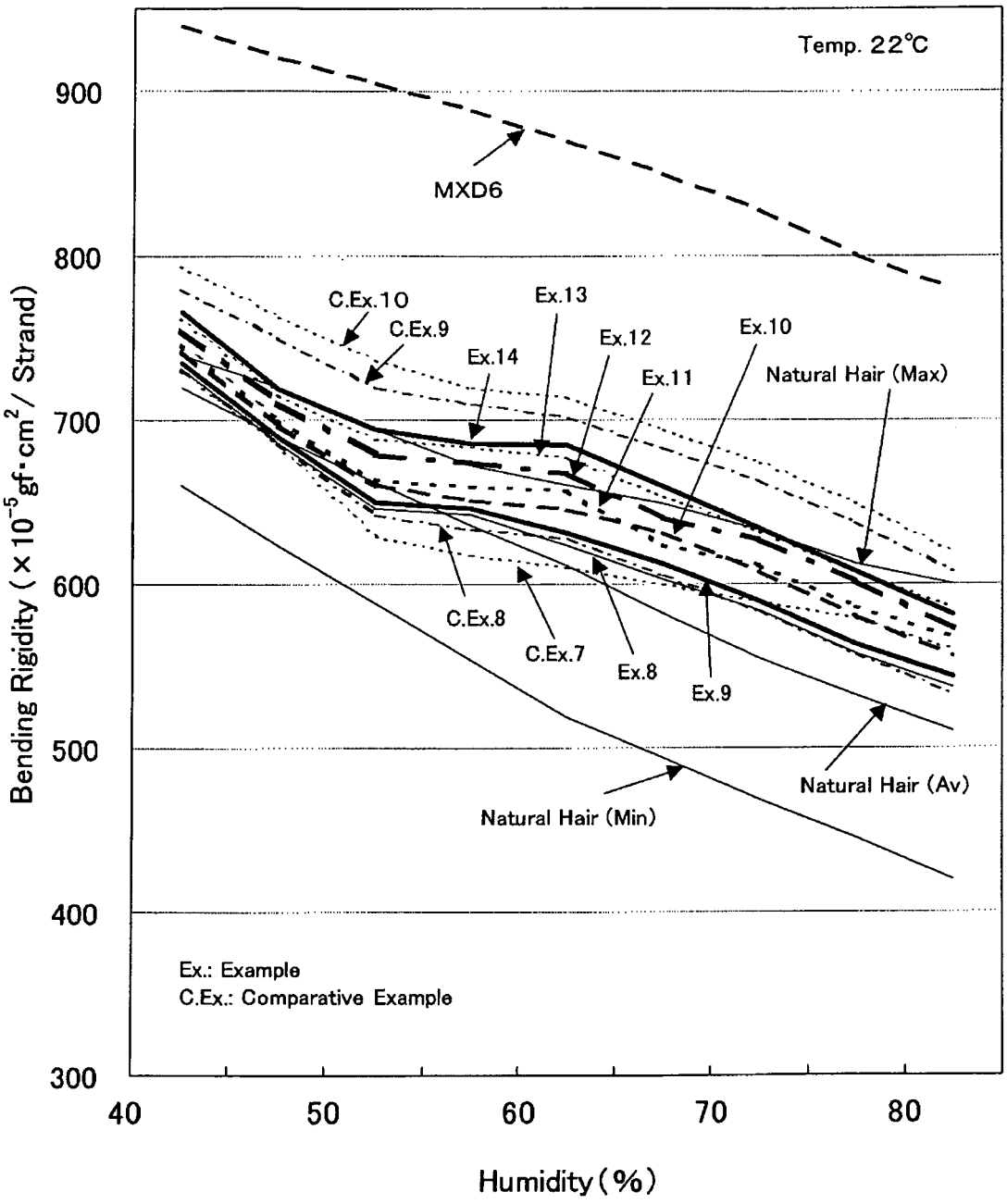
FIG. 27 is a graph showing humidity dependency of bending rigidity of artificial hairs of Examples 8-14 and Comparative Examples 7, 8, 9, and 10.

FIG. 27 is a graph showing the humidity dependency of bending rigidity of the artificial hairs 6 of Examples 8-14 and Comparative Examples 7, 8, 9, and 10. In the figure, the abscissa axis represents humidity (%), and the ordinate axis represents bending rigidity ($10^{-5}$ $gfcm^2$/strand). The measurement temperature was 22° C.

In FIG. 27, humidity dependency of bending rigidity of artificial hair of Examples and Comparative Examples is shown together with that of natural hair. Since natural hairs have wide personal deviation, hairs were collected from 25 males and 38 females of respective ages between 20 and 50 years old, bending rigidities of the samples of 80 μm diameter were measured, and their average was defined as a standard value. In addition, their maximum and minimum values were also shown in the figure.

It is seen that the average value of bending rigidities of natural hair was $720\times10^{-5}$ and $510\times10^{-5}$ $gfcm^2$/strand for humidity 40 and 80%, respectively, and decreased monotonously with humidity increase.

On the other hand, the maximum value of bending rigidity of natural hair was $740\times10^{-5}$ and $600\times10^{-5}$ $gfcm^2$/strand for humidity 40 and 80%, respectively, and its minimum value was $660\times10^{-5}$ and $420\times10^{-5}$ $gfcm^2$/strand for humidity 40 and 80%, and thus bending rigidity of natural hair has deviation.

The artificial hair 6 of Example 8 had a thread diameter of 80 μm, and a sheath/core volume ratio of 1/5. Its core was made of MXD6 nylon and polyethylene terephthalate (3 weight %), its bending rigidity was $731\times10^{-5}$ $gfcm^2$/strand for humidity 40%, it gradually decreased as humidity increased, down to about $624\times10^{-5}$ $gfcm^2$/strand for humidity 60%, and further down to about $537\times10^{-5}$ $gfcm^2$/strand for humidity 80%.

From this result, in case of artificial hair of Example 8, it showed higher bending rigidity than the average value of natural hair, but lower than the maximum value, thus showing bending rigidity and humidity dependency similar to natural hair.

The difference of the artificial hair of Example 9 (PET content 5 weight %) from the artificial hair of Example 8 was the composition of the core. For the artificial hair 6 of Example 9, its bending rigidity was $735\times10^{-5}$ $gfcm^2$/strand for humidity 40%, it gradually decreased as humidity increased, down to about $631\times10^{-5}$ $gfcm^2$/strand for humidity 60%, and further down to about $543\times10^{-5}$ $gfcm^2$/strand for humidity 80%.

From this result, in case of artificial hair of Example 9, it showed higher bending rigidity than the average value of natural hair, but lower than the maximum value, thus showing bending rigidity and humidity dependency similar to natural hair.

The difference of the artificial hair of Example 10 (PET content 10 weight %) from the artificial hair of Example 8 was the composition of the core. For the artificial hair of Example 10, its bending rigidity was $742\times10^{-5}$ $gfcm^2$/strand for humidity 40%, it gradually decreased as humidity increased, down to about $645\times10^{-5}$ $gfcm^2$/strand for humidity 60%, and further down to about $556\times10^{-5}$ $gfcm^2$/strand for humidity 80%.

From this result, in case of artificial hair of Example 10, it showed higher bending rigidity than the average and maximum values of natural hair, but showing bending rigidity and humidity dependency similar to natural hair.

The difference of the artificial hair of Example 11 (PET content 15 weight %) from the artificial hair of Example 8 was the composition of the core. For the artificial hair of Example 14, its bending rigidity was $746\times10^{-5}$ $gfcm^2$/strand for humidity 40%, it gradually decreased as humidity increased, down to about $657\times10^{-5}$ $gfcm^2$/strand for humidity 60%, and further down to about $567\times10^{-5}$ $gfcm^2$/strand for humidity 80%.

From this result, in case of artificial hair of Example 11, it showed higher bending rigidity than the average and maximum values of natural hair, but showing bending rigidity and humidity dependency similar to natural hair.

The difference of the artificial hair of Example 12 (PET content 20 weight %) from the artificial hair of Example 8 was the composition of the core. For the artificial hair of Example 12, its bending rigidity was $755\times10^{-5}$ $gfcm^2$/strand for humidity 40%, it gradually decreased as humidity increased, down to about $668\times10^{-5}$ $gfcm^2$/strand for humidity 60%, and further down to about $573\times10^{-5}$ $gfcm^2$/strand for humidity 80%.

From this result, in case of artificial hair of Example 12, it showed higher bending rigidity than the average and maximum values of natural hair, but showing bending rigidity and humidity dependency similar to natural hair.

The difference of the artificial hair of Example 13 (PET content 25 weight %) from the artificial hair of Example 8 was the composition of the core. For the artificial hair of Example 13, its bending rigidity was $762\times10^{-5}$ $gfcm^2$/strand for humidity 40%, it gradually decreased as humidity increased, down to about $677\times10^{-5}$ $gfcm^2$/strand for humidity 60%, and further down to about $586\times10^{-5}$ $gfcm^2$/strand for humidity 80%.

From this result, in case of artificial hair of Example 13, it showed higher bending rigidity than the average and maximum values of natural hair, but showing bending rigidity and humidity dependency similar to natural hair.

The difference of the artificial hair of Example 14 (PET content 30 weight %) from the artificial hair of Example 8 was the composition of the core. For the artificial hair of Example 11, its bending rigidity was $766\times10^{-5}$ $gfcm^2$/strand for humidity 40%, it gradually decreased as humidity increased, down to about $685\times10^{-5}$ $gfcm^2$/strand for humidity 60%, and further down to about $581\times10^{-5}$ $gfcm^2$/strand for humidity 80%.

From this result, in case of artificial hair of Example 14, it showed higher bending rigidity than the average and maximum values of natural hair, but showing bending rigidity and humidity dependency similar to natural hair.

The artificial hair of Comparative Example 7 (PET content 0 weight %) had the same sheath/core structure as the artificial hair of Example 8. For said artificial hair, its bending rigidity was $730\times10^{-5}$ gfcm$^2$/strand for humidity 40%, it gradually decreased as humidity increased, down to about $610\times10^{-5}$ gfcm$^2$/strand for humidity 60%, and further down to about $560\times10^{-5}$ gfcm$^2$/strand for humidity 80%.

From this result, in case of artificial hair of Comparative Example 7, it showed higher bending rigidity than the average value, but lower than the maximum value of natural hair, showing bending rigidity and humidity dependency similar to natural hair.

The artificial hair of Comparative Example 8 (PET content 1 weight %) had the same sheath/core structure as the artificial hair of Example 8. For said artificial hair, its bending rigidity was $731\times10^{-5}$ gfcm$^2$/strand for humidity 40%, it gradually decreased as humidity increased, down to about $628\times10^{-5}$ gfcm$^2$/strand for humidity 60%, and further down to about $533\times10^{-5}$ gfcm$^2$/strand for humidity 80%.

From this result, in case of artificial hair of Comparative Example 8, it showed higher bending rigidity than the average value, but lower than the maximum value of natural hair, showing bending rigidity and humidity dependency similar to natural hair.

The artificial hair of Comparative Example 9 (PET content 35 weight %) had the same sheath/core structure as Example 8. For said artificial hair, its bending rigidity was $780\times10^{-5}$ gfcm$^2$/strand for humidity 40%, it gradually decreased as humidity increased, down to $702\times10^{-5}$ gfcm$^2$/strand for humidity 60%, and further down to $608\times10^{-5}$ gfcm$^2$/strand for humidity 80%.

The artificial hair of Comparative Example 10 (PET content 40 weight %) had the same sheath/core structure as Example 8. For said artificial hair, its bending rigidity was $794\times10^{-5}$ gfcm$^2$/strand for humidity 40%, it gradually decreased as humidity increased, down to $714\times10^{-5}$ gfcm$^2$/strand for humidity 60%, and further down to $619\times10^{-5}$ gfcm$^2$/strand for humidity 80%.

From these results, in case of artificial hairs of Comparative Examples 9 and 10, it showed higher bending rigidity than the maximum value of natural hair over the whole humidity range for measurement.

Here, in FIG. 27 for reference, is shown the bending rigidity of a single filament artificial hair made of MXD6, and the bending rigidities for humidity 40, 60, and 80% were $940\times10^{-5}$ gfcm$^2$/strand, $870\times10^{-5}$ gfcm$^2$/strand, and $780\times10^{-5}$ gfcm$^2$/strand, respectively, thus decreasing as humidity increased, but all of these values are seen to be higher than those of natural hair or the artificial hairs of Examples 8-14 and Comparative Examples 7-10.

From the results above, it is seen that, for the artificial hair of the sheath/core structure in Examples 8-14, secondary shape forming could be freely performed from the state memorizing the initial shape, said secondary shape forming were maintained in the state of room temperature or after shampooing, and could be returned again to the initial shape memory state after steaming. Further, the artificial hair of the sheath/core structure in Examples 8-14 were seen to show bending rigidity and its humidity dependency similar to natural hair.

The best modes for carrying out the present invention as explained above may be properly modified variously within the scope of the range of invention recited in the claims.

What is claimed is:

1. An artificial hair consisting of a sheath/core double filament structure comprising a core portion and a sheath portion covering said core portion, wherein said core portion consists of polyethylene terephthalate and a semi-aromatic polyamide resin mixed together, the polyethylene terephthalate having a concentration of 3-30 weight % in the core portion, said semi-aromatic polyamide resin having glass transition temperature between about 60-120° C., said semi-aromatic polyamide resin being an alternate copolymer of metaxylylene diamine and adipic acid and said sheath portion is made of a polyamide resin having lower bending rigidity than said core portion.

2. The artificial hair as set forth in claim 1, wherein said sheath portion is made of a linear saturated aliphatic polyamide resin.

3. The artificial hair as set forth in claim 2, wherein said linear saturated aliphatic polyamide resin is a ring opening polymer of caprolactam, and/or an alternate copolymer of hexamethylene diamine and adipic acid.

4. The artificial hair as set forth in claim 1, wherein the surface of said artificial hair is deglossed by having a fine concave and convex portion.

5. The artificial hair as set forth in claim 4, wherein said fine concave and convex portion is formed by spherulite formation and/or blast processing.

6. The artificial hair as set forth in claim 1, wherein said artificial hair contains pigments and/or dyes.

7. The artificial hair as set forth in claim 1, wherein the sheath/core weight ratio of said sheath and core portions is 10/90-35/65.

8. A wig comprising a wig base and artificial hair tied to said wig base, wherein said artificial hair consists of a sheath/core double filament structure comprising a core portion and a sheath portion covering said core portion, said core portion consists of polyethylene terephthalate and a semi-aromatic polyamide resin mixed together, the polyethylene terephthalate having a concentration of 3-30 weight % in the core portion, said semi-aromatic polyamide resin having glass transition temperature between about 60-120° C., said semi-aromatic polyamide resin being an alternate copolymer of metaxylylene diamine and adipic acid and said sheath portion is made of a polyamide resin having lower bending rigidity than said core portion.

9. The wig as set forth in claim 8, wherein said sheath portion is made of a linear saturated aliphatic polyamide resin.

10. The wig as set forth in claim 9, wherein said linear saturated aliphatic polyamide resin is a ring opening polymer of caprolactam, and/or an alternate copolymer of hexamethylene diamine and adipic acid.

11. The wig as set forth in claim 8, wherein the surface of said artificial hair is deglossed by having a fine concave and convex portion.

12. The wig as set forth in claim 11, wherein said fine concave and convex portion is formed by spherulite and/or blast processing.

13. The wig as set forth in claim 8, wherein said artificial hair contains pigments and/or dyes.

14. The wig as set forth in claim 8, wherein the sheath/core weight ratio of said sheath and core portions is 10/90-35/65.

* * * * *